US011495917B2

(12) United States Patent
Buck et al.

(10) Patent No.: US 11,495,917 B2
(45) Date of Patent: Nov. 8, 2022

(54) RIGHT-ANGLE ELECTRICAL CONNECTOR AND ELECTRICAL CONTACTS FOR A RIGHT-ANGLE CONNECTOR

(71) Applicant: SAMTEC, INC., New Albany, IN (US)

(72) Inventors: Jonathan E. Buck, Hershey, PA (US); John Mongold, Todd, PA (US); Madhumitha Rengarajan, Mechanicsburg, PA (US)

(73) Assignee: SAMTEC, INC., New Albany, IN (US)

( * ) Notice: Subject to any disclaimer, the term of this patent is extended or adjusted under 35 U.S.C. 154(b) by 0 days.

(21) Appl. No.: 16/758,579

(22) PCT Filed: Oct. 24, 2018

(86) PCT No.: PCT/US2018/057266
§ 371 (c)(1),
(2) Date: Apr. 23, 2020

(87) PCT Pub. No.: WO2019/084110
PCT Pub. Date: May 2, 2019

(65) Prior Publication Data

US 2020/0350731 A1 Nov. 5, 2020

Related U.S. Application Data

(60) Provisional application No. 62/639,261, filed on Mar. 6, 2018, provisional application No. 62/623,289, filed
(Continued)

(51) Int. Cl.
*H01R 13/6471* (2011.01)
*H01R 12/72* (2011.01)
(Continued)

(52) U.S. Cl.
CPC ..... *H01R 13/6471* (2013.01); *H01R 12/724* (2013.01); *H01R 13/6474* (2013.01); *H01R 43/205* (2013.01)

(58) Field of Classification Search
CPC .... H01R 24/64; H01R 12/724; H01R 12/725; H01R 12/721; H01R 13/6471;
(Continued)

(56) References Cited

U.S. PATENT DOCUMENTS 3,329,926 A 7/1967 Akin et al.
4,158,745 A * 6/1979 Keller ..... H01L 21/4842 174/16.3
(Continued)

FOREIGN PATENT DOCUMENTS

CN 1467884 A 1/2004
CN 2749117 Y 12/2005
(Continued)

OTHER PUBLICATIONS

Har-bus Connectors, p. 5, (JPO Division of Design, Official Gazette Known Data No. HD13004493), Harting KGaA, Acceptance Date—Mar. 16, 2001.
(Continued)

*Primary Examiner* — Marcus E Harcum
(74) *Attorney, Agent, or Firm* — BakerHostetler

(57) ABSTRACT

An electrical connector has a row of signal contacts, and a ground shield disposed inwardly from the signal contacts. Each of the signal and ground contacts has a first segment and a second segment. Each first segment defines a mounting end that can mount to a first electrical component, and each second segment defines a mating end that can mate with a second electrical component. The first and second segments of each signal contact and the ground contact are angularly offset from one another so as to define an angle of
(Continued)

between 75 degrees and 105 degrees between the first and second segments. The first and second segments of each signal contact and the ground contact can be coupled to one another to define the angle. Alternatively, the signal and ground contacts can be bent along a common bend line that intersects the signal contacts and the ground contact.

19 Claims, 16 Drawing Sheets

Related U.S. Application Data on Jan. 29, 2018, provisional application No. 62/576,146, filed on Oct. 24, 2017.

(51) Int. Cl.
*H01R 13/6474* (2011.01)
*H01R 43/20* (2006.01)

(58) Field of Classification Search
CPC ..... H01R 13/6474; H01R 13/6585; H01R 9/2675; H01R 9/2408; H01R 43/20
USPC ..... 439/891, 637
See application file for complete search history.

(56) References Cited

U.S. PATENT DOCUMENTS 4,621,885 A 11/1986 Szczesny et al.
D316,704 S 5/1991 Eto et al.
D316,846 S 5/1991 Moriai et al.
D327,469 S 6/1992 Moriai et al.
D328,590 S 8/1992 Tanaka
5,340,329 A 8/1994 Hirai
5,919,063 A 7/1999 Wang
5,951,340 A * 9/1999 Mueller ..... H01R 25/161 439/891
D419,135 S 1/2000 Wu et al.
6,146,205 A 11/2000 Lai
D435,245 S 12/2000 Hwang
D435,831 S 1/2001 Ko
6,176,716 B1 * 1/2001 Mercurio ..... H01R 11/12 439/166
D449,276 S 10/2001 Hwang et al.
D459,702 S 7/2002 Watanabe
6,462,957 B1 10/2002 Kwong et al.
6,491,529 B2 * 12/2002 Gray ..... H01R 24/50 439/79
6,565,383 B1 5/2003 Wu
6,652,318 B1 11/2003 Winings et al.
6,655,979 B1 12/2003 Lee
D485,532 S 1/2004 Lai
D490,377 S 5/2004 Sato
6,736,663 B2 5/2004 Lee et al.
6,799,986 B2 10/2004 Igarashi et al.
6,848,932 B2 2/2005 Bowling et al.
6,860,750 B1 3/2005 Wu
6,890,205 B1 5/2005 Wu
6,945,796 B2 9/2005 Bassler et al.
6,951,474 B1 10/2005 Wu
7,083,459 B1 8/2006 Wu et al.
7,226,307 B1 6/2007 Chen et al.
D562,246 S 2/2008 Matsuzaki et al.
D576,954 S 9/2008 Hsiao
7,422,494 B2 * 9/2008 Fry, Jr. ..... H01R 13/15 439/891
7,581,978 B1 9/2009 Briant
D601,506 S 10/2009 Fukazawa et al.
D605,602 S 12/2009 Mase
7,666,023 B2 2/2010 Wu
7,686,622 B2 3/2010 Dawiedczyk et al.
7,794,262 B2 9/2010 Briant et al.
7,837,522 B1 11/2010 Hoover et al.
7,841,889 B2 11/2010 Gerard et al.
D631,016 S 1/2011 Iijima et al.
D640,638 S 6/2011 Ngo
D649,518 S 11/2011 Zhu
D650,754 S 12/2011 Bodmann et al.
8,282,430 B2 10/2012 He et al.
8,348,701 B1 1/2013 Lan et al.
8,398,429 B2 3/2013 Costello
8,506,323 B2 8/2013 Costello
8,591,248 B2 * 11/2013 Pepe ..... H01R 24/64 439/405
D699,683 S 2/2014 Yoshisuji
D706,724 S 6/2014 McCartin et al.
D708,580 S 7/2014 McCartin et al.
8,998,645 B2 4/2015 Vanaleck et al.
D729,745 S 5/2015 Vanderwoud
D745,852 S 12/2015 Harper et al.
9,209,545 B2 12/2015 Hemmi et al.
D748,589 S 2/2016 Endo et al.
9,257,778 B2 2/2016 Buck et al.
9,293,852 B2 * 3/2016 Glick ..... H01R 13/11
D768,089 S 10/2016 Liu
D772,168 S 11/2016 Harper et al.
9,608,348 B2 3/2017 Wanha
D801,283 S 10/2017 Walsh et al.
D816,044 S 4/2018 Zerebilov et al.
9,985,367 B2 5/2018 Wahna et al.
D823,814 S 7/2018 Buck et al.
10,020,614 B1 7/2018 Bucher
D826,863 S 8/2018 Schafmeister
D835,046 S 12/2018 Bingham
10,199,768 B2 2/2019 Nagasaki
10,230,196 B2 3/2019 Phillips et al.
10,439,330 B2 10/2019 Mongold et al.
10,534,145 B2 1/2020 Zbinden et al.
10,574,002 B1 * 2/2020 Henry ..... H01R 13/6587
D877,084 S 3/2020 Buck et al.
D877,700 S 3/2020 Buck et al.
D896,183 S 9/2020 Musser et al.
D924,169 S 7/2021 Buck et al.
D941,780 S 1/2022 Buck et al.
2003/0143886 A1 7/2003 Nemoto
2003/0194889 A1 10/2003 Golat et al.
2003/0228788 A1 12/2003 Igarashi et al.
2004/0115983 A1 6/2004 Liang
2004/0121633 A1 6/2004 David et al.
2004/0248446 A1 12/2004 Kuroki
2005/0101176 A1 5/2005 Kachlic
2005/0148219 A1 7/2005 Myer et al.
2007/0155255 A1 * 7/2007 Galauner ..... H01R 12/585 439/891
2007/0281543 A1 12/2007 Boegelein et al.
2008/0102702 A1 5/2008 Sercu et al.
2008/0166090 A1 7/2008 Kiani et al.
2008/0305690 A1 12/2008 Zhang et al.
2009/0201658 A1 8/2009 Lemke et al.
2009/0215309 A1 8/2009 Mongold et al.
2009/0233492 A1 9/2009 Mizukami et al.
2009/0291584 A1 11/2009 Wu
2010/0178779 A1 7/2010 Davis et al.
2010/0203765 A1 8/2010 Goossens et al.
2010/0255731 A1 10/2010 Oyake et al.
2011/0294357 A1 12/2011 Tanaka
2011/0300736 A1 12/2011 Katagiri et al.
2012/0058665 A1 3/2012 Zerebilov et al.
2012/0329305 A1 12/2012 Ritter et al.
2013/0023157 A1 1/2013 Omer
2013/0115815 A1 5/2013 Lim et al.
2013/0273781 A1 10/2013 Buck et al.
2014/0038447 A1 2/2014 Brown et al.
2014/0065899 A1 * 3/2014 Aboulkassem ..... H01R 13/04 439/891
2014/0213125 A1 * 7/2014 Hemmi ..... H01R 13/10 439/891
2014/0220795 A1 8/2014 Bai et al.
2014/0242817 A1 * 8/2014 Mongold ..... H01R 13/428 439/83
2014/0273670 A1 * 9/2014 Crutcher ..... H01R 4/5025 439/891

(56) References Cited

U.S. PATENT DOCUMENTS

| | | | | |
|---|---|---|---|---|
| 2015/0079845 | A1 | 3/2015 | Wanha et al. | |
| 2015/0255895 | A1 | 9/2015 | Knowlden et al. | |
| 2016/0006150 | A1 | 1/2016 | Bachmutsky | |
| 2016/0111824 | A1 | 4/2016 | Phillips | |
| 2016/0164196 | A1* | 6/2016 | Wu | H01R 4/4818 439/816 |
| 2016/0233598 | A1 | 8/2016 | Kg | |
| 2016/0261060 | A1 | 9/2016 | Sechrist | |
| 2017/0077621 | A1 | 3/2017 | Liao | |
| 2017/0170604 | A1 | 6/2017 | Endo et al. | |
| 2017/0187158 | A1 | 6/2017 | Crowe | |
| 2017/0229792 | A1* | 8/2017 | Wu | H01R 4/58 |
| 2018/0054012 | A1 | 2/2018 | Zhu et al. | |
| 2018/0076581 | A1* | 3/2018 | Tsai | H01R 24/60 |
| 2018/0131144 | A1 | 5/2018 | King et al. | |
| 2018/0294592 | A1* | 10/2018 | Huang | H01R 12/721 |
| 2019/0013619 | A1 | 1/2019 | Obata et al. | |
| 2019/0044287 | A1* | 2/2019 | Lin | H01R 13/502 |
| 2019/0051587 | A1 | 2/2019 | Azeroual et al. | |
| 2019/0089098 | A1* | 3/2019 | Cheng | H01R 4/02 |
| 2019/0089106 | A1 | 3/2019 | Regnier | |
| 2019/0097357 | A1 | 3/2019 | Mongold | |
| 2019/0131743 | A1* | 5/2019 | Hsu | H01R 13/405 |
| 2019/0393634 | A1* | 12/2019 | Kao | H01R 12/7005 |
| 2020/0044395 | A1* | 2/2020 | Naganuma | H01R 4/24 |
| 2020/0212631 | A1 | 7/2020 | Buck et al. | |
| 2020/0220279 | A1* | 7/2020 | Koellmann | H01R 4/4836 |
| 2021/0151934 | A1 | 5/2021 | Faith | |

FOREIGN PATENT DOCUMENTS

| | | | |
|---|---|---|---|
| CN | 200950498 | Y | 9/2007 |
| CN | 101171724 | A | 4/2008 |
| CN | 201117955 | Y | 9/2008 |
| CN | 101297441 | A | 10/2008 |
| CN | 201570699 | U | 9/2010 |
| CN | 201789145 | U | 4/2011 |
| CN | 102222828 | A | 10/2011 |
| CN | 301785292 | S | 1/2012 |
| CN | 103828129 | A | 5/2014 |
| CN | 303032002 | S | 12/2014 |
| CN | 104332767 | A | 2/2015 |
| CN | 105703157 | A | 6/2016 |
| CN | 106207534 | A | 12/2016 |
| EP | 1225664 | A2 | 7/2002 |
| JP | 5940898 | | 10/1984 |
| JP | 60-007258 | | 2/1985 |
| JP | 0985825 | | 12/1995 |
| JP | 09-085825 | A | 3/1997 |
| JP | 1206569 | | 4/2004 |
| JP | 2009-218119 | A | 9/2009 |
| JP | D1419110 | S | 7/2011 |
| JP | 2018-014964 | A | 2/2018 |
| JP | 1655265 | S | 3/2020 |
| JP | 1655173 | S | 8/2020 |
| KR | 0193346 | | 2/1997 |
| TW | 404579 | U | 9/2000 |
| TW | D130799 | | 10/2008 |
| TW | D132453 | | 12/2009 |
| TW | D163315 | | 9/2013 |
| TW | D172197 | | 4/2014 |
| TW | D166670 | | 3/2015 |
| TW | D168325 | | 6/2015 |
| TW | D168328 | | 6/2015 |
| TW | D198418 | S | 7/2019 |
| WO | 2013/155147 | A1 | 10/2013 |
| WO | 2015/116407 | A1 | 8/2015 |
| WO | 2017/218771 | | 12/2017 |
| WO | 2018/231896 | A1 | 12/2018 |
| WO | 2019/018728 | A1 | 1/2019 |
| WO | 2019/084110 | A1 | 5/2019 |

OTHER PUBLICATIONS

Har-bus Connectors, p. 5, (JPO Division of Design, Official Gazette Known Data No. HD13004494), Harting KGaA, Acceptance Date—Mar. 16, 2001.

"Cable Assemblies/BiPass I/O/High-Speed Solutions", Molex, LLC., © 2018, 3 pages.

"Credo demonstrates 112 G PAM4 SR, 56G PAM4 LR, and 56G NRZ Serdes Technology at DesignCon", Credo Semiconductor, Jan. 30, 2017, 6 pages.

Buck et al., "Contact Wafer", U.S. Appl. No. 29/611,655, filed Jul. 14, 2017.

Buck et al., "Contact Wafer", U.S. Appl. No. 29/647,260, filed May 11, 2018.

Buck et al., "Contact Wafers", U.S. Appl. No. 29/652,017, filed Dec. 20, 2018.

Buck et al., "Electrical Connector", U.S. Appl. No. 29/610,936, filed Jul. 17, 2017.

Buck et al., "Electrical Connector", U.S. Appl. No. 29/611,028, filed Jul. 18, 2017.

Mongold et al., "Overmolded Lead Frame Providing Contact Support and Impedance Matching Properties", U.S. Appl. No. 15/566,504, filed Oct. 13, 2017.

TE Connectivity introduces cabled STRADA Whisper connectors, Connector Tips, https://www.connectortips.com/te-connectivity-introduces-cabled-strada-whisper-connectors/, website accessed Jul. 20, 2020.

Amphenol TCS, "PAL 4×8 POS, 30AWG, 40GHz CBL ASSY", Part No. HS30720-XXX, Drawing No. CHS30720500, dated Oct. 31, 2017, 3 pages.

Gannon, "TE Connectivity introduces cabled STRADA Whisper connectors", Aug. 23, 2017, pp. 1-7, https://www.connectortips.com/te-connectivity-introduces-cabled-strada-whisper-connectors/.

* cited by examiner

RIGHT-ANGLE ELECTRICAL CONNECTOR AND ELECTRICAL CONTACTS FOR A RIGHT-ANGLE CONNECTOR

CROSS-REFERENCE TO RELATED APPLICATIONS

This application is the National Stage Application of International Patent Application No. PCT/US2018/057266, filed Oct. 24, 2018, which claims priority to U.S. provisional patent application No. 62/576,146, filed on Oct. 24, 2017, U.S. provisional patent application No. 62/623,289, filed on Jan. 29, 2018, and U.S. provisional patent application No. 62/639,261, filed on Mar. 6, 2018, the teachings of all of which are hereby incorporated by reference as if set forth in their entirety herein.

BACKGROUND

Electrical connector systems generally include circuits and components on one or more interconnected circuit boards. Examples of circuit boards in an electrical connector system can include daughter boards, motherboards, backplane boards, midplane boards, or the like. Electrical assemblies can further include an electrical connector that provides an interface between electrical components, and provides electrically conductive paths for electrical communications data signals and/or electrical power so as to place the electrical components in electrical communication with each other.

As another example, a conventional electrical connector system can include connectors that place a first substrate that can be a printed circuit board (PCB) into electrical communication with a second substrate that can also be a PCB. The electrical connector system can include first and second electrical connectors that mate with one another. The first electrical connector includes a first dielectric connector housing and a first plurality of contacts supported by the first connector housing. The first electrical connector defines a first mounting interface that mounts onto the first substrate, and a first mating interface that mates with the second electrical connector. The second electrical connector includes a second dielectric connector housing and a second plurality of contacts supported by the second connector housing. The second electrical connector defines a second mounting interface that mounts onto the second substrate, and a second mating interface that with mates the first electrical connector at the first mating interface. When mated, the connectors provide an electrically conductive path between traces carried by the first substrate and traces carried by the second substrate.

SUMMARY OF THE INVENTION

In one embodiment, an electrical contact for an electrical connector comprises a first segment and a second segment. The first segment has a first pair of broadsides that are opposite one another, a first pair of edges that are opposite one another and that extend between the first pair of broadsides, a mounting end that is configured to mount to a first electrical component, and a first coupling end offset from the mounting end. The first coupling end defines at least one first coupling feature. The second segment has a second pair of broadsides that are opposite one another, a second pair of edges that are opposite one another and that extend between the second pair of broadsides, a mating end that is configured to mate with a second electrical component, and a second coupling end offset from the mating end. The second coupling end defines at least one second coupling feature. The at least one first coupling feature and the at least one second coupling feature are coupled to one another such that electrical contact defines an angle between 75 degrees and 105 degrees between the first and second segments and such that the first and second segments define a continuous conductive path between the mounting end and the mating end.

In another embodiment, a plurality of electrical contacts for an angled connector comprise a plurality of signal contacts and a ground shield. The plurality of signal contacts are spaced from one another in a row along a lateral direction. Each signal contact comprises a first signal segment and a second signal segment. The first signal segment has a signal mounting end that is configured to mount to a first electrical component, and a first signal coupling end offset from the signal mounting end. The second signal segment has a signal mating end that is configured to mate with a second electrical component, and a second signal coupling end offset from the signal mating end. The second signal coupling end is coupled to the first signal coupling end such that the signal contact defines an angle between 75 degrees and 105 degrees between the first and second signal segments, and so as to define a continuous conductive path from the signal mounting end to the signal mating end. The ground shield that is spaced from the signal contacts along an inward-outward direction, perpendicular to the lateral direction. The ground shield comprises a first ground segment and a second ground segment. The first ground segment has a ground mounting end that is configured to mount to a first electrical component, and a first ground coupling end offset from the ground mounting end. The second ground segment has a ground mating end that is configured to mate with a second electrical component, and a second ground coupling end offset from the ground mating end. The second ground coupling end is coupled to the first ground coupling end such that the ground shield defines an angle between 75 degrees and 105 degrees between the first and second ground segments and so as to define a continuous conductive path from the ground mounting end to the ground mating end.

Yet another embodiment is a method of assembling an angled electrical connector. The method comprises attaching at least one bank of electrical contacts to a housing of the electrical connector. Each bank comprises a plurality of signal contacts arranged in a row along a lateral direction, and a ground shield offset from the signal contacts along an inward-outward direction, perpendicular to the lateral direction. The step of attaching comprises, for each bank and for each signal contact in the bank, coupling a first signal segment of the signal contact to a second signal segment of the signal contact so as to define an angle between 75 degrees and 105 degrees between the first and second signal segments, and so as to define a continuous conductive path from a mounting end of the first signal segment to a mating end of the second signal segment. The step of attaching also comprises coupling a first ground segment of the ground shield to a second ground segment of the ground shield so as to define an angle between 75 degrees and 105 degrees between the first and second ground segments, and so as to define a continuous conductive path from a mounting end of the first ground segment to a mating end of the second ground segment.

In yet still another embodiment, an angled electrical connector comprises a plurality of signal contacts and ground shield. The plurality of signal contacts are arranged along a row along a lateral direction. Each signal contact includes a signal mounting end, a signal mating end offset from the signal mounting end, a first signal segment that extends from the signal mounting end towards the signal mating end, and a second signal segment that extends from the signal mating end towards the signal mounting end. The first and second signal segments are angularly offset from one another by an angle of between 75 degrees and 105 degrees. The ground shield has a ground mating end, a ground mounting end offset from the ground mating end, a first ground segment that extends from the ground mounting end towards the ground mating end, and a second ground segment that extends from the ground mating end towards the ground mounting end. The first and second ground segments are angularly offset from one another by an angle of between 75 degrees and 105 degrees. The ground shield defines a plurality of windows at an elbow of the ground shield that defines the angle between the first ground segment and the second ground segment. The ground shield is arranged relative to the signal contacts such that each of the windows is aligned with at least one of the signal contacts along the inward-outward direction.

In yet still another embodiment, a plurality of electrical contacts for an electrical connector comprises a plurality of signal contacts and a ground shield. Each of the plurality of signal contacts, includes a signal mounting end, and a signal mating end offset from the signal mounting end, a first signal segment that extends from the signal mounting end toward the signal mating end, a second signal segment that extends from the signal mating end toward the signal mounting end, and an intermediate signal segment that extends from the first signal segment to the second signal segment. Each of the signal contacts includes first and second signal edges opposite each other along a lateral direction, and first and second signal broadsides opposite each other along an inward-outward direction perpendicular to the lateral direction. The intermediate signal segment is jogged with respect to each of the first and second signal segments along the inward-outward direction. The ground shield has a ground mating end and a ground mounting end. The ground shield defines at least one window at a bend region of the ground shield, each window extending through the ground shield. The signal contacts are arranged such that 1) the intermediate signal segments are received in the at least one window such that a common bend line that extends along the lateral direction intersects the windows, the signal contacts, and the ground shield, and 2) the first and second signal segments are offset from the ground plate body along the inward-outward direction.

Even yet still another embodiment is a method of forming electrical contacts for an electrical connector. The method comprises arranging a plurality of signal contacts relative to a ground shield. The signal contacts are arranged so as to be spaced in a row along a lateral direction. Further, first and second signal segments of each signal contact are arranged to be spaced from the ground shield along an inward-outward direction, perpendicular to the lateral direction. Each first signal segment defines a mounting end of a respective one of the signal contacts, and each second signal segment defines a mating end of a respective one of the signal contacts. An intermediate section of each of the signal contacts is arranged so as to be received in one of a plurality of windows of the ground shield. Once arranged, the signal contacts and the ground shield are bent about a common bend line that intersects the windows, the signal contacts, and the ground shield.

BRIEF DESCRIPTION OF THE DRAWINGS

The foregoing summary, as well as the following detailed description of embodiments of the application, will be better understood when read in conjunction with the appended drawings. For the purposes of illustrating the methods and devices of the present application, there is shown in the drawings representative embodiments. It should be understood, however, that the application is not limited to the precise methods and devices shown. In the drawings.

DETAILED DESCRIPTION

Figure 6:
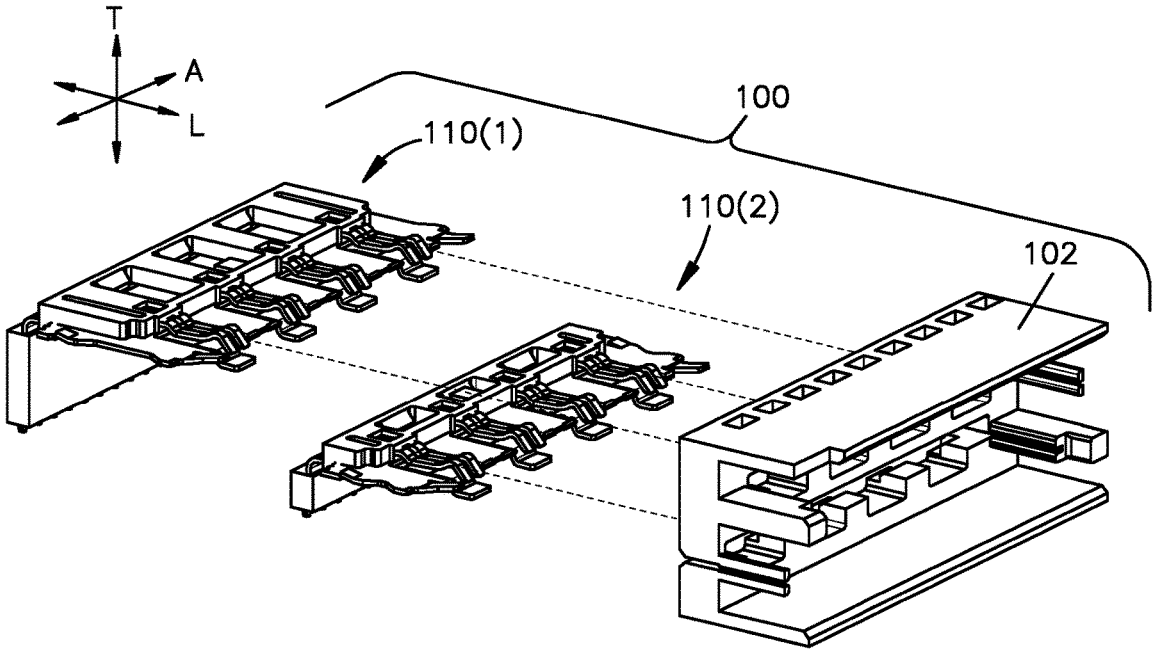
FIG. 6 shows a rear exploded perspective view of the first electrical connector of FIG. 1.
Figure 9:
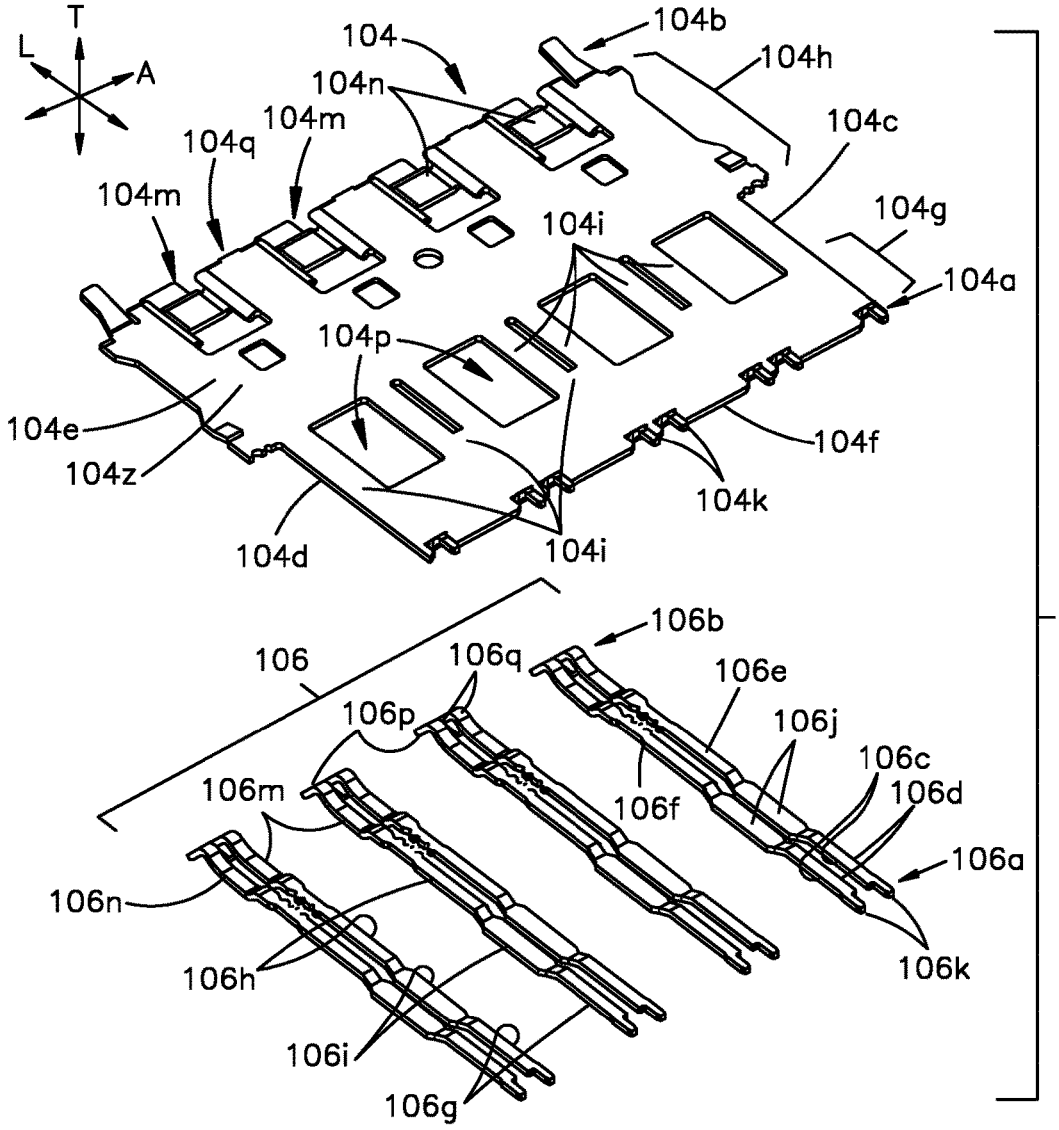
FIG. 9 shows an exploded perspective view of a ground plate and signal contacts of the first electrical connector of FIG. 1 in a straight configuration.
Figure 10:
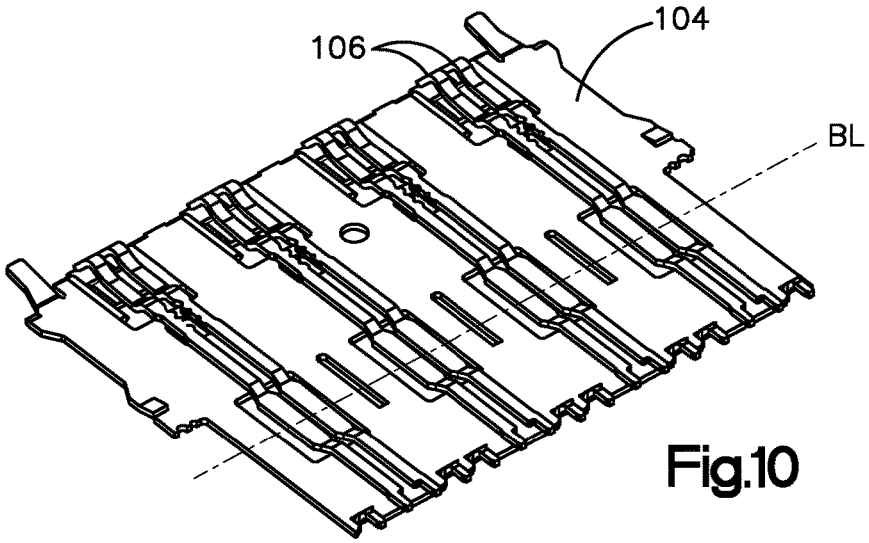
FIG. 10 shows an assembled perspective view of the ground plate and signal contacts of FIG. 9 in a straight configuration.
Figure 11:
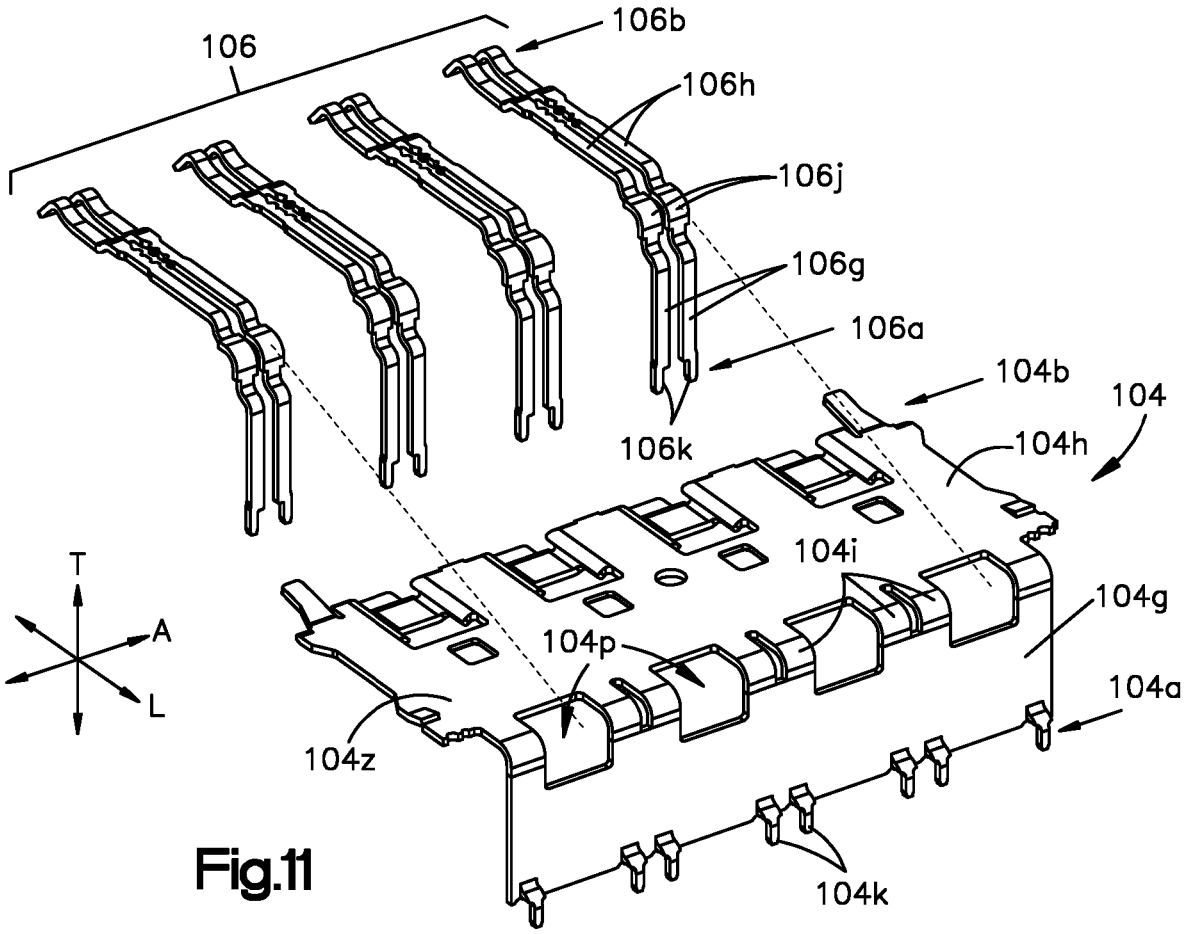
FIG. 11 shows an exploded perspective view of the ground plate and signal contacts FIG. 9 in an angled configuration.
Figure 12:
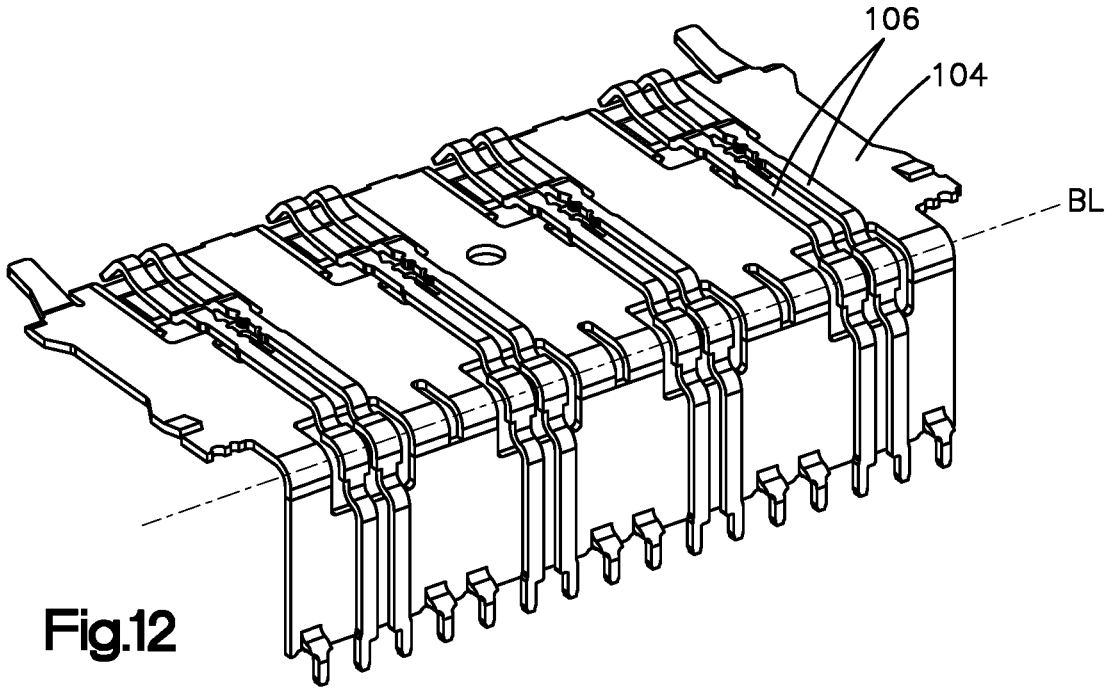
FIG. 12 shows an assembled perspective view of the ground plate and signal contacts of FIG. 10 in an angled configuration.
Figure 23:
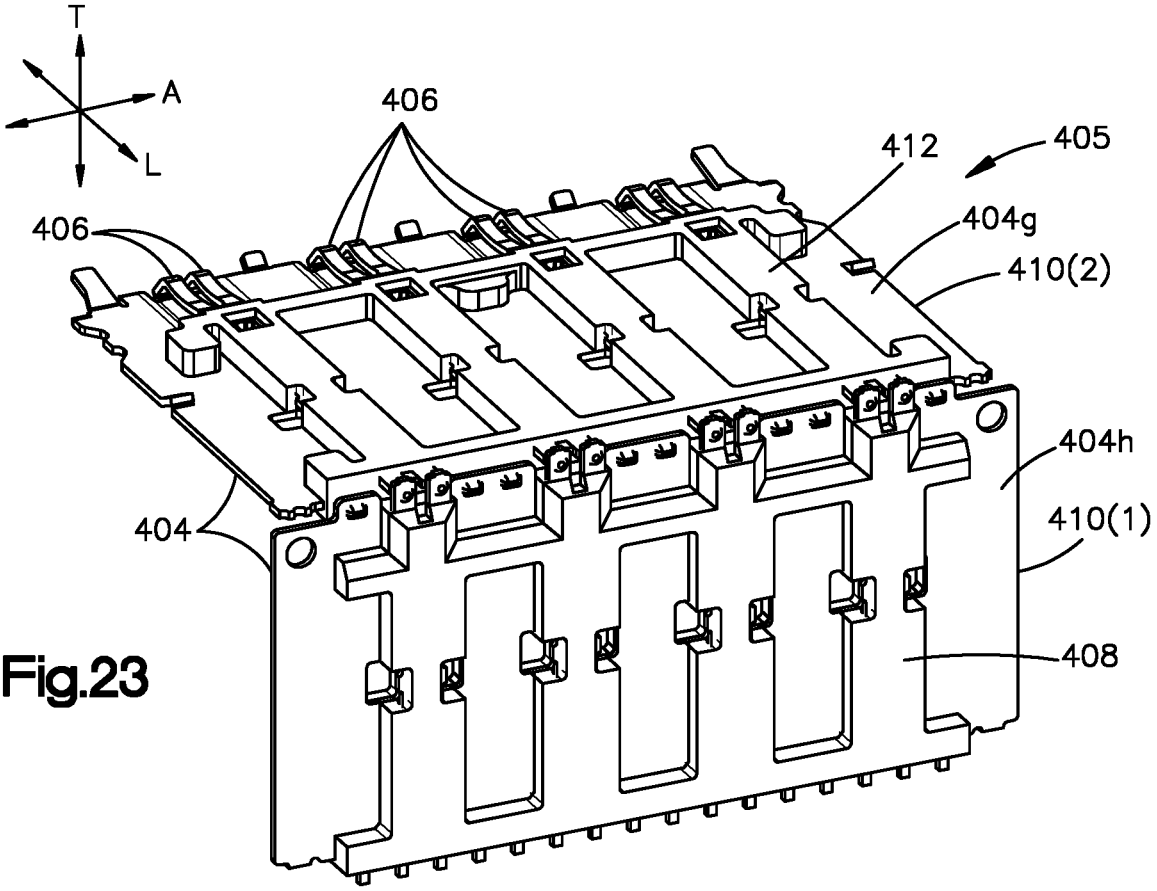
FIG. 23 shows a perspective view of a bank of contacts having first and second lead frames coupled to one another.
Figure 24:
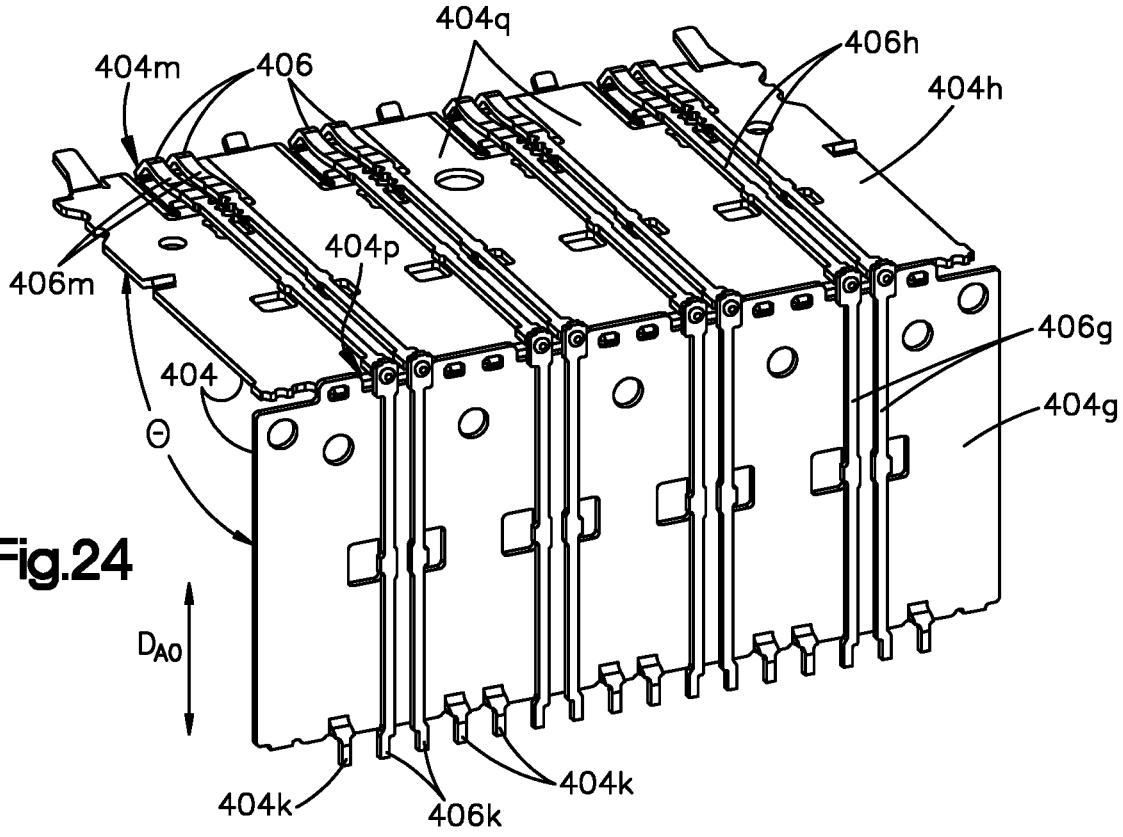
FIG. 24 shows a perspective view of the bank of contacts of FIG. 23 without insulative inserts.
Figure 25:
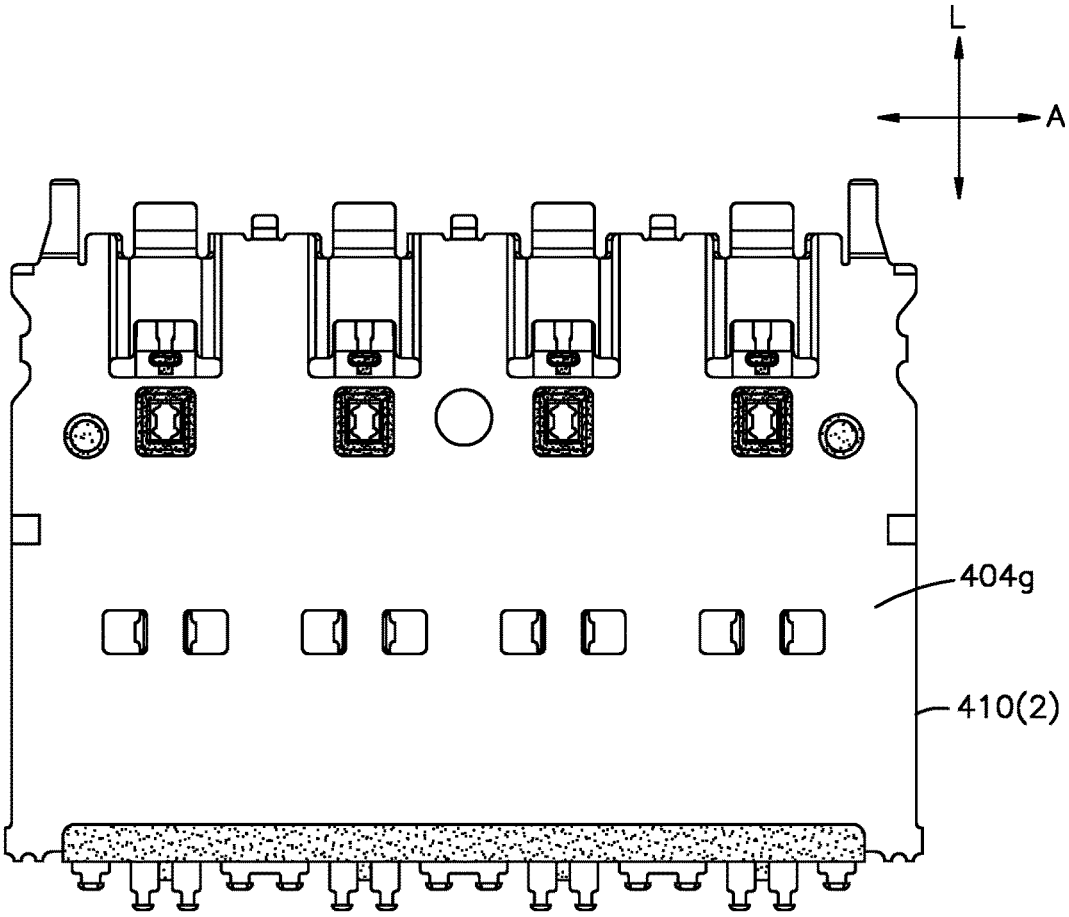
FIG. 25 shows a rear view of the first lead frame of the bank of contacts of FIG. 23, with insulative inserts shaded for illustrative purposes.
Figure 26:
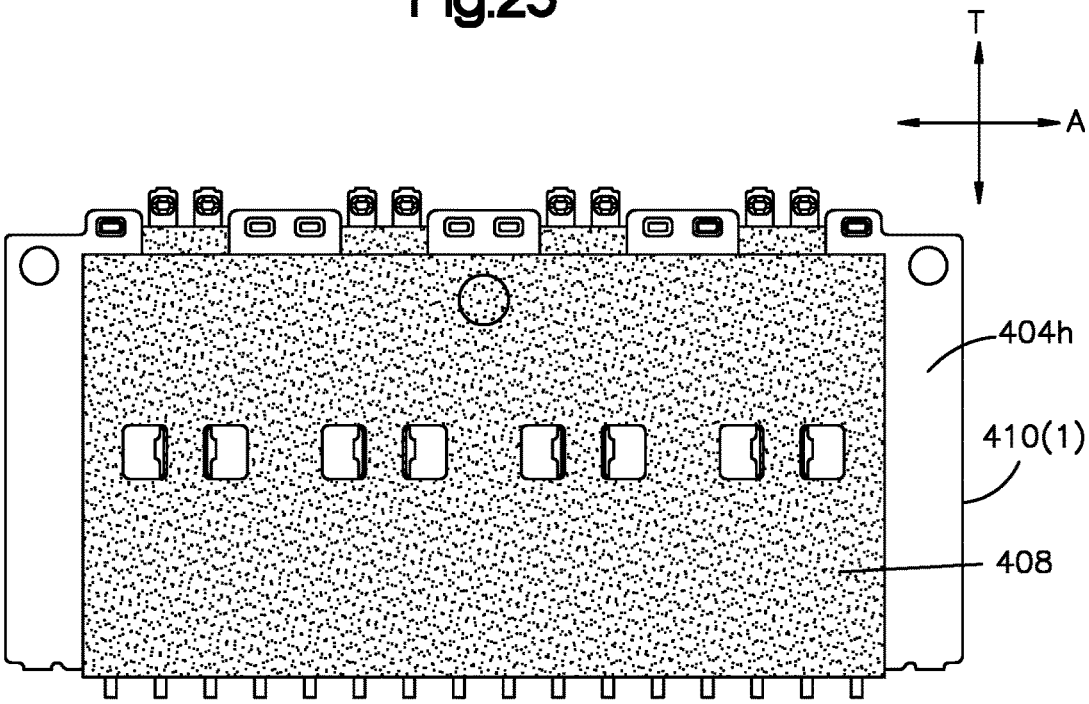
FIG. 26 shows a rear view of the second lead frame of the bank of contacts of FIG. 23, with insulative inserts shaded for illustrative purposes.
Figure 27:
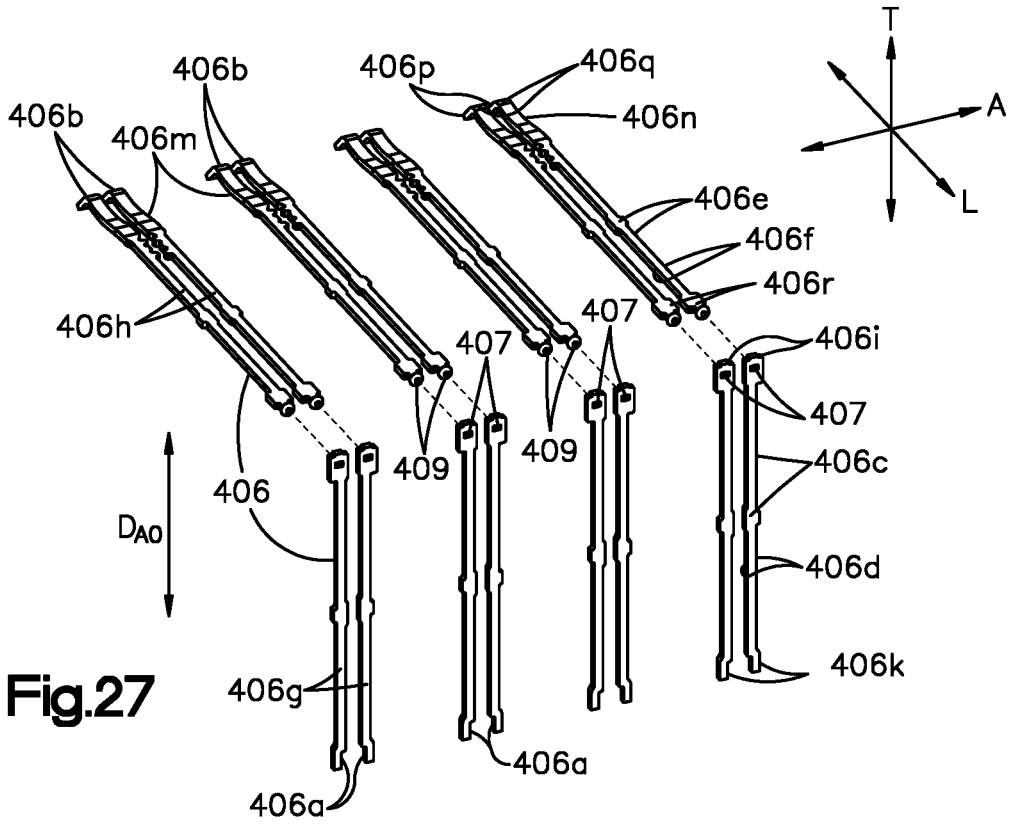
FIG. 27 shows a perspective exploded view of the signal contacts of the bank of contacts of FIG. 23.
Figure 28:
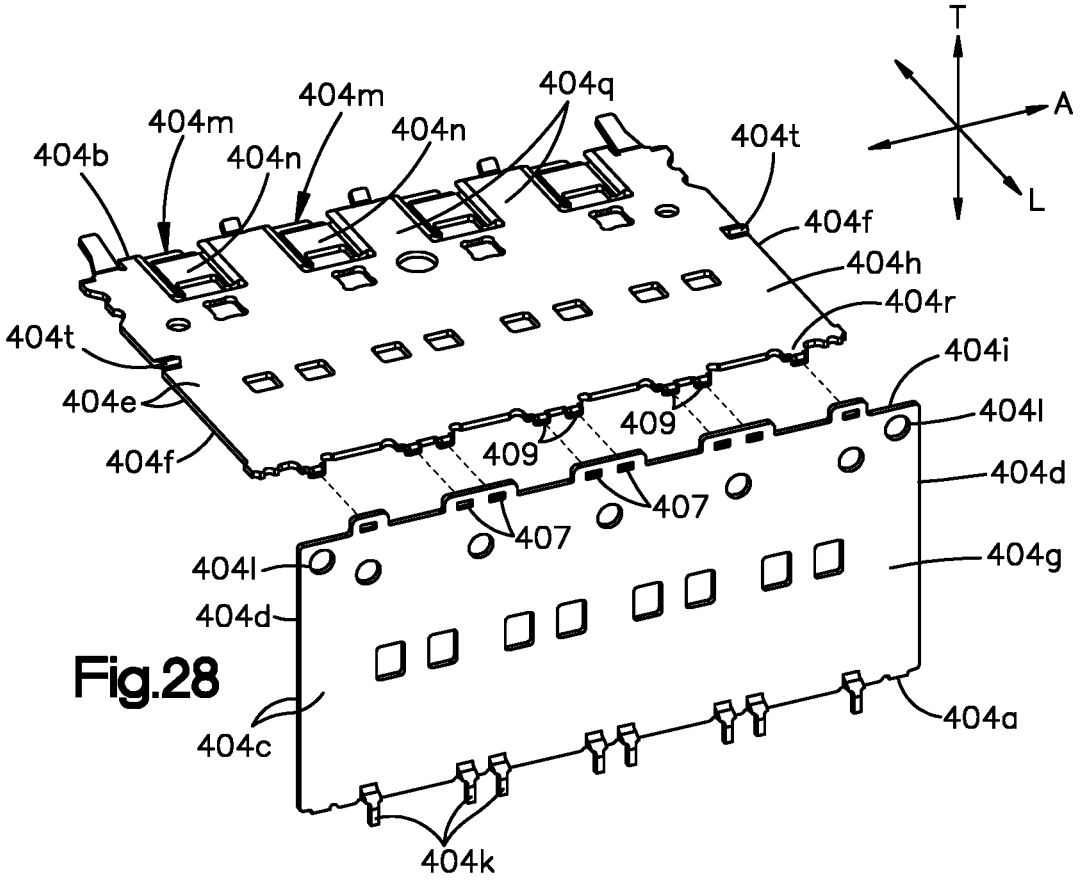
FIG. 28 shows a perspective exploded view of the ground shield of the bank of contacts of FIG. 23.

In general, the present disclosure relates to electrical contacts (e.g., 104 and 106 in FIGS. 11 and 12, and 404 and 406 in FIG. 24) for electrical connectors, and also to electrical connectors (e.g., 100 and 200 in FIGS. 1 and 400 in FIG. 18), lead frames (e.g., 110(1) and 110(2) in FIG. 6, and 410(1) and 410(2) in FIG. 23), and electrical connector systems (e.g., 10 in FIG. 1) comprising electrical connectors having the electrical contacts. At least one of the electrical connectors can be an angled connector (e.g., 100 in FIGS. 1 and 400 in FIG. 18), such as a right-angled connector. The electrical contacts of the angled connector can include at least one ground contact (e.g., 104 in FIGS. 11 and 404 in FIG. 24) and a plurality of signal contacts (e.g., 106 in FIGS. 11 and 406 in FIG. 24). In some embodiments, the signal contacts 106 and the ground contact 104 can be assembled in a straight configuration as shown in FIGS. 9 and 10, and then bent to a bent configuration as shown in FIGS. 11 and 12 to form angled contacts. In other embodiments, the signal contacts 506 and ground contact 404 can have separate segments that can be coupled to one another as shown in FIGS. 24, 27, and 28 to form angled contacts.

Discussion of FIGS. 1-17

Turning to FIGS. 1 to 4, an electrical connector system 10 is shown according to one embodiment. The connector system 10 comprises a first electrical connector 100 and a second electrical connector 200. The first electrical connector 100 is configured to be mounted onto a first complementary electrical component (not shown) such as a first printed circuit board (PCB). The first electrical connector 100 can be an angled connector, such as (without limitation) a right-angle connector, that is configured to mate with the second electrical connector 200 along a longitudinal direction L, and configured to mount onto the first PCB in a direction that is angularly offset from the both longitudinal direction L and a lateral direction A. In some examples, the angularly-offset direction can be a transverse direction T, that is perpendicular to both the longitudinal direction L and the lateral direction A.

The second electrical connector 200 is configured to be mounted onto a second complementary electrical component (not shown) such as a second PCB. The second electrical connector 200 can be a straight connector that is configured to mount onto the second PCB in the longitudinal direction L, and configured to mate with the second electrical connector along the longitudinal direction L. However, it will be understood that, in alternative embodiments, the second electrical connector 200 can be implemented as an angled connector, such as (without limitation) a right-angle connector. When mated, the first and second electrical connectors 100 and 200 are configured to place the first and second complementary electrical components in electrical communication with one another. Accordingly, the first and second electrical connectors 100 and 200 provide an electrically conductive path between the first and second complementary electrical components, such as from at least one of the first and second complementary electrical components to the other of the first and second complementary electrical components.

Figure 5:
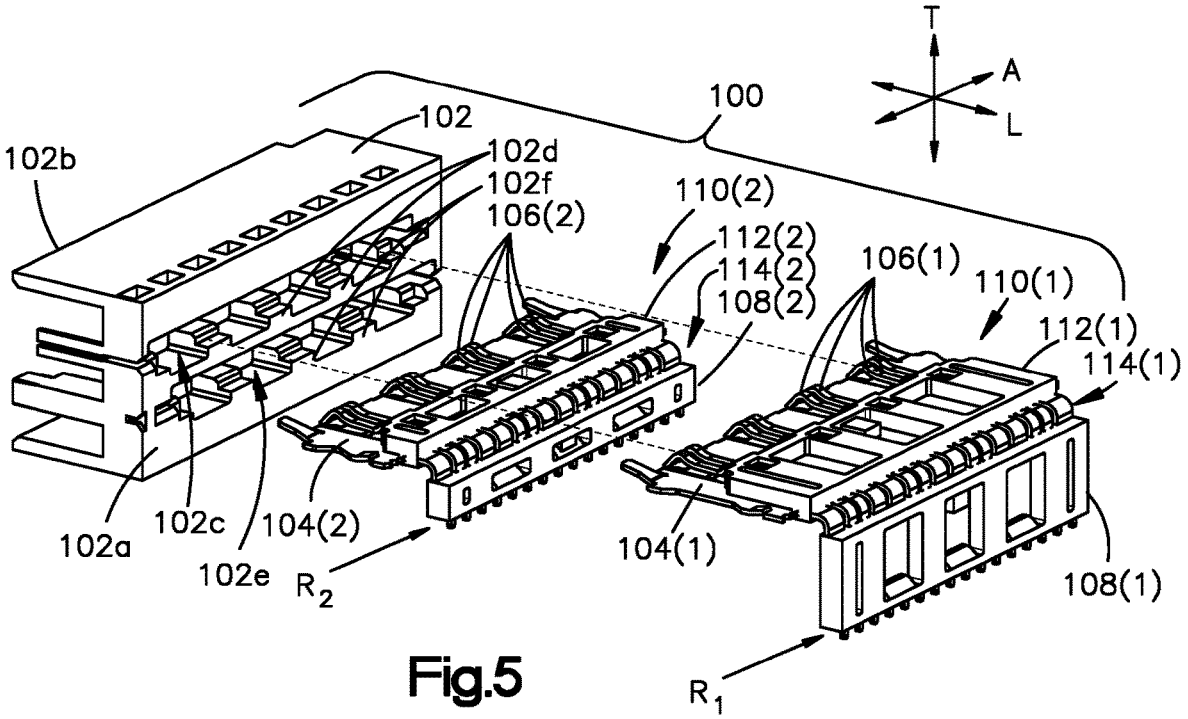
FIG. 5 shows a front exploded perspective view of the first electrical connector of FIG. 1.

Referring to FIGS. 5 and 6, the first electrical connector 100 includes a first dielectric or electrically insulative connector housing 102, and a plurality of electrical contacts supported by the connector housing 102. The plurality of electrical contacts can define a first row $R_1$ of electrical contacts that is oriented along the lateral direction A. The first row $R_1$ can include a first ground contact 104(1) and first a plurality of signal contacts 106(1). The ground contact 104(1) and the signal contacts 106(1) can be made from a metallic or lossy material such as copper, nickel, beryllium, gold, silver, or any other suitable metal, metal alloy, or electrically conductive material. The first ground contact 104(1) can be configured as a plate that is configured to shield the signal contacts 106(1) from at least one of a second row $R_2$ of electrical contacts (discussed below) and the PCB to which the first electrical connector 100 is mounted. Thus, the first ground contact 104(1) can be referred to as a ground plate or ground shield.

The first ground plate 104(1) and the first plurality of signal contacts 106(1) can be supported by at least one dielectric or electrically insulative insert body 108(1) and 112(1) that is in turn supported by the first connector housing 102. Thus, the electrical connector 100 can include a first insert assembly or lead frame 110(1) that includes the at least one insert body 108(1) and 112(1), the first ground plate 104(1), and the first plurality of signal contacts 106(1). The first ground plate 104(1) and the first plurality of signal contacts 106(1) can be affixed to the at least one insert body 108(1) and 112(1) by insert molding, stitching, press fitting, or any other suitable technique for affixing an electrical contact to an insulative body. The at least one dielectric or electrically insulative insert body 108(1) and 112(1) can provide electrical insulation between the ground plate 104 (1) and the signal contacts 106(1) and between each of the signal contacts 106(1).

The plurality of electrical contacts of the first electrical connector 100 can define a second row $R_2$ of electrical contacts that is oriented along the lateral direction A. The second row $R_2$ can be offset from the first row $R_1$ along an inward direction, perpendicular to the lateral direction A. It will be understood that embodiments of the disclosure are not limited to having two rows, and in various embodiments, the first electrical connector 100 can include as few as one row or more than two rows of electrical contacts. The second row $R_2$ can include a second ground contact 104(2) and second a plurality of signal contacts 106(2). The ground contact 104(2) and the signal contacts 106(2) can be made from a metallic or lossy material such as copper, nickel, beryllium, gold, silver, or any other suitable metal, metal alloy, or electrically conductive material. The second ground contact 104(2) can be configured as a plate that is configured to shield the signal contacts 106(2) from the PCB to which the first electrical connector 100 is mounted. Thus, the second ground contact 104(2) can be referred to as a ground plate or ground shield.

The second ground contact 104(2) and the second plurality of signal contacts 106(2) can be supported by at least one dielectric or electrically insulative insert body 108(2) and 112(2) that is in turn supported by the first connector housing 102. Thus, the electrical connector 100 can include a second insert assembly or lead frame 110(2) that includes the at least one insert body 108(2) and 112(2), the second ground plate 104(2), and the second plurality of signal contacts 106(2). The second ground plate 104(2) and the second plurality of signal contacts 106(2) can be affixed to the at least one insert body 108(2) and 112(2) by insert molding, stitching, press fitting, or any other suitable technique for affixing an electrical contact to an insulative body. The at least one dielectric or electrically insulative insert body 108(2) and 112(2) can provide electrical insulation between the ground plate 104(2) and the signal contacts 106(2) and between each of the signal contacts 106(2).

The first connector housing 102 has a mounting end **102*a*, and a mating end 102*b* that is offset from the mounting end 102*a*. The first connector housing 102 can define a first contact opening 102*c* that extends through the mounting end 102*a* and the mating end 102*b* along the longitudinal direction L. The first contact opening 102*c* can be configured to receive the first row $R_1$ of the electrical contacts along the longitudinal direction L. For example, the first contact opening 102*c* can be configured to receive the first lead frame 110(1) that supports the first row $R_1$ of electrical contacts. The first connector housing 102 can include a first plurality of spacer walls 102*d* that extend into the first contact opening 102*c*. The first spacer walls 102*d* can be spaced from one another along the lateral direction A. For example, the first spacer walls 102*d* can be spaced so as to align with mating features 104*q* (discussed below) of the ground plate 104(1)** along the transverse direction T.

The first housing can also define a second contact opening **102*e* that extends through the mounting end 102*a* and the mating end 102*b* along the longitudinal direction L. The second contact opening 102*e* can be spaced from the first contact opening 102*c* along the transverse direction T. The second contact opening 102*e* can be configured to receive the second row $R_2$ of the electrical contacts along the longitudinal direction L. For example, the second contact opening 102*e* can be configured to receive the second lead frame 110(2) that supports the second row $R_2$ of electrical contacts. The first connector housing 102 can include a second plurality of spacer walls 102*f* that extend into the second contact opening 102*c*. The second spacer walls 102*f* can be spaced from one another along the lateral direction A. For example, the second spacer walls 102*d* can be spaced so as to align with mating features 104*q* (discussed below) of the ground plate 104(2)** along an inward-outward direction.

Turning to FIGS. 9 and 10, a ground plate 104 and a plurality of signal contacts 106 according to one embodiment are shown as straight contacts in a straight configuration. One or both of the first and second ground plates 104(1) and 104(2) of FIGS. 5 and 6 can be implemented as shown by the ground plate 104 in FIGS. 9 and 10 and then subsequently bent to be angled contacts in an angled configuration, such as (without limitation) right-angle contacts in a right-angle configuration as shown in FIGS. 11 and 12. It will be understood that various dimensions of the second ground plate 104(2) may be smaller than the corresponding dimensions of the first ground plate 104(1) such that the second ground plate 104(2) can be disposed inwardly of the first ground plate 104(1). Similarly, one or both of the first and second pluralities of signal contacts 106(1) and 106(2) of FIGS. 5 and 6 can be implemented as shown by the plurality of signal contacts 106 in FIGS. 9 and 10, and then subsequently bent to be angled contacts in an angled configuration, such as (without limitation) right-angle contacts in a right-angle configuration as shown in FIGS. 11 and 12. It will be understood that various dimensions of the second plurality of signal contacts 106(2) may be smaller than the corresponding dimensions of the first plurality of signal contacts 106(1) so that the second plurality of contacts 106(2) can be disposed inwardly of the first plurality of contacts 106(1).

Each signal contact 106 has a signal mounting end **106*a*, and a signal mating end 106*b* offset from the signal mounting end 106*a*. The signal contacts 106 in FIGS. 9 and 10 are each in a substantially straight configuration, wherein the signal mounting ends 106*a* are configured to mount in the same direction (e.g., the longitudinal direction L) in which the signal mating ends 106*b* are configured to mate. In FIGS. 11 and 12, on the other hand, the signal contacts 106 are each in a bent or angled configuration wherein the signal mounting ends 106*a* are configured to mount in a direction that is angularly offset to both the longitudinal direction L and the lateral direction A. The angular offset can be between 75 degrees and 105 degrees from a plane that extends along the longitudinal direction L and lateral direction A. In one particular example, the angular offset can be approximately 90 degrees from the plane such the signal contacts are arranged in a right-angle configuration, wherein the signal mounting ends 106*a* are configured to mount in a direction (e.g., the transverse direction T) that is perpendicular to the direction (e.g., the longitudinal direction L) in which the signal mating ends 106*b*** are configured to mate.

Each signal contact 106 has a first signal edge **106*c*, and a second signal edge 106*d* opposite from the first signal edge 106*c* along the lateral direction A. Each signal contact 106 has first and second signal broadsides 106*e* and 106*f* opposite each other along an inward-outward direction, perpendicular to the lateral direction A. Each signal contact 106 can have a width along the lateral direction A from its first signal edge 106*c* to its second signal edge 106*d*, a thickness from its first signal broadside 106*e* to its second signal broadside 106*f*, and a length from its signal mounting end 106*a* to its signal mating end 106*b* along one of the first and second signal broadsides 106*e* and 106*f*. The width can be greater than the thickness. Further, the length can be greater than the width and the thickness. Thus, each signal contact 106 can be elongate as it extends from its signal mounting end 106*a* to its signal mating end 106*b* along one of its signal broadsides 106*e* and 106*f***.

Each signal contact 106 has a first segment **106*g*, a second segment 106*h*, and an intermediate segment 106*i* that extends between its first segment 106*g* and its second segment 106*h*. Each intermediate segment 106*i* is jogged with respect to each of its corresponding first and second segments 106*g* and 106*h* along the inward-outward direction that extends from one of the first and second signal broadsides 106***e* and 106*f* to the other.

The intermediate segment 106*i* of each signal contact 106 can include an offset region 106*j* that is offset from the first and second segments 106*g* and 106*h* along the inward-outward direction that extends from one of the first and second signal broadsides 106*e* and 106*f* to the other of the first and second signal broadsides 106*e* and 106*f* The intermediate segment 106*i* can define a pair of substantially "s"-shaped curves that connect the offset region 106*j* to the first segment 106*g* and the second segment 106*h*, respectively. When a signal contact 106 is in the straight configuration shown in FIGS. 9 and 10, the first and second segments 106*g* and 106*h* of the signal contact 106 can be substantially in-plane with one another. Further, the offset region 106*j* of the intermediate segment 106*i* can be substantially parallel to the first and second segments 106*g* and 106*h*, although embodiments of the disclosure are not so limited.

The offset region 106*j* can optionally have an offset-region width from the first signal edge 106*c* to the second signal edge 106*d* along the lateral direction A. The offset-region width can be greater than a width of each of the first and second segments 106*g* and 106*h* from the first signal edge 106*c* to the second signal edge 106*d* along the lateral direction A. Without being bound by theory, it is believed that providing a greater width at the offset region 106*j* can lower impedance.

The signal mounting end 106*a* of each signal contact 106 can include a mounting feature 106*k* such as a mounting tail that is configured to receive a solder ball (not shown). However, in alternative embodiments, the mounting feature 106*k* can be configured as a press-fit mounting tail, a surface mount tail, or any other suitable mounting feature or combination of mounting features suitable for mounting the signal contact 106 onto a PCB.

The signal mating end 106*b* of each signal contact 106 can include a mating feature that is configured to mate with electrical contacts of a second electrical component (e.g., connector 200). For example, each mating feature can comprise a contact beam 106*m*, although embodiments of the disclosure can implement other suitable mating features. The contact beam 106*m* can be constructed as a flexible beam having a bent, such as curved, shape. Bent structures as described herein refer to bent shapes that can be fabricated, for instance, by bending the end or by stamping a bent shape, or by any other suitable manufacturing process. The contact beam 106*m* can include a beam body 106*n* and a stub 106*p* that extends from the beam body 106*n*. The beam body 106*n* can extend from the second segment 106*h* in a direction that is away from the signal mounting end 106*a*. The stub 106*p* can extend from the beam body 106*n* along a direction that is away from the signal mounting end 106*a* and angularly offset from the beam body 106*n*, such as along a direction that is angularly offset from a plane that extends along the longitudinal direction L and the lateral direction A. The beam body 106*n* and the stub 106*p* can be adjoined to one another at an elbow 106*q*. At least a portion of the beam body 106*n* can be offset from the second segment 106*h* along the inward-outward direction. The contact beam 106*m* can define a substantially "s"-shaped curve that connects the offset portion of the beam body 106*n* to the second segment 106*h*.

Figure 16:
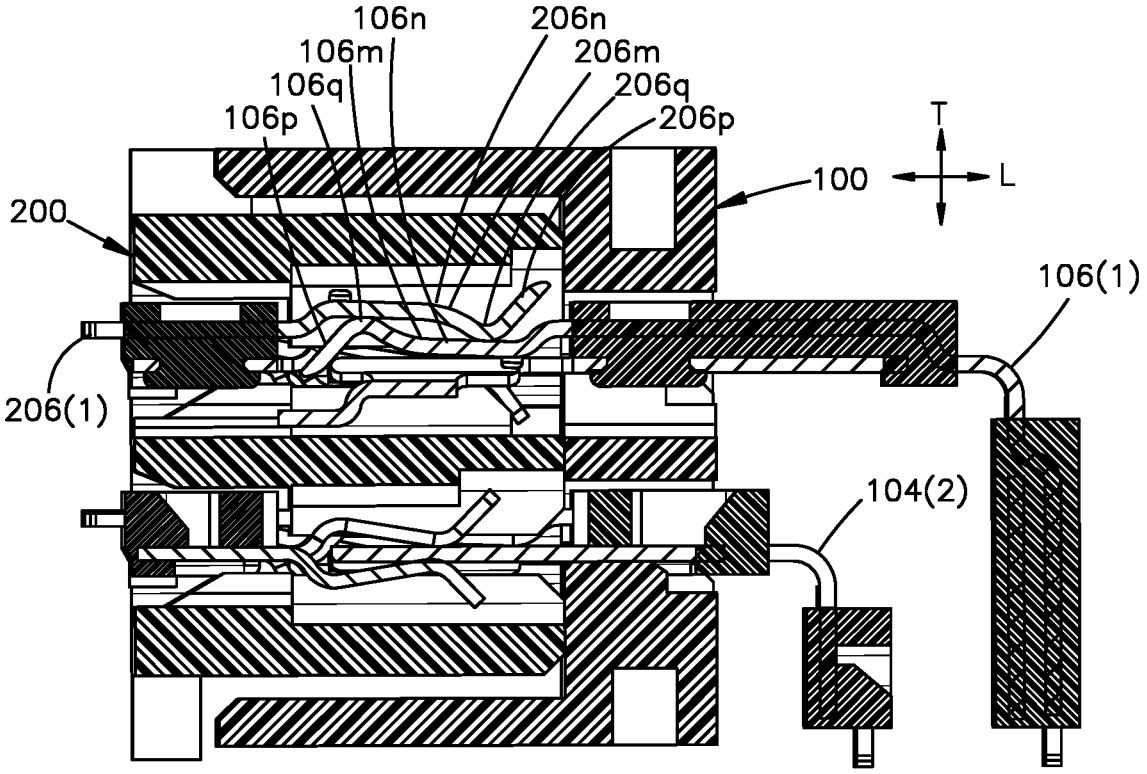
FIG. 16 shows a cross-sectional elevation view of the electrical connector system of FIG. 1 showing signal contacts of the first and second connectors mated with one another.

Turning briefly to FIG. 16, the elbow 106*q* of each signal contact 106 is configured to wipe against a corresponding electrical contact 206 of the second electrical connector 200 as the second connector 200 is mated with the contact beam 106*m* of the signal contact 106 along the longitudinal direction L. As each signal contact 106 wipes against a corresponding electrical contact 206, the contact beam 106*m* of the signal contact 106 deflects along a direction that extends from the first broadside 106*e* to the second broadside 106*f* from an undeflected position to a deflected position. The contact beam 106*m* can then deflect back along an opposite direction that extends from the second broadside 106*f* to the first broadside 106*e* from its deflected position towards its undeflected position, without fully returning to the undeflected position. When mated, each contact beam 106*m* is configured to contact a corresponding contact 206 of the second electrical connector 200 so as to apply a biasing force to the corresponding contact 206 along the opposite direction.

Returning to FIGS. 9 and 10, the ground plate 104 can be made from a metallic or lossy material or any other suitable material that provides shielding to the signal contacts 106. Therefore, the ground plate 104 can also be referred to as a ground shield. The ground plate 104 has a ground plate body 104*z* that extends between a ground mounting end 104*a* and a ground mating end 104*b* that are offset from one another. The ground plate 104 is in a substantially straight configuration in FIGS. 9 and 10, wherein the ground mounting end 104*a* is configured to mount in the same direction (e.g., the longitudinal direction L) in which the ground mating end 104*b* is configured to mate. In FIGS. 11 and 12, on the other hand, the ground plate 104 is in an angled configuration wherein the ground mounting end 104*a* is configured to mount in a direction that is angularly offset from both the longitudinal direction L and the lateral direction A. The angular offset can be between 75 degrees and 105 degrees from a plane that extends along the longitudinal direction L and lateral direction A. In one particular example, the angular offset can be approximately 90 degrees from the plane such the ground contact is arranged in a right-angle configuration, wherein the ground mounting end 104*a* is configured to mount in a direction (e.g., the transverse direction T) that is perpendicular to the direction (e.g., the longitudinal direction L) in which the ground mating end 104*b* is configured to mate.

The ground plate 104 has a first ground edge 104*c*, and a second ground edge 104*d* spaced from the first ground edge 104*c* along the lateral direction A. The ground plate 104 has a first planar surface 104*e*, and a second planar surface 104*f* opposite the first planar surface 104*e* along an inward-outward direction. The ground plate 104 can have a width along the lateral direction A from the first ground edge 104*c* to the second ground edge 104*d*, a thickness from the first planar surface 104*e* to the second planar surface 104*f*, and a length from the ground mounting end 104*a* to the ground mating end 104*b* along one of the first and second planar surfaces 104*e* and 104*f* The length and width can be greater than the thickness. In some embodiments, the width can be greater than the length.

The ground plate 104 has a first ground segment 104*g*, and a second ground segment 104*h* opposite the first ground segment 104*g*. The first ground segment 104*g* can extend from the ground mounting end 104*a* towards the ground mating end 104*b*. The second ground segment 104*h* can extend from the ground mating end 104*b* towards the ground mounting end 104*a*. The ground plate 104 has at least one connecting segment 104*i* that extends between the first ground segment 104*g* and the second ground segment 104*h*. The connecting segments 104*i* can be spaced from one another along the lateral direction A. The connecting segments 104*i* can each define a bend region 104*j*, where the ground plate 104 is configured to be bent into the angled configuration. When the ground plate 104 is in the straight configuration shown in FIGS. 9 and 10, the first and second ground segments 104*g* and 104*h* of the ground plate 104 can be substantially in-plane with one another.

The ground plate body 104*z* defines at least one window 104*p* that extends into at least one of the first and second planar surfaces 104*e* and 104*f*. Each window 104*p* extends from the first ground segment 104*g* to the second ground segment 104*h*. Further, each window 104*p* can be defined between a pair of the connecting segments 104*i* with respect to the lateral direction A. In one example, the windows 104*p* can be through holes that extend through both of the first and second planar surfaces 104*e* and 104*f*. Each window 104*p* can be at an elbow of the ground plate 104 when the ground plate 104 is bent into an angled configuration.

The ground mounting end 104*a* of the ground plate 104 can include a plurality of mounting features 104*k*. The mounting features 104*k* can be spaced from one another along the lateral direction A. The mounting features 104*k* are configured to be attached to the first complementary electrical component (e.g., PCB). Each mounting feature 104*k* can be configured as a mounting tail that is configured to receive a solder ball (not shown). However, in alternative embodiments, each mounting feature 104*k* can be configured as a press-fit mounting tail, a surface-mount tail, any other suitable mounting feature or combination of mounting features suitable for mounting the ground plate 104 onto a PCB. Each mounting feature 104*k* can be offset from the ground plate body 104*z* along the inward-outward direction.

At least some of the ground mounting features 104*k* can be arranged in pairs, although embodiments of the disclosure are not so limited. In embodiments in which the ground mounting features 104*k* are arranged in pairs, the ground mounting features 104*k* of each pair can be spaced from one another by a first distance along the lateral direction A. Further, adjacent pairs can be spaced from one another by a second distance, the second distance being greater than the first distance. In some embodiments, the second distance can be at least as great as a width of one of the signal contacts 106 along the lateral direction A. In some such embodiments, the second distance can be at least as great as a width of two of the signal contacts 106 along the lateral direction A.

The second ground segment 104*h* of the ground plate 104 can define a plurality of mating-end openings 104*m* adjacent the ground mating end 104*b* that extend into one of the first and second planar surfaces 104*e* and 104*f*. The mating-end openings 104*m* can be spaced from one another along the lateral direction A. Each mating-end opening 104*m* can be aligned with a window 104*p* along the longitudinal direction L. The ground plate 104 can include offset surfaces 104*n* for each mating-end opening 104*m*. Each offset surface 104*n* can be aligned with a respective one of the mating-end openings 104*m* in the inward-outward direction. Further, each offset surface 104*n* can be offset from a respective one of the mating-end openings 104*m* with respect to the inward-outward direction. Each offset surface 104*n* is configured to shield at least one contact beam 106*m*, such as a pair of contact beams 106*m*, from electrical contacts or a PCB disposed below the ground plate 104 with respect to the inward-outward direction.

Figure 15:
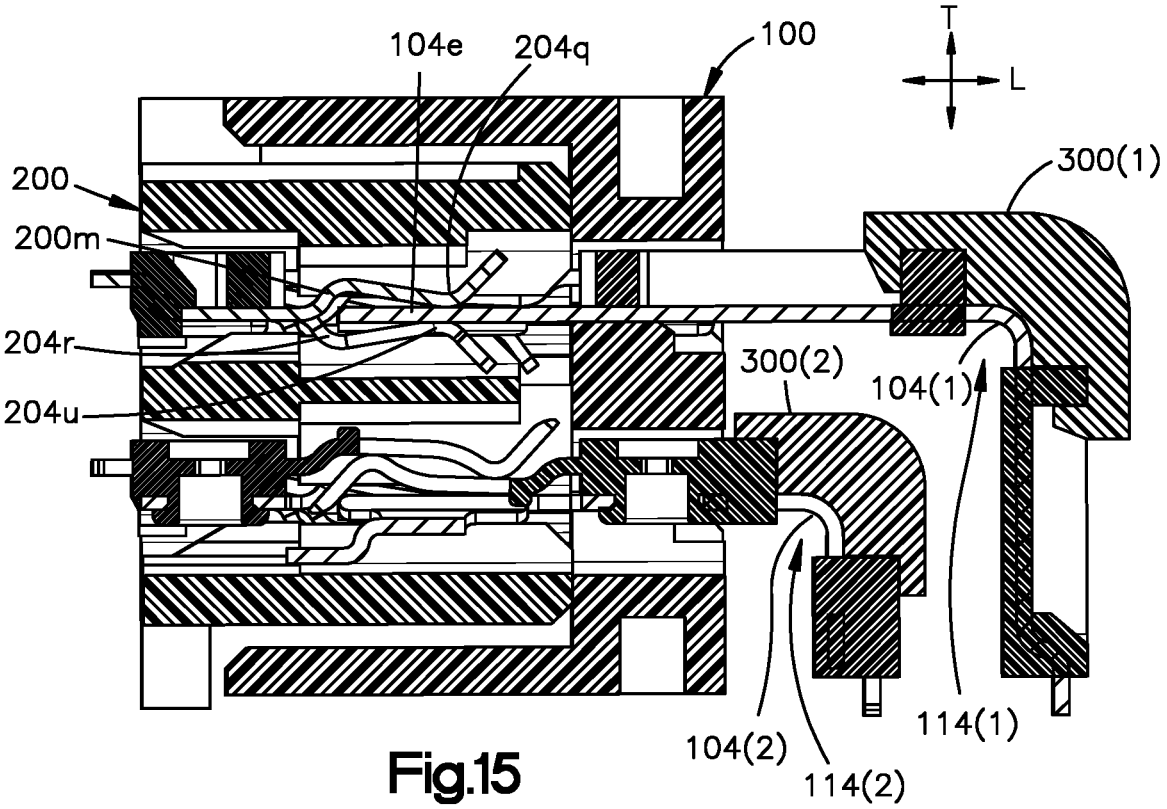
FIG. 15 shows a cross-sectional elevation view of the electrical connector system of FIG. 1 showing mating features of the grounds of the first and second connectors mated with one another.

The ground mating end 104*b* can define a plurality of mating features 104*q* that are configured to mate with the second electrical connector 200. The mating features 104*q* can be spaced from one another along the lateral direction A. Further, individual ones of the mating features 104*q* can be disposed between two of the mating-end openings 104*m* with respect to the lateral direction A. In one embodiment, each mating feature 104*q* can include a planar mating segment having a first planar surface configured to mate with at least one contact beam of the second electrical connector 200. For example, each mating feature 104*q* can include first and second planar surfaces that are configured to mate with opposed ground-contact beams 204*m* and 204*r* of the second connector 200 (as shown in FIG. 15). Thus, each mating feature 104*q* can be received between a pair of opposed ground-contact beams 204*m* and 204*r* of the second electrical connector 200. In alternative embodiments, each mating feature 104*q* can define any other suitable mating interface such as (without limitation) a contact beam.

Referring back to FIGS. 10 and 12, the ground plate 104 is configured to be arranged relative to the signal contacts 106 such that each of the windows 104*p* of the ground plate 104 is aligned with at least one of the signal contacts 106 along the inward-outward direction. For example, each window 104*p* can be configured to receive the intermediate segments 106*i* of at least one of the signal contacts 106 therein, such as a pair of intermediate segments 106*i*. When so received, the intermediate segments 106*i* can be aligned with the ground plate body 104*z* along the lateral direction A, and the first and second segments 106*g* and 106*h* can be offset from the ground plate body along the inward-outward direction.

In some embodiments, the ground plate 104 and the signal contacts 106 can be assembled relative to one another in a straight configuration as shown in FIG. 10. Then, the ground plate 104 and signal contacts 106 can be transitioned to a bent configuration as shown in FIG. 12 by bending each of the ground plate 104 and signal contacts 106 by between 70 degrees and 105 degrees along a common bend line BL. The common bend line BL can extend along the lateral direction A, and can intersect the windows 104*p*, the signal contacts 106, and the ground plate 104. In at least some embodiments, the bend line BL can intersect the intermediate sections 106*i* of the signal contacts 106 and the ground plate body 104*z* so that, when the ground plate 104 and the signal contacts 106 are bent, the intermediate sections 106*i* of the signal contacts 106 are aligned with the ground plate body 104*z* along the bend line BL. Aligning the intermediate sections 106*i* of the signal contacts 106 with the ground plate body may improve connector performance by, for example, improving impedance matching and/or reducing signal interference.

The signal contacts 106 can be arranged so as to be spaced from one another along a row direction. The row direction can be the lateral direction A. In some embodiments (as shown), the signal contacts 106 can be arranged in pairs, although embodiments of the disclosure are not so limited. Each pair of signal contacts 106 can define a differential signal pair. The signal contacts 106 in each pair can be arranged edge-to-edge, and spaced from one another by a first distance along the lateral direction A. The pair of signal contacts are edge-coupled. Individual pairs of signal contacts 106 can be spaced from one another by a second distance along the lateral direction A, the second distance being greater than the first distance. In some embodiments, the second distance can be at least as great as a width of one of the signal contacts 106 along the lateral direction A. In some such embodiments, the second distance can be at least as great as a width of two of the signal contacts 106 along the lateral direction A.

The signal contacts 106 can be arranged relative to the ground plate 104 such that the intermediate segment 106*i* of each of the signal contacts 106 is received in one of the windows 104*p* of the ground plate 104. In the straight configuration, the offset region 106*j* of each intermediate segment 106*i* can be in-plane with the ground plate 104. For example, each offset region 106*j* can be in-plane with the connecting segments 104*i*, and can be aligned with the connecting segments 104*i* along the lateral direction A. Thus, the first and second ground planar surfaces 104*e* and 104*f* can be aligned with the first and second broadsides 106*e* and 106*f* of each signal contact 106 at their respective intermediate segments 106*i*. In embodiments in which the signal contacts 106 are arranged in pairs, each window 104*p* can be sized to receive the intermediate segments 106*i* of one pair of the signal contacts 106.

The first and second segments 106*g* and 106*h* of each signal contact 106 can be spaced from the ground plate 104. For example, the second signal broadside 106*f* at each of the first and second segments 106*g* and 106*h* can be spaced from and face the first ground planar surface 104*e*. Thus, a line can extend along the lateral direction A between the ground plate 104 and the first segments 106*g* of all of the signal contacts 106 without intersecting either the ground plate 104 or the signal contacts 106. Stated differently, a line can extend through the first segments 106*g* of all of the signal contacts 106 along the lateral direction A without extending through any portion of the ground plate 104. Similarly, a line can extend along the lateral direction A between the ground plate 104 and the second segments 106*h* of all of the signal contacts 106 without intersecting either the ground plate 104 or the signal contacts 106. Stated differently, a line can extend through the second segments 106*h* of all of the signal contacts 106 along the lateral direction A without extending through any portion of the ground plate 104. In alternative embodiments, the ground plate 104 can include a protrusion such as an embossment between the pairs of signal contacts 106. The protrusion can shield pairs of signal contacts from one another.

The signal contacts 106 and ground plate 104 can be arranged relative to one another such that the signal mounting features 106*k* of the signal contacts 106 are in-line with one another and with the ground mounting features 104*k* of the ground plate 104 along the lateral direction A. Individual signal mounting features 106*k* can be disposed between two of the ground mounting features 104*k* with respect to the lateral direction A. In embodiments in which the signal contacts 106 are arranged in pairs, individual pairs of the signal mounting features 106*k* can be disposed between two of the ground mounting features 104*k* with respect to the lateral direction A. In embodiments in which the ground mounting features 104*k* are arranged in pairs, individual pairs of ground mounting features 104*k* can be disposed between two of the signal mounting features 106*k* with respect to the lateral direction A. In embodiments in which both the signal contacts 106 and the ground mounting features 104*k* are arranged in pairs, individual pairs of ground mounting features 104*k* can be disposed between two pairs of the signal mounting features 106*k* with respect to the lateral direction A. Similarly, individual pairs of the signal mounting features 106*k* can be disposed between two pairs of the ground mounting features 104*k* with respect to the lateral direction A.

The signal contacts 106 can be arranged relative to the ground plate 104 such that the contact beam 106*m* of each signal contact 106 is aligned with one of the mating-end openings 104*m* along the inward-outward direction. Thus, each contact beam 106*m* is configured to deflect into a corresponding mating-end opening 104*m* when the contact beam 106*m* mates with a mating end of the second electrical connector 200 in FIG. 1. Preferably, each contact beam 106*m* can deflect into a corresponding opening 104*m* such that the body 106*n* of the contact beam 106*m* is substantially in-plane with the mating features 104*q* when the contact beam 106*m* is mated with the second electrical connector 200. In embodiments in which the signal contacts 106 are arranged in pairs, each mating-end opening 104*m* can be aligned with the contact beams 106*m* of one pair of the signal contacts 106. The offset surfaces 104*n* of the ground plate 104 can be aligned with the first and second broadsides 106*e* and 106*f* of the signal contacts 106 along the inward-outward direction when the signal contacts 106 are in the adjacent position with respect to the ground plate 104.

The ground plate 104 and the signal contacts 106 can be maintained in the adjacent position discussed above by at least one dielectric or electrically insulative insert body. For example, the first segments 106*g* of the signal contacts 106 and the first ground segment 104*g* of the ground plate 104 can be disposed in a first insert body (e.g., 108(1) or 108(2) of FIGS. 5 and 6). Further, the second segments 106*h* of the signal contacts 106 and the second ground segment 104*h* can be disposed in a second insert body (e.g., 112(1) or 112(2) of FIGS. 5 and 6). The second insert body can be spaced from the first insert body so as to define a gap (e.g., 114(1) or 114(2)) therebetween. The offset regions 106*j* of the signal contacts 106 and the bend regions 104*i* can be disposed in the gap so as to allow bending of the signal contacts 106 and the ground plate 104 at the gap. The ground plate 104 and the signal contacts 106 can be affixed to the first and second insert bodies 108 and 112 by insert molding, stitching, press fitting, or any other suitable technique for affixing an electrical contact to a housing.

Referring briefly to FIGS. 9, 15, and 16, each ground plate 104(1) and 104(2) can have a length from its mounting end 104*a* to its mating end 104*b* along one of its first and second planar surfaces 104*e* and 104*f*. The length of the ground plate 104(1) can be greater than the length of the ground plate 104(2). Further, the first and segments 104*g* and 104*h* of the first and second ground plates 104(1) and 104(2) can each have a length. The length of the first segment 104*g* of the first ground plate 104(1) can be greater than the length of the first segment 104*g* of the second ground plate 104(2). The length of the second segment 104*h* of the first ground plate 104(1) can be greater than the length of the second segment 104*h* of the second ground plate 104(2).

Similarly, each signal contact 106(1) and 106(2) can have a length from its mounting end 106*a* to its mating end 106*b*. The length of each signal contact 106(1) can be greater than the length of each signal contact 106(2). Further, the first and segments 106*g* and 106*h* of the signal contacts 106(1) and 106(2) can each have a length. The length of the first segments 106*g* of each first signal contact 106(1) can be greater than the length of the first segment 106*g* of each second signal contact 106(2). The length of the second segment 106*h* of each first signal contact 106(1) can be greater than the length of the second segment 106*h* of each second signal contact 106(2).

Turning now to FIGS. 11 and 12, the ground plate 104 and signal contacts 106 can be transitioned from the straight configuration of FIGS. 9 and 10 to the angled configuration while the adjacent position of the ground plate 104 and signal contacts 106 is maintained by the insert body or bodies. Note that for illustrative purposes, the insert bodies are omitted from FIGS. 11 and 12. Further, it will be understood that in alternative embodiments, the ground plate 104 and signal contacts 106 can be transitioned to the angled configuration before being disposed in the insert body or bodies.

The ground plate 104 and signal contacts 106 are transitioned by bending the ground plate 104 and signal contacts 106 along a bend line BL that extends along the lateral direction A. The ground plate 104 and the signal contacts 106 define a bend region along the bend line BL. The bend line BL can intersect the windows 104*p* of the ground plate 104 and the intermediate segments 106*i* of the signal contacts 106. Thus, the intermediate segments 106*i* and the windows 104*p* can be disposed at the bend region. However, it will be understood that, in alternative embodiments, the ground plate 104 and signal contacts 106 can be bent along a bend line that does not intersect the windows 104*p* of the ground plate 104 and the intermediate segments 106*i* of the signal contacts 106.

In the angled configuration, the second segment 104*h* of the ground plate 104 is generally planar along the lateral direction A and the longitudinal direction L. Further, the first segment 104*g* of the ground plate 104 is generally planar along a direction that is angularly offset from second segment 104*h*. In one example, the first segment 104*g* of the ground plate 104 is generally planar along the lateral direction A and the transverse direction T. Thus, the first segment 104*g* can be substantially perpendicular to the second segment 104*h*. The first and second broadsides 104*e* and 104*f* of the ground plate 104 are spaced from one another along an inward-outward direction that can be aligned with the longitudinal direction L at the first segment 104*g*, and aligned with the transverse direction T at the second segment 104*h*.

The second segments 106*h* of the signal contacts 106 can be in-plane with one another along a plane that extends in the lateral direction A and the longitudinal direction L. The first segments 106*g* of the signal contacts 106 can be in-plane with one another along a plane that is angularly offset from the second segments 106*h*. In one example, the first segments 106*g* of the signal contacts 106 can be in-plane with one another along a plane that extends in the lateral direction A and the transverse direction T. Thus, the second segments 104*h* and 106*h* can be substantially perpendicular to the first segments 104*g* and 106*g*, respectively. The first and second broadsides 106*e* and 106*f* of each signal contact 106 are spaced from one another along an inward-outward direction that can be aligned with the longitudinal direction L at the first segments 106*g*, and with the transverse direction T at the second segments 106*h*. The first segments 106*g* of the signal contacts 106 can be substantially parallel to the first segment 104*g* of the ground plate 104. The second segments 106*h* of the signal contacts 106 can be substantially parallel to the second segment 104*g* of the ground plate.

The first segments 106*g* of the signal contacts 106 are spaced from the ground plate 104 along the longitudinal direction L, and the second segments 106*h* of the signal contacts 106 are spaced from the ground plate 104 along the transverse direction T. The intermediate segments 106*i* of the signal contacts are aligned with the connecting segments 104*i* of the ground plate 104 along the lateral direction A. Thus, a straight line BL extending along the lateral direction A can intersect the intermediate segments 106*i* of the signal contacts 106 and the connecting segments 104*i* of the ground plate 104. Further, no straight line exists that is oriented along the lateral direction A and passes through the offset regions 106*j* of the intermediate segments 106*i* without also passing through the ground plate body 104*z*. The intermediate segment 106*i* of each signal contact 106 is inwardly offset from the first segment 106*g* of the signal contact 106 along the longitudinal direction L and inwardly offset from the second segment 106*g* of the signal contact 106 along the transverse direction T.

It will be noted that, in alternative embodiments, the positions of the ground plate 104 and the signal contacts 106 can be switched such that the signal contacts 106 are generally inwardly spaced from the ground plate 104, with the exception of the intermediate segments 106*i*. For example, the signal contacts 106 and ground plate 104 can be arranged such that the first segments 106*g* of the signal contacts 106 are inwardly spaced from the ground plate 104 along the longitudinal direction L, and the second segments 106*h* of the signal contacts 106 are inwardly spaced from the ground plate 104 along the transverse direction T. The intermediate segments 106*i* of the signal contacts can be aligned with the bend regions 104*j* of the ground plate 104 along the lateral direction A. Further, the intermediate segment 106*i* of each signal contact 106 can be outwardly offset from the first segment 106*g* of the signal contact 106 along the longitudinal direction, and outwardly offset from the second segment 106*g* of the signal contact 106 along the transverse direction T. The mounting features 104*k* of the ground plate 104 can be inwardly offset from the second ground planar surface 104*f* along the longitudinal direction L so as to be aligned with the mounting features 106*k* of the signal contacts.

Figure 2:
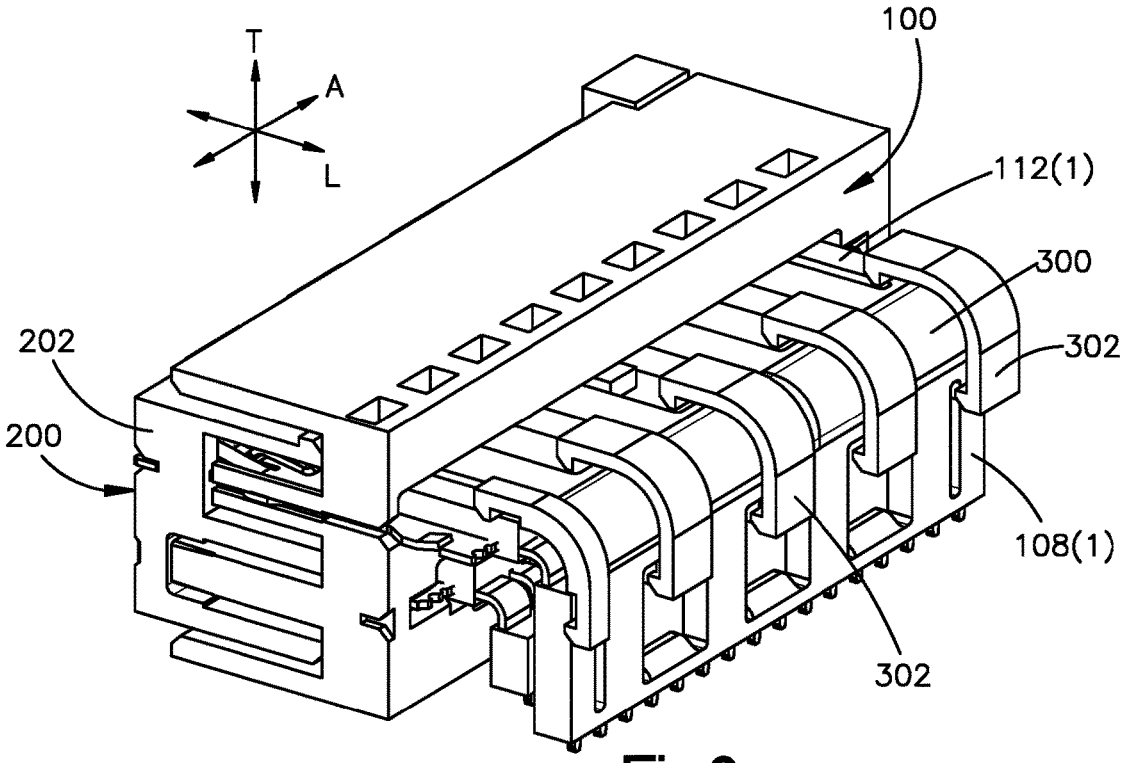
FIG. 2 shows the electrical connector system of FIG. 1 with an electrical-contact cover over the electrical contacts of the first electrical connector at a bend of the electrical contacts.
Figure 3:
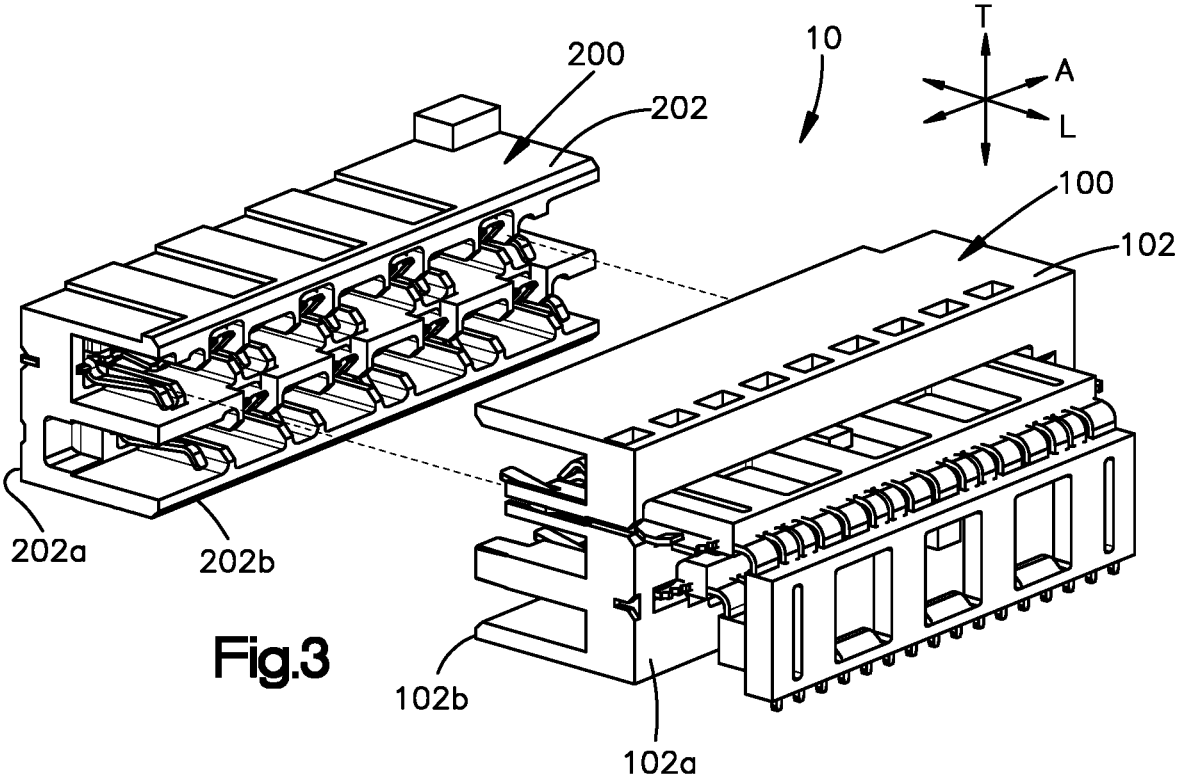
FIG. 3 shows a front exploded perspective view of the electrical connector system of FIG. 1.
Figure 4:
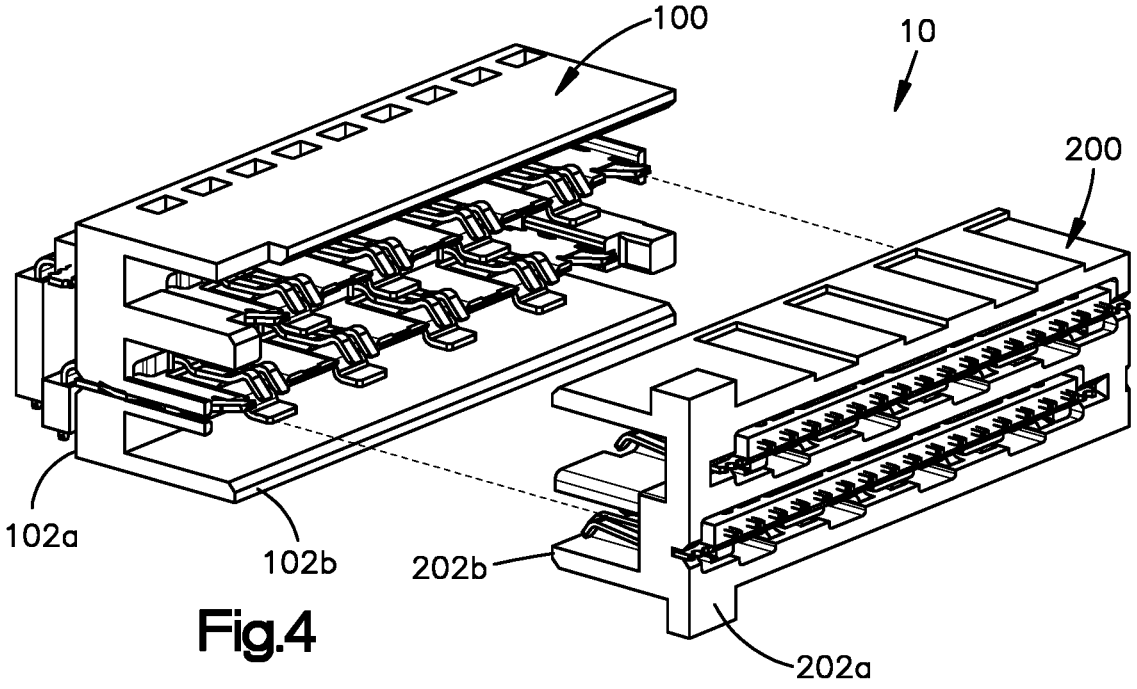
FIG. 4 shows a rear exploded perspective view of the electrical connector system of FIG. 1.
Figure 17:
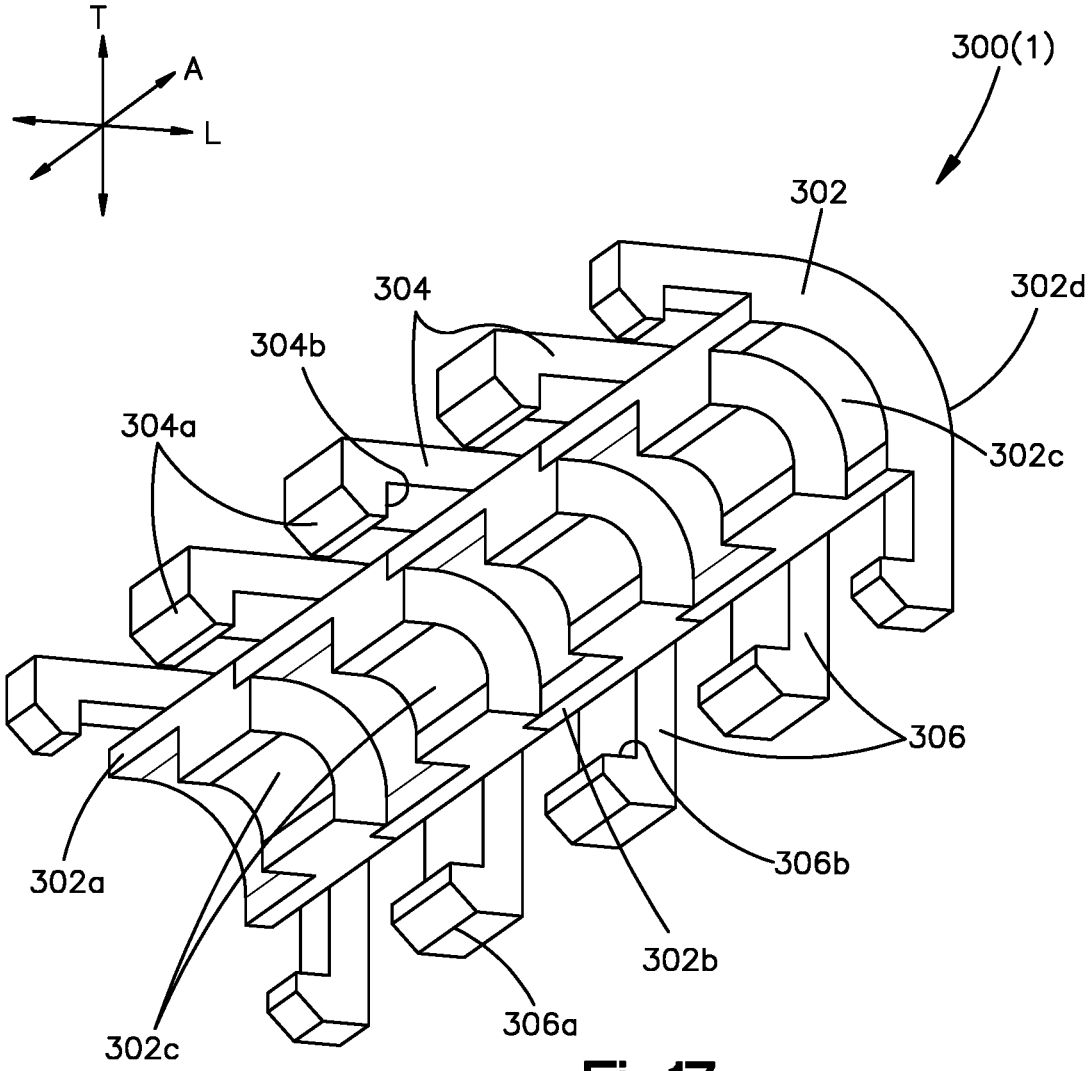
FIG. 17 shows a perspective bottom view of the electrical-contact cover of the connector assembly of FIG. 2.

Referring to FIGS. 2, 15, and 17, the first connector 100 or the first lead frame 110(1) can include a dielectric or electrically insulative cover 300(1) that is configured to cover a bend region of the first row $R_1$ of the first connector 100. The cover 300(1) can include a body 302 and at least one fastener that is configured to attach the body 302 to the lead frame 110(1). The cover body 302 can be configured to be disposed in the gap 114(1) between the first and second insert bodies 108(1) and 112(1). Disposing the cover 300(1) in the gap 114(1) can help to control the impedance at the bend region. The cover body 302 has a first end 302*a*, and a second end 302*b* opposite the first end 203*a*. The first end 302*a* can be configured to face or abut the first insert body 108(1), and the second end 203*b* can be configured to face or abut the second insert body 112(1). The cover body 302 can define a right-angle curve or turn that extends from the first end 302*a* to the second end 302*b*.

The cover body 302 has an inner surface 302*c* configured to face or abut the electrical contacts of the lead frame 110(1), and an outer surface 302*d* opposite the inner surface 302*c*. The cover body 302 can include a plurality of spacer walls 302*c* that extend from the inner surface 302*c* in a direction that is away from the outer surface 302*d*. The spacer walls 302*c* can be spaced from one another along the lateral direction A. For example, the spacer walls 302*c* can be spaced so as to be aligned with the signal contacts 106 along a direction that extends from the outer surface 302*d* to the inner surface 302*c*. In embodiments in which the signal contacts 106 are arranged in pairs, the spacer walls 302*c* can be spaced so as to be aligned with the pairs of signal contacts 106 along the direction that extends from the outer surface 302*d* to the inner surface 302*c*.

The at least one fastener is configured to attach the cover body 302 to at least one of the first and second insert bodies 108(1) and 112(1). The at least one fastener can include at least one first fastener 304 configured to couple to the first insert body 108(1). The first fasteners 304 can be spaced from one another along the lateral direction A. Each first fastener 304 can include a barb 304*a* having an abutment surface 304*b*. Each abutment surface 304*b* can be configured to abut a corresponding abutment surface of first insert body 108(1) as shown in FIG. 15.

The at least one fastener can include at least one second fastener 306 configured to couple to the second insert body 112(1). The second fasteners 306 can be spaced from one another along the lateral direction A. Further, individual ones of the second fasteners 306 can each be aligned with a first fastener 304 along a direction that extends from the first end 302*a* to the second end 302*b*. Each second fastener 306 can include a barb 306*a* having an abutment surface 306*b*. Each abutment surface 306*b* can be configured to abut a corresponding abutment surface of second insert body 112 (1) as shown in FIG. 15. It will be understood that, in alternative embodiments, each of the at least one faster 304 and 306 can be implemented as any other suitable fastener that is suitable for fastening the cover 300 to the first and second insert bodies 108(1) and 112(2).

The first connector 100 or the second lead frame 112(1) can include a dielectric or electrically insulative cover 300(2) that is configured to cover a bend region of the second row of the first connector 100. The second cover 302(2) can be implemented as described above in relation to first cover 302(1). However, in some embodiments, the second cover 302(2) might not include barbs 304*a* and 306*a*.

Figure 1:
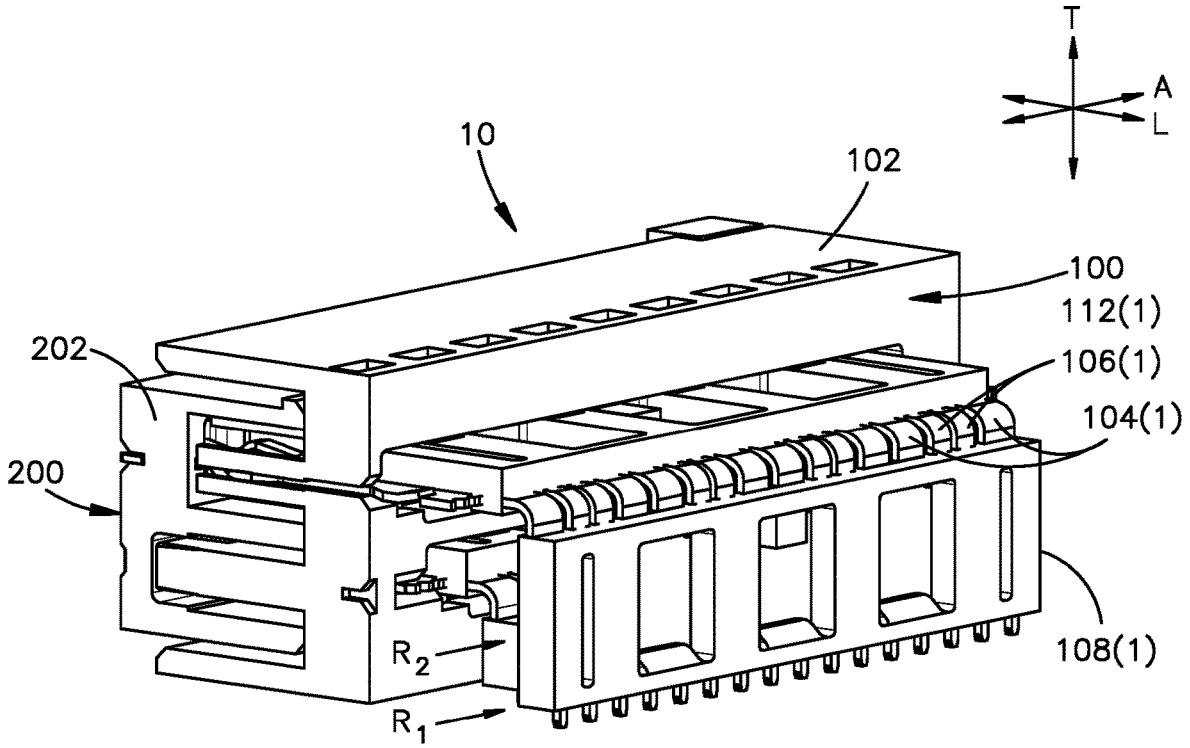
FIG. 1 shows a front perspective view of an electrical connector system according to one embodiment having a first electrical connector and a second electrical connector mated to one another.
Figure 7:
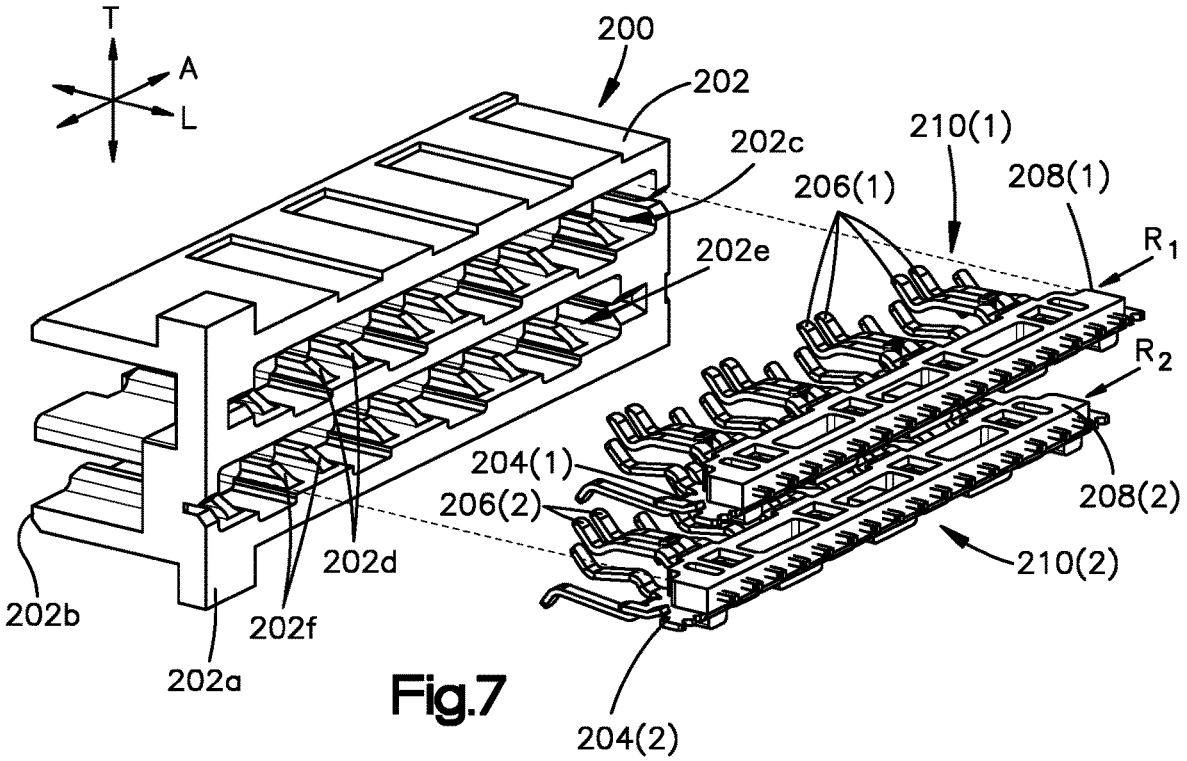
FIG. 7 shows a rear exploded perspective view of the second electrical connector of FIG. 1.
Figure 8:
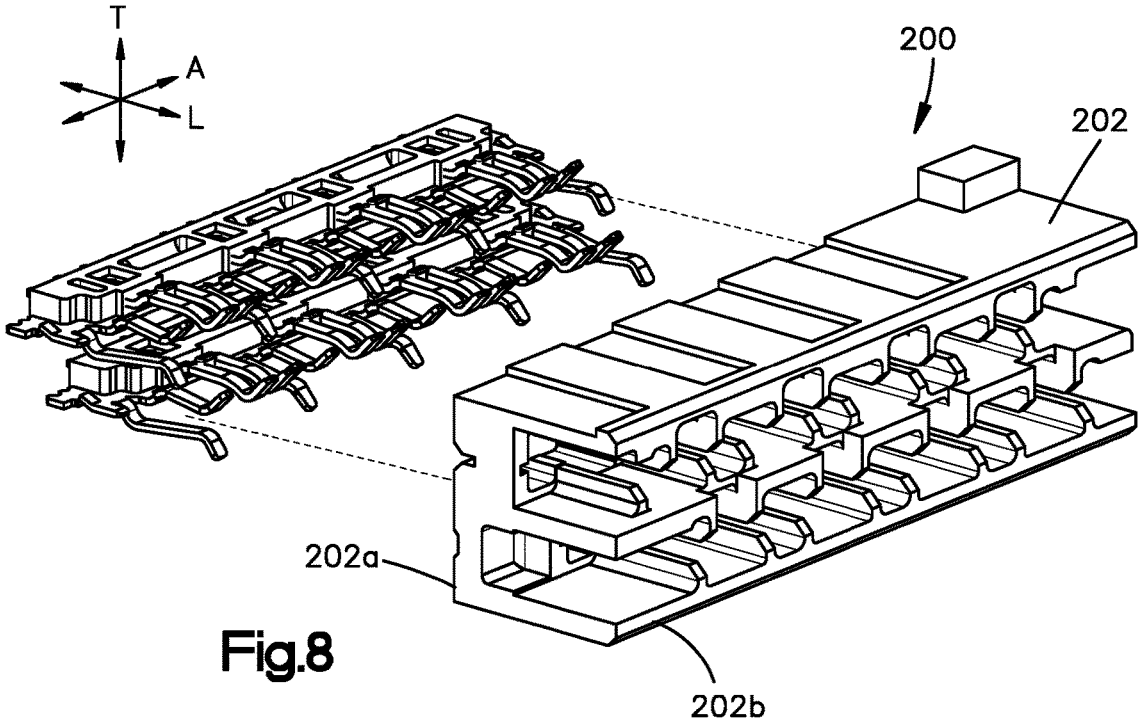
FIG. 8 shows a front exploded perspective view of the second electrical connector of FIG. 1.

Turning to FIGS. 1, 7, and 8, the second electrical connector 200 includes a second dielectric or electrically insulative connector housing 202, and a plurality of electrical contacts supported by the connector housing 202. The plurality of electrical contacts can define a first row $R_1$ of electrical contacts that is oriented along the lateral direction A and that is configured to mate with the first row $R_1$ of the first connector 100. The first row $R_1$ can include a first ground plate 204(1) and first a plurality of signal contacts 206(1). The first ground plate 204(1) can be configured to shield the signal contacts 206(1) from at least one of a second row $R_2$ of electrical contacts (discussed below) and the PCB to which the first electrical connector 100 is mounted.

The first ground plate 204(1) and the first plurality of signal contacts 206(1) can be supported by at least one dielectric or electrically insulative insert body 208(1) that is in turn supported by the connector housing 202. Thus, the electrical connector 200 can include a first insert assembly or lead frame 210(1) that includes the at least one insert body 208(1), the first ground plate 204(1), and the first plurality of signal contacts 206(1). The first ground plate 204(1) and the first plurality of signal contacts 206(1) can be affixed to the insert body 208(1) by insert molding, stitching, press fitting, or any other suitable technique for affixing an electrical contact to a housing.

The plurality of electrical contacts of the second electrical connector 200 can define a second row $R_2$ of electrical contacts that is oriented along the lateral direction A and that is configured to mate with the second row $R_2$ of the first connector 100. The second row $R_2$ can be spaced inwardly from the first row $R_1$ along the transverse direction T. It will be understood that, embodiments of the disclosure are not limited to having two rows, and that in various embodiments, the second electrical connector 200 can include as few as one row, or more than two rows of electrical contacts. The second row $R_2$ can include a second ground plate 204(2) and second a plurality of signal contacts 206(2). The second ground plate 204(2) can be configured to shield the signal contacts 206(2) from the PCB to which the first electrical connector 100 is mounted.

The second ground plate 204(2) and the second plurality of signal contacts 206(2) can be supported by at least one dielectric or electrically insulative insert body 208(2) that is in turn supported by the connector housing 202. Thus, the electrical connector 200 can include a second insert assembly or lead frame 210(2) that includes the at least one insert body 208(2), the second ground plate 204(2), and the second plurality of signal contacts 206(2). The second ground plate 204(2) can be configured to shield the signal contacts 206(2) from the PCB to which the first electrical connector 100 is mounted. The second ground plate 204(2) and the second plurality of signal contacts 206(2) can be affixed to the insert body 208(2) by insert molding, stitching, press fitting, or any other suitable technique for affixing an electrical contact to a housing.

The second connector housing 202 has a mounting end 202*a*, and a mating end 202*b* that is offset from the mounting end 202*a*. The second connector housing 202 can define a first contact opening 202*c* that extends through the mounting end 202*a* and the mating end 202*b* along the longitudinal direction L. The first contact opening 202*c* can be configured to receive the first row $R_1$ of the electrical contacts along the longitudinal direction L. For example, the first contact opening 202*c* can be configured to receive the first lead frame 210(1) that supports the first row $R_1$ of electrical contacts. The first connector housing 202 can include a first plurality of divider walls 202*d* that extend into the first contact opening 202*c*. The first divider walls 202*d* can be spaced from one another along the lateral direction A. For example, the first divider walls 202*d* can be spaced so as to separate electrical contacts from one another. In some embodiments, the first divider walls 202*d* can be spaced so as to separate pairs of signal contacts 206(1) from one another and from the ground contact beams 204*m* and 204*r* (discussed below in relation to FIGS. 13 and 14).

The second housing 202 can also define a second contact opening 202*e* that extends through the mounting end 202*a* and the mating end 202*b* along the longitudinal direction L. The second contact opening 202*e* can be spaced from the first contact opening 202*c* along the transverse direction T. The second contact opening 202*e* can be configured to receive the second row $R_2$ of the electrical contacts along the longitudinal direction L. For example, the second contact opening 202*e* can be configured to receive the second lead frame 210(2) that supports the second row $R_2$ of electrical contacts. The first connector housing 202 can include a second plurality of divider walls 202*f* that extend into the second contact opening 202*e*. The second divider walls 202*f* can be spaced from one another along the lateral direction A. For example, the second divider walls 202*f* can be spaced so as to separate electrical contacts from one another. In some embodiments, the second divider walls 202*e* can be spaced so as to separate pairs of signal contacts 206(2) from one another and from the ground contact beams 204*m* and 204*r* (discussed below in relation to FIGS. 13 and 14).

Figure 13:
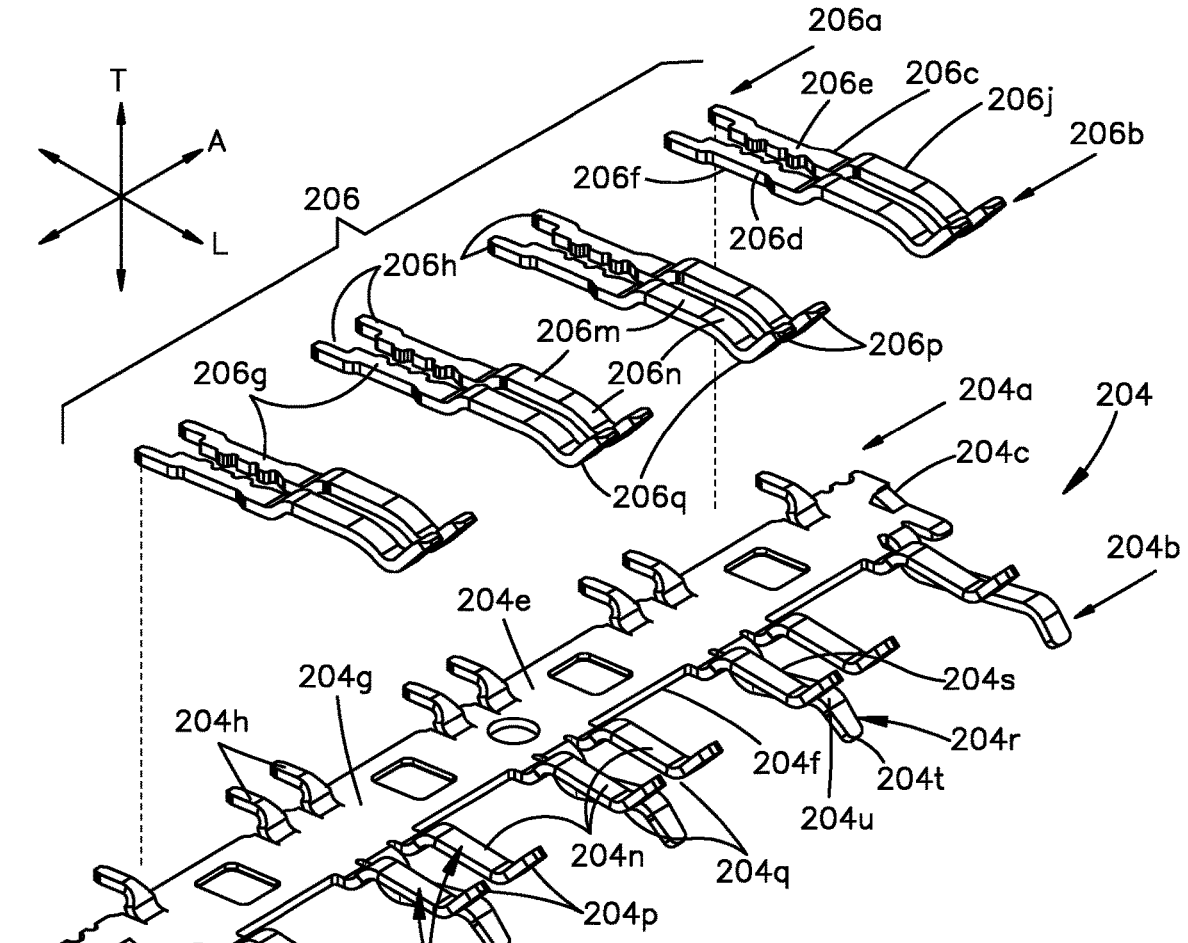
FIG. 13 shows an exploded perspective view of a ground plate and signal contacts of the second electrical connector of FIG. 1.
Figure 14:
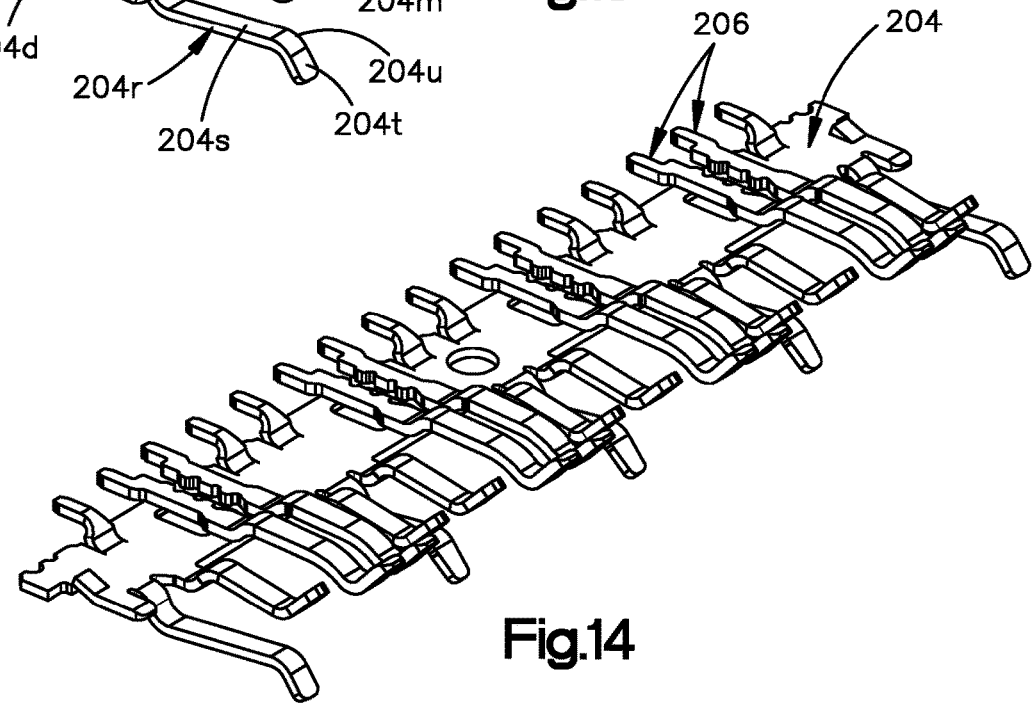
FIG. 14 shows an assembled perspective view of the ground plate and signal contacts of FIG. 13.

Turning now to FIGS. 13 and 14, a ground plate 204 and a plurality of signal contacts 206 according to one embodiment are shown. One or both of the first and second ground plates 204(1) and 204(2) of FIGS. 7 and 8 can be implemented as shown by the ground plate 204 in FIGS. 13 and 14. Similarly, one or both of the first and second pluralities of signal contacts 206(1) and 206(2) can be implemented as shown by the signal contacts 206.

Each signal contact 206 has a signal mounting end 206*a*, and a signal mating end 206*b* opposite the signal mounting end 206*a*. The signal contacts 206 are each in a substantially straight configuration, wherein the signal mounting ends

206*a* are configured to mount in the same direction (e.g., the longitudinal direction L) in which the signal mating ends 206*b* are configured to mate. Each signal contact 206 has a first signal edge 206*c*, and a second signal edge 206*d* opposite from the first signal edge 206*c* along the lateral direction A. Each signal contact 206 has a first signal broadside 206*e*, and a second signal broadside 206*f* opposite the first signal broadside 206*e*. Each signal contact 206 can have a width along the lateral direction A from its first signal edge 206*c* to its second signal edge 206*d*, a thickness from its first signal broadside 206*e* to its second signal broadside 206*f*, and a length from its signal mounting end 206*a* to its signal mating end 206*b* along one of the first and second signal broadsides 206*e* and 206*f*. The width can be greater than the thickness. Further, the length can be greater than the width and the thickness. Thus, each signal contact 206 can be elongate as it extends from its signal mounting end 206*a* to its signal mating end 206*b* along one of its first and second signal broadsides 206*e* and 206*f*.

Each signal contact 206 has a signal-contact body 206*g* that is configured to couple to the insert body of the lead frame (e.g., body 208(1) of 210(1) or body 208(2) of 210(2)). The signal mounting end 206*a* of each signal contact 206 can include a signal mounting feature 206*h* that extends from the signal-contact body 206*g*. The signal mounting feature 206*h* can be a mounting tail that is configured to receive a solder ball (not shown). However, in alternative embodiments, the mounting feature 206*h* can be configured as a press-fit mounting tail, a surface-mount tail, any other suitable mounting feature or combination of mounting features suitable for mounting the signal contact 206 onto a PCB.

The signal mating end 206*b* of each signal contact 206 can include a contact beam 206*m*. The contact beam 206*m* can be constructed as a flexible beam having a bent, such as curved, shape. Bent structures as described herein refer to bent shapes that can be fabricated, for instance, by bending the end or by stamping a bent shape, or by any other suitable manufacturing process. The contact beam 206*m* can include a beam body 206*n* and a stub 206*p* that extends from the beam body 206. The beam body 206*n* can extend from the signal-contact body 206*g* away from the signal mounting end 206*a*, and the stub 206*p* can extend from the beam body 206*n* along a direction that is angularly offset from the signal-contact body 206*g*, such as a direction that is angularly offset from the longitudinal direction L and the transverse direction T. The beam body 206*n* and the stub 206*p* can be adjoined to one another at an elbow 206*q*. At least a portion of the beam body 206*n* can be offset from the signal-contact body 206*g* along the inward-outward direction. The inward-outward direction can be aligned with the transverse direction T. The contact beam 206*m* can define a substantially "s"-shaped curve that connects the offset portion of the beam body 206*n* to the signal-contact body 206*n*.

Turning briefly to FIG. 16, the elbow 206*q* of each signal contact 206 is configured to wipe against a corresponding electrical contact 106 of the first electrical connector 100 as the first connector 100 is mated with the contact beam 206*m* of the signal contact 206 along the longitudinal direction L. As each signal contact 206 wipes against a corresponding electrical contact 106, the contact beam 206*m* of the signal contact 206 deflects along a direction that extends from the second signal broadside 206*f* to the first signal broadside 206*e*. The contact beam 206*m* can then deflect back towards its undeflected position, without returning fully to its undeflected position. When mated, each contact beam 206*m* is configured to contact a corresponding contact 106 of the first electrical connector 100 so as to apply a biasing force to the corresponding contact 106 along the inward-outward direction.

Returning to FIGS. 13 and 14, the ground plate 204 can be made from a metallic or lossy material or any other suitable material that provides shielding to the signal contacts 206. Therefore, the ground plate 204 can also be referred to as a shield. The ground plate 204 has a ground plate body 204*g* that defines a ground mounting end 204*a* and ground mating end 204*b* that are offset from one another. The ground plate 204 in FIGS. 13 and 14 is in a substantially straight configuration, wherein the ground mounting end 204*a* is configured to mount in the same direction (e.g., the longitudinal direction L) in which the ground mating end 204*b* is configured to mate. It will be understood that, in alternative embodiments, the ground plate 204 can be implemented in a right-angle configuration.

The ground plate 204 has a first ground edge 204*c*, and a second ground edge 204*d* spaced from the first ground edge 204*c* along the lateral direction A. The ground plate 204 has a first ground planar surface 204*e*, and a second ground planar surface 204*f* opposite the first ground planar surface 204*e*. The ground plate 204 can have a width along the lateral direction A from the first ground edge 204*c* to the second ground edge 204*d*, a thickness from the first planar surface 204*e* to the second planar surface 204*f*, and a length from the ground mounting end 204*a* to the ground mating end 204*b* along one of the first and second planar surfaces 204*e* and 204*f*. The length and width can be greater than the thickness. In some embodiments, the width can be greater than the length.

The ground plate body 204*g* is configured to couple to the insert body of the lead frame (e.g., body 208(1) of 210(1) or body 208(2) of 210(2)). The ground mounding end 204*a* can include a plurality of mounting features 204*h* that are configured to be attached to the second complementary electrical component (e.g., PCB). The ground mounting features 204*h* can be spaced from one another along the lateral direction A. Each mounting feature 204*h* can be configured as a mounting tail that is configured to receive a solder ball (not shown). However, in alternative embodiments, each mounting feature 204*h* can be configured as a press-fit mounting tail, a surface-mount tail, any other suitable mounting feature or combination of mounting features suitable for mounting the ground plate 204 onto a PCB. Each mounting feature 204*h* can be offset from the plate body 204*g* along the inward-outward direction (e.g., a direction that extends from the second planar surface 204*f* and to the first planar surface 204*e*.

The ground mounting features 204*h* can be arranged in pairs, although embodiments of the disclosure are not so limited. In embodiments in which the ground mounting features 204*h* are arranged in pairs, the ground mounting features 204*h* of each pair can be spaced from one another by a first distance along the lateral direction A. Further, adjacent pairs can be spaced from one another by a second distance, the second distance being greater than the first distance. In some embodiments, the second distance can be at least as great as a width of one of the signal contacts 206 along the lateral direction A. In some such embodiments, the second distance can be at least as great as a width of two of the signal contacts 206 along the lateral direction A.

The ground mating end 204*b* can include a plurality of opposed ground contact beams 204*m* and 204*r*. The ground contact beams 204*m* and 204*r* can be constructed as flexible beams having a bent, such as curved, shape. Bent structures as described herein refer to bent shapes that can be fabricated, for instance, by bending the end or by stamping a bent shape, or by any other suitable manufacturing process. Each ground contact beam 204*m* can include a beam body 204*n* and a stub 204*p* that extends from the beam body 204*n*. The stubs 204*p* can extend from the beam body 204*n* along a direction that is angularly offset from the beam body 204*n*, such as along a direction that is angularly offset from the longitudinal direction L and the transverse direction T. The direction can have a directional component that is along the inward-outward direction. The beam body 204*n* and the stub 204*p* can be adjoined to one another at an elbow 204*q*. At least a portion of the beam body 204*n* can be offset from the plate body 204*g* along the inward-outward direction. The ground contact beam 204*m* can define a substantially "s"-shaped curve that connects the offset portion of the beam body 204*n* to the plate body 204*g*.

Similarly, each ground contact beam 204*r* can include a beam body 204*s* and a stub 204*t* that extends from the beam body 204*s*. The stubs 204*t* can extend from the beam body 204*s* along a direction that is angularly offset from the beam body 204*s*, such as along a direction that is angularly offset from the longitudinal direction L and the transverse direction T. The direction can have a directional component that is in the inward-outward direction. The beam body 204*n* and the stub 204*p* can be adjoined to one another at an elbow 204*q*. At least a portion of the beam bodies 204*s* of the contact beams 204*r* can be offset from the plate body 204*g* along the inward-outward direction. The contact beam 204*r* can define a substantially "s"-shaped curve that connects the offset portion of the beam body 204*s* to the plate body 204*g*.

Each ground contact beam 204*m* can be adjacent an opposing ground contact beam 204*r*. Thus, the ground plate 204 can include sets of adjacent contact beams, where each set includes at least one pair of opposed ground contact beams 204*m* and 204*r*. As shown, in some embodiments, each set can include a two ground contact beams 204*m* and one ground contact beam 204*r*. In each set, an opposed ground contact beam 204*r* can be between a pair of the ground contact beams 204*m* with respect to the lateral direction A. Each ground contact beam 204*m* of a pair can be aligned with one of the ground mounting features 204*h* along the longitudinal direction L. The ground contact beams 204*m* of each pair can be spaced from one another by a first distance along the lateral direction A. Further, adjacent pairs of the ground contact beams 204*m* can be spaced from one another by a second distance, the second distance being greater than the first distance. In some embodiments, the first distance can be at least as great as a width of one of the ground contact beams 204*r* along the lateral direction A. Further, in some embodiments, the second distance can be at least as great as a width of two of the ground contact beams 204*r* along the lateral direction A.

Turning briefly to FIG. 15, the opposed ground contact beams 204*m* and 204*r* are configured to wipe against a corresponding ground mating feature 104*q* of the first electrical connector 100 as first electrical connector 100 and the second connector 200 are mated with one another along the longitudinal direction L. For example, each ground contact beam 204*m* is configured to wipe against the first planar surface 204*e* of the ground plate 204 at a respective one of the ground mating features 104*q*, and each ground contact beam 204*r* is configured to wipe against the second planar surface 204*f* of the ground plate 204 at a respective one of the ground mating features 104*q*. As each ground contact beam 204*m* wipes against a corresponding ground mating feature 104*q*, the contact beam 204*m* deflects along the inward-outward direction. The ground contact beam 204*m* can then deflect back towards its undeflected position, without fully returning to the undeflected position. Thus, when mated, each contact beam 204*m* applies a biasing force to the corresponding ground mating feature 104*q* along the inward-outward direction. As each ground contact beam 204*r* wipes against a corresponding ground mating feature 104*q*, the contact beam 204*r* deflects along the inward-outward direction. The ground contact beam 204*m* can then deflect back towards its undeflected position, without fully returning to the undeflected position. Thus, when mated, each contact beam 204*r* applies a biasing force to the corresponding ground mating feature 104*q* along the inward-outward direction.

As shown in FIG. 14, the ground plate 204 and the signal contacts 206 are configured to be arranged relative to one another into an adjacent position. The signal contacts 206 can be arranged so as to be spaced from one another along the lateral direction A. The signal contacts 206 can also be spaced from the ground plate 204 along the transverse direction. In some embodiments (as shown), the signal contacts 206 can be arranged in pairs, although embodiments of the disclosure are not so limited. Each pair of signal contacts 206 can define a differential signal pair. The signal contacts 206 in each pair can be arranged edge-to-edge, and spaced from one another by a first distance along the lateral direction A. The pairs of signal contacts 206 can be spaced from one another by a second distance along the lateral direction A, the second distance being greater than the first distance. In some embodiments, the second distance can be at least as great as a width of one of the signal contacts 206 along the lateral direction A. In some such embodiments, the second distance can be at least as great as a width of two of the signal contacts 206 along the lateral direction A.

The signal contacts 206 and ground plate 204 can be arranged relative to one another such that the signal mounting features 206*h* of the signal contacts 206 are in-line with one another and with the ground mounting features 204*h* of the ground plate 204 along the lateral direction A. In embodiments in which the signal contacts 206 and the ground mounting features 204*h* are arranged in pairs, individual pairs of ground mounting features 204*h* can be disposed between two pairs of the signal contacts 206 with respect to the lateral direction A. Similarly, individual pairs of the signal mounting features 206*h* can be disposed between two pairs of the ground mounting features 204*h* with respect to the lateral direction A.

The signal contacts 206 can be arranged relative to the ground plate 204 such that the contact beam 206*m* of each signal contact 206 is between at least two sets of the opposed ground contact beams 204*m* and 204*r* with respect to the lateral direction A. In embodiments in which the signal contacts 206 are arranged in pairs, the signal contacts 206 in each pair can be arranged between two sets of the opposed ground contact beams 204*m* and 204*r* with respect to the lateral direction A.

The ground plate 204 and the signal contacts 206 can maintained in the adjacent position discussed above by at least one dielectric or electrically insulative insert. For example, the signal-contact bodies 206*g* of the signal contacts 206 and the plate body 204*g* of the ground plate 204 can be disposed in an insert body (e.g., 208(1) or 208(2) of FIGS. 7 and 8). The ground plate 204 and the signal contacts 206 can be affixed to the insert body 208 by insert molding, stitching, press fitting, or any other suitable technique for affixing an electrical contact to a housing.

Discussion of FIGS. 18-32

Maintaining coplanarity of the mounting ends of contacts in a right-angle connector is important to ensure precise mounting onto a PCB. If the positions of the mounting ends of the contacts is not controlled precisely, then one or more of the mounting ends might not mount properly onto a corresponding contact of the PCB. In conventional right-angle connectors, maintaining coplanarity of the mounting ends can be difficult to control when bending the electrical contacts to form a right angle. Therefore, in the following discussion, embodiments are disclosed in which separate segments of the contacts are coupled together to form a right angle, rather than bending the contacts.

Turning now to FIGS. 18 to 21, an electrical connector 400 is shown according to another embodiment. In this embodiment, the signal and ground contacts can each have separate segments that can be coupled to one another as shown in FIGS. 23 and 24 to form angled contacts. The electrical connector 400 is configured to be mounted onto a first complementary electrical component (not shown) such as a first PCB. The first electrical connector 400 can be an angled connector, such as (without limitation) a right-angle connector, that is configured to mate with a second electrical connector (not shown) along the longitudinal direction L, and configured to mount onto the first PCB in a direction that is angularly offset from the both longitudinal direction L and the lateral direction A. Thus, the electrical connector 400 and the second electrical connector can form a connector system. In some examples, the angularly-offset direction can be a transverse direction T, that is perpendicular to both the longitudinal direction L and the lateral direction A.

The second electrical connector (not shown) can be configured to be mounted onto a second complementary electrical component (not shown) such as a second PCB. The second electrical connector can be a straight connector that is configured to mount onto the second PCB in the longitudinal direction L, and configured to mate with the second electrical connector along the longitudinal direction L. However, it will be understood that, in alternative embodiments, the second electrical connector can be implemented as an angled connector, such as (without limitation) a right-angle connector. When mated, the electrical connector 400 and the second electrical connector are configured to place the first and second complementary electrical components in electrical communication with one another. Accordingly, the electrical connector 400 and the second electrical connector provide an electrically conductive path between the first and second complementary electrical components, such as from at least one of the first and second complementary electrical components to the other of the first and second complementary electrical components.

Figure 18:
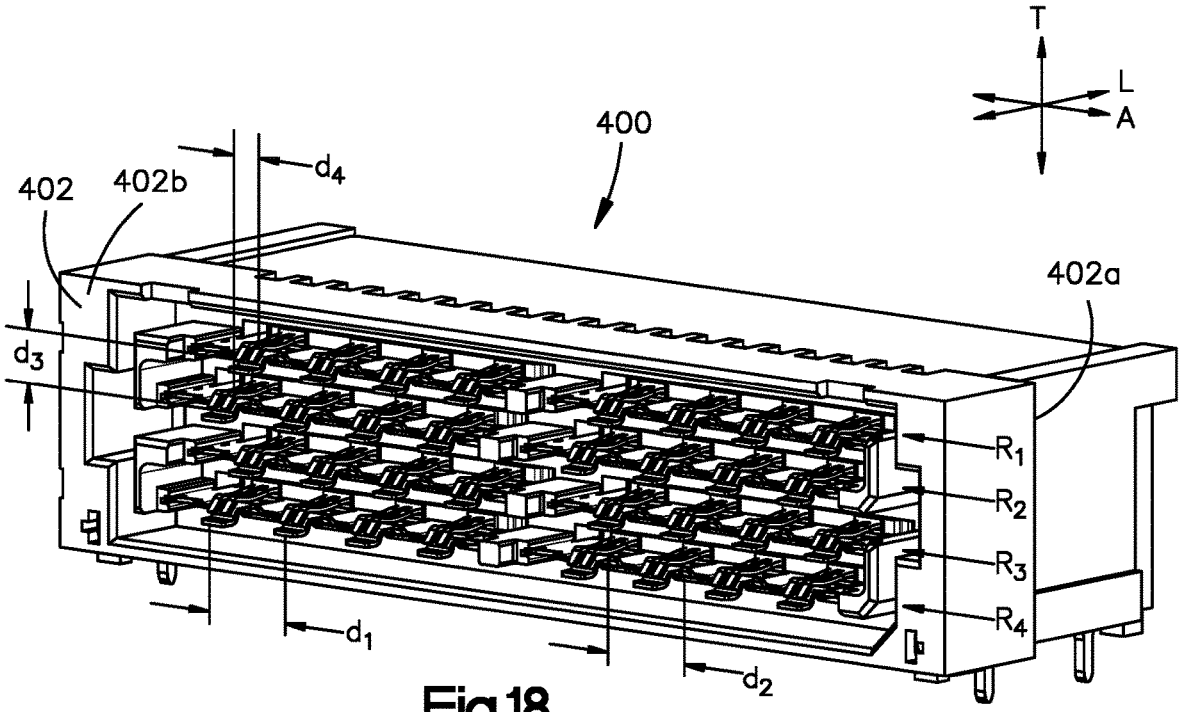
FIG. 18 shows a rear perspective view of an electrical connector according to another embodiment.
Figure 19:
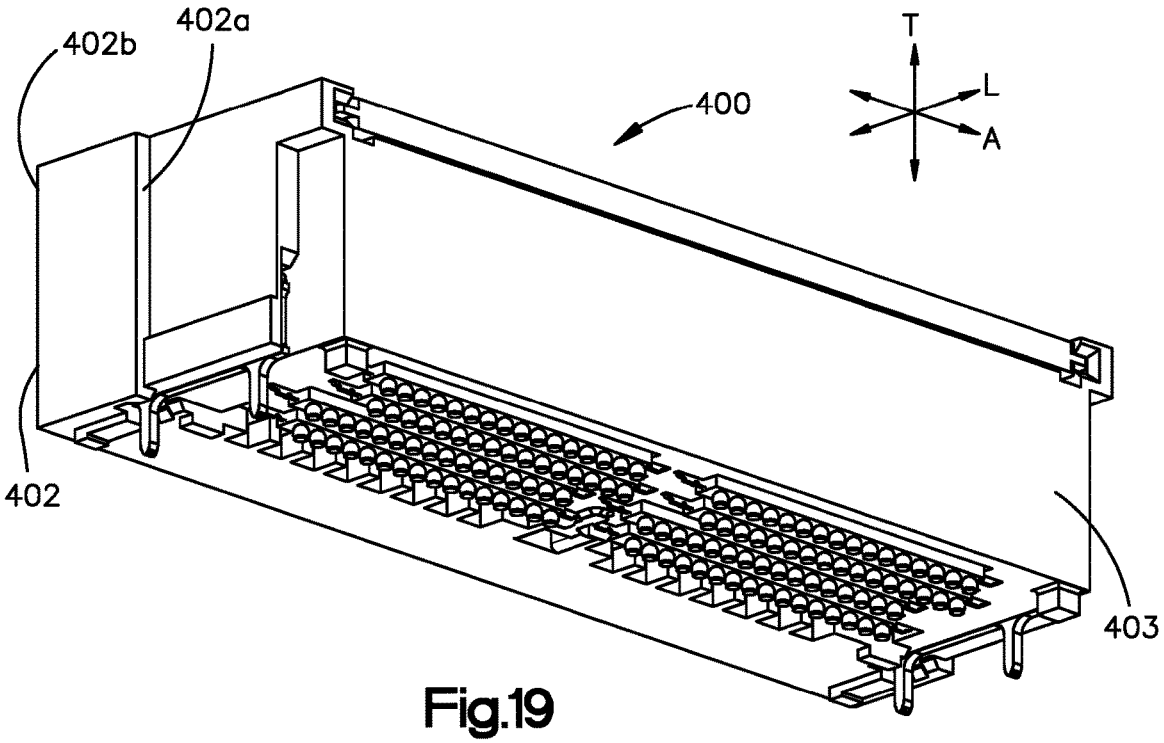
FIG. 19 shows a front perspective view of the electrical connector of FIG. 18 having a covers and hold down brackets.
Figure 20:
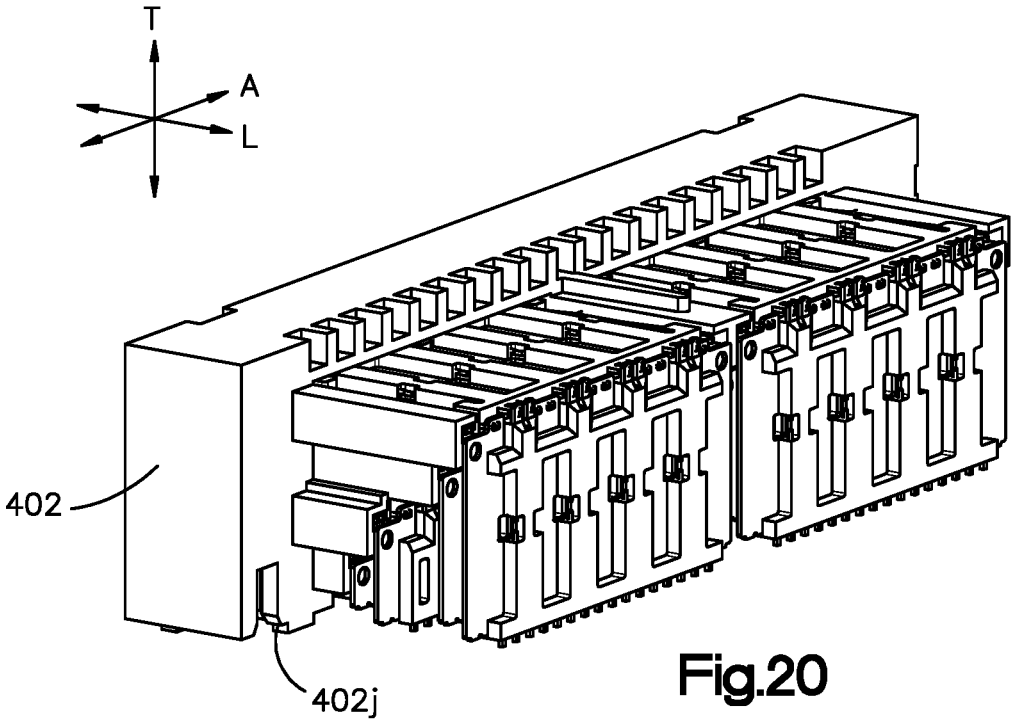
FIG. 20 shows a front perspective view of the electrical connector of FIG. 18 without the cover and without the hold down brackets.
Figure 22:
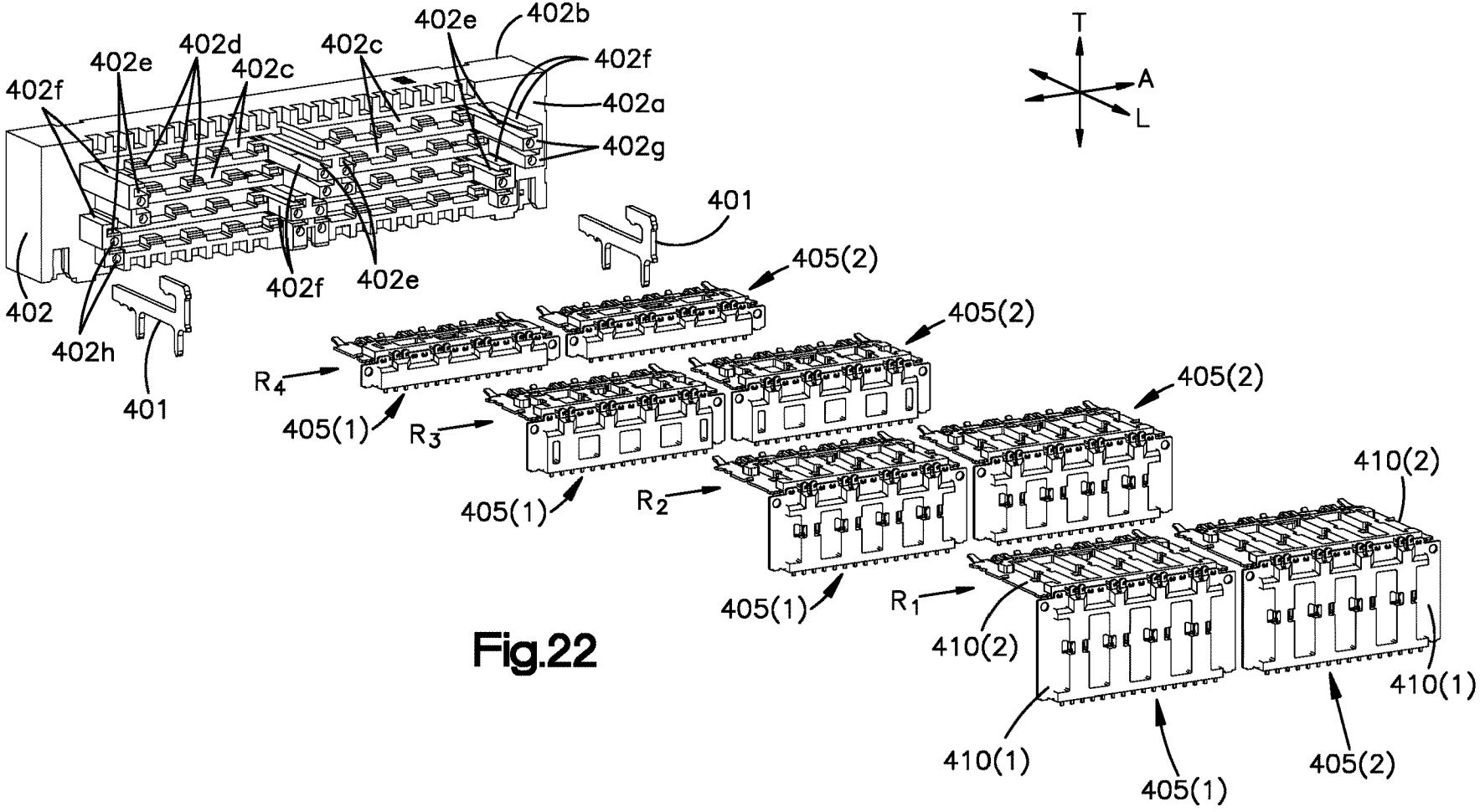
FIG. 22 shows an exploded front perspective view of the electrical connector of FIG. 18 without the cover.

Referring to FIGS. 18-20 and 22, the electrical connector 400 includes a first dielectric or electrically insulative connector housing 402, and a plurality of electrical contacts supported by the connector housing 402. The plurality of electrical contacts can define at least one row of electrical contacts that is oriented along the lateral direction A. Each row can include at least one bank of electrical contacts. In some embodiments, each row can include a plurality of banks 405(1) and 405(2) of electrical contacts that are offset from one another along the lateral direction A. Additionally or alternatively, in some embodiments, the plurality of electrical contacts can define a plurality of rows $R_1$, $R_2$, $R_3$, and $R_4$ of electrical contacts that are offset from one another along an inward-outward direction. In FIGS. 20 and 22, four rows $R_1$, $R_2$, $R_3$, and $R_4$ of electrical contacts are shown, each row having two banks 405(1) and 405(2). It will be understood that embodiments of the disclosure can have any suitable number of rows and any suitable number of banks of electrical contacts.

Turning briefly to FIGS. 23 to 26, a bank 405 of electrical contacts is shown according to one example embodiment. At least one, up to all, of the banks 405(1) and 405(2) in FIG. 22 can be implemented as shown by the bank 405 in FIG. 23. The bank 405 can include a pair of wafers or lead frames, including first and second lead frames 410(1) and 410(2). The first lead frame 410(1) defines a mounting end of the electrical contacts, and therefore can be considered to be a mounting-end lead frame 410(1). The second lead frame 410(2) defines a mating end of the electrical contacts, and therefore can be considered to be a mating-end lead frame 410(2). The lead frames 410(1) and 410(2) in each pair can be angularly offset from one another by an angle θ between 75 degrees and 105 degrees. In one example, the lead frames 410(1) and 410(2) can be angularly offset from one another by an angle θ of approximately 90 degrees.

The bank 405 of electrical contacts includes a ground contact 404 and a plurality of signal contacts 406. The ground contact 404 and the signal contacts 406 can be made from a metallic or lossy material such as copper, nickel, beryllium, gold, silver, or any other suitable metal, metal alloy, or electrically conductive material. As will be described in further detail below, the ground contact 404 can include a first ground segment **404*g*, and a separate second ground segment 404*h* that can be coupled to the first ground segment 404*g*. Similarly, each signal contact 406 can include a first signal segment 406*g*, and a separate second signal segment 406*h* that can be coupled to the first signal segment 404*g*. Each ground contact 404 can be configured as a ground shield that shields its respective signal contacts 406 from at least one of (i) an adjacent row of electrical contacts and (ii) the PCB to which the electrical connector 400** is mounted.

The bank 405 of electrical contacts can further include at least one dielectric or electrically insulative insert body 408 and 412 that supports the ground contact 404 and the signal contacts 406. For example, the bank 405 of electrical contacts can include an electrically insulative insert body 408 that supports the first ground segment **404*g* and the first signal segments 406*g*. Thus, the lead frame 410(1) can include the inset body 408, the first ground segment 404*g* and the first signal segments 406*g*. Further, the bank 405 of electrical contacts can include an electrically insulative insert body 412 that supports the second ground segment 404*h* and the second signal segments 406*h*. Thus, the lead frame 410(2) can include the inset body 412, the second ground segment 404*h*, and the second signal segments 406*h*. The ground contact 404 and the second plurality of signal contacts 406 can be affixed to the at least one insert body 408 and 412 by insert molding, stitching, press fitting, or any other suitable technique for affixing an electrical contact to a housing. For example, the first ground segment 404*g* and the first signal segments 406*g* can be affixed to the insert body 408, and the second ground segment 404*h* and second signal segments 406*h* can be affixed to the insert body 412. The at least one dielectric or electrically insulative insert body 408 and 412 can provide electrical insulation between the ground contact 404 and the signal contacts 406 and between each of the signal contacts 406**.

Returning to FIG. 22, in embodiments such as shown in FIG. 22 that have multiple rows of electrical contacts, the lead frames 410(1) and 410(2) can decrease in size from one row to the next along an inward direction that extends from an outer-most row to an innermost row. For example, each mounting-end lead frame 410(1) can have a height along the transverse direction T, and the heights of the lead frames 410(1) can decrease from one row to the next along the inward direction. Similarly, each mating-end lead frame 410(2) can have a length along the longitudinal direction L, and the lengths of the lead frames 410(2) can decrease from one row to the next along the inward direction. This decrease in size can permit the rows of electrical contacts to be nested within one another.

The connector housing 402 has a mounting end 402*a*, and a mating end 402*b* that is offset from the mounting end 402*a*. The connector housing 402 can define at least one contact opening 402*c* that extends through the mounting end 402*a* and the mating end 402*b* along the longitudinal direction L. Each contact opening 402*c* can be configured to receive a portion of a bank 405 of the electrical contacts along the longitudinal direction L. For example, each contact opening 402*c* can be configured to receive at least a portion of a mating-end lead frame 410(2) of a bank 405 of electrical contacts. The connector housing 402 can include, for each contact opening 402*c*, a plurality of spacer walls 402*d* that extend into the contact opening 402*c* along the transverse direction T. The spacer walls 402*d* in each contact opening 402*c* can be spaced from one another along the lateral direction A. For example, the spacer walls 402*d* can be spaced so as to align with mating features 404*q* (discussed below in relation to FIGS. 27 and 28) of one of the ground contacts 404 along the transverse direction T.

In embodiments such as shown in FIG. 22 that have multiple rows of electrical contacts, the connector housing 402 can define at least one contact opening 402*c* for each row. The contact openings 402*c* of the rows R can be offset from one another along the transverse direction T. Further, in embodiments such as shown in FIG. 22 where a row of electrical contacts has multiple banks 405 of electrical contacts, the connector housing 402 can define a contact opening 402*c* for each bank 405. The contact openings 402*c* for the banks 405 in a row can be offset from one another along the lateral direction A.

The connector body 402 can define at least one receptacle that is configured to receive a bank 405 of electrical contacts. For example, the connector body 402 can define a plurality of receptacles that are configured to receive a plurality of banks 405 of electrical contacts. Each receptacle can be configured to receive one of the banks 405 of electrical contacts. In embodiments having a plurality of rows of electrical contacts, the receptacles of each row can be offset from one another along the transverse direction T. In embodiments having a plurality of banks 405 of contacts in a row, the receptacles in a row can be offset from one another along the lateral direction A. FIG. 22 shows an embodiment having four rows of receptacles, where each row of receptacles has two receptacles. However, it will be understood that the connector body 402 can define any suitable number of rows of receptacles and any suitable numbers of receptacles in each row.

Each receptacle can be defined by at least one groove or recess 402*e* that is defined by the connector body 402. Each groove 402*e* can be elongate along the longitudinal direction L. Each groove 402*e* can extend into an inner surface of the connector body 402 along the lateral direction A. For example, each receptacle can be defined between a pair of grooves 402*e* defined the connector body 402. The grooves 402*e* of each pair can be spaced from one another along the lateral direction A, and can be open towards one another. The grooves 402*e* of each pair can extend into respective inner surfaces of the connector body 402 that face one another. Each pair of grooves 402*e* can be configured to receive at least a portion of a respective one of the banks 405 therebetween along the longitudinal direction L. For example, each pair of grooves 402*e* can be configured to receive edges of a respective mating-end lead frame 410(2) along the longitudinal direction L.

The connector body 402 can include at least one block 402*f*. Each groove 402*e* can be defined by the at least one block 402. For example, each block 402*f* can include an inner surface into which a groove 402*e* extends along the lateral direction A. In some examples, the connector body 402 can include a plurality of blocks 402*f* that define a plurality of grooves 402*e*, and each groove 402*e* can be defined by one of the blocks 402*f* Each block 402*f* can extend from the mounting end 402*a* of the connector body 402 along the longitudinal direction L. The plurality of blocks 402*f* can include a pair of blocks 402*f* for each receptacle. The blocks 402*f* of each pair can be spaced from one another along the lateral direction A. In embodiments having a plurality of rows of electrical contacts, the blocks 402*f* for each row can be offset from one another along the transverse direction T. Further, the blocks 402*f* can each have a length along the longitudinal direction, and the lengths of the blocks 402*f* can decrease from one row to the next along the transverse direction T.

In embodiments having a plurality of banks 405 of contacts in a row, the blocks 402*f* in a row can be offset from one another along the lateral direction A. Further, interior blocks 402*f* between adjacent receptacles in a row can be shared between the adjacent receptacles. Thus, each interior block 402*f* can define first and second grooves 402*e* that face away from one another and that define adjacent receptacles. FIG. 22 shows an embodiment having four rows of bocks 402*f*, where each row of blocks 402*f* has three blocks 402*f*. However, it will be understood that the connector body 402 can define any suitable number of rows of blocks 402*f* and any suitable numbers of blocks 402*f* in each row.

The connector body 402 can include at least one abutment surface 402*g* that is configured to abut a bank 405 of electrical contacts. For example, the connector body 402 can include a plurality of abutment surfaces 402*g* that are configured to abut a plurality of banks 405 of electrical contacts. Each abutment surface 405 can be configured to abut a mounting-end lead frame 410(1) so as to orient the mounting-end lead frame 410(1) along a direction that is angularly offset from a respective one of the mating-end lead frames 410(2). For example, each abutment surface 405 can be configured to orient a mounting-end lead frame 410(1) to be at an angle θ with respect to the mating-end lead frame 410(2). The angle θ can be between 75 degrees and 105 degrees. In one example, the angle θ can be substantially equal to 90 degrees, and thus, each abutment surface 402*g* can be aligned with a plane that extends substantially along the lateral direction A and the transverse direction T. Each abutment surface 402*g* can be defined by a block 402*f*, such as at a free end of the block 402*f* that is opposite the mating end 402*b* of the connector body 402.

In some embodiments, the connector body 402 can include at least one alignment feature 402*h* at an abutment surface 402*g* that is configured to align a respective one of the mounting-end lead frames 410(1) with the abutment surface 402*g* along the lateral direction A and transverse direction T. For example, the connector body 402 can include a plurality of alignment features 402*h* that are configured to align a plurality of the mounting-end lead frames 410(1) with the abutment surfaces 402*g* along the lateral direction A and transverse direction T. In one example, each alignment feature 402*h* can be an opening defined in a respective one of the abutment surfaces 402*g*. However, it will be understood that each alignment feature

402*h* could alternatively be a projection that is configured to be received in an opening of a respective one of the mounting-end lead frames 410(1).

Figure 21:
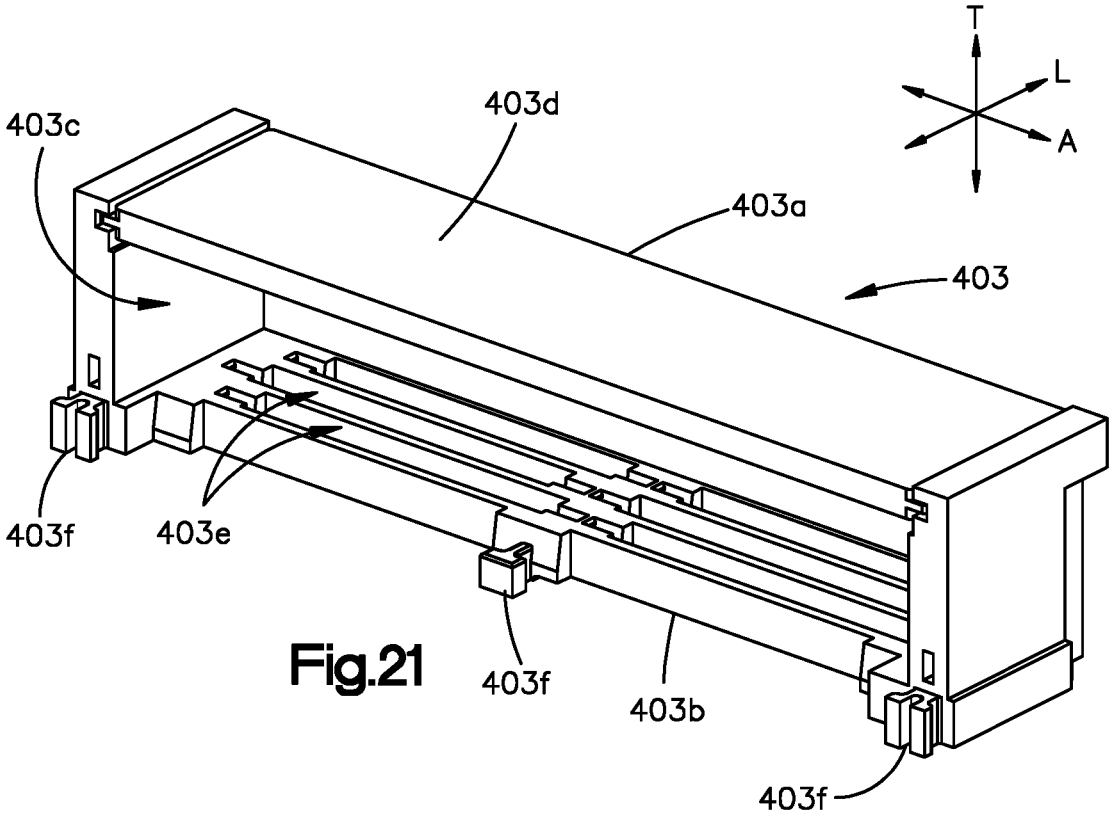
FIG. 21 shows a perspective view of the cover of the electrical connector of FIG. 18.

With reference to FIGS. 20 and 21, the electrical connector 400 can include a cover 403 that is configured to cover and protect the electrical contacts. The cover 403 can include an upper end 403*a* and a lower end 403*b* spaced from one another along the transverse direction T. The cover 403 can define a recess 403*c* that extends between the upper end 403*a* and the lower end 403*b*. The recess 403*c* can be configured to receive elbows of the electrical contacts such that the cover 403 protects the electrical contacts at a location between their respective mounting ends and mating ends.

The upper end 403*a* can include a lid 403*d* that is configured to be selectively opened and closed. For example, the lid 403*d* can be opened as the cover 403 is translated into engagement with the housing 402 along a direction that extends from the lower end 403*b* to the upper end 403*a*. The lid 403*d* can then be closed over the electrical contacts once the lid 403*d* is in position. In some embodiments, the lid 403*d* can be translated between the open and closed position along the longitudinal direction L by sliding the lid 403*d* along a pair of grooves. In other embodiments, the lid 403*d* can be rotated to an open position about a hinge (not shown).

The lower end 403*b* can define a plurality of slots 403*e* that extend therethrough. Each slot 403*e* can be configured to receive the mounting ends of a row or a bank of electrical contacts therethrough as can be seen in FIG. 19, such that the mounting ends are positioned to mount to a complementary electrical component. The cover 403 can include at least one coupling feature 403*f* that is configured to mate with a corresponding coupling feature 402*j* of the housing 402. In one example, the at least one coupling feature 402*j* can define a groove, and the at least one coupling feature 403*f* can define a tongue that is configured to be received in the groove. The tongue can have a T-shape or any other suitable shape. It will be understood that the cover 403 and housing 402 can include any other suitable other types of coupling features that are configured to couple the cover 403 to the housing 402.

As can be seen in FIG. 22, the connector 400 can include at least one hold down bracket 401 that is configured to secure the connector 400 to the PCB. Each hold down bracket 401 can be inserted into a slot on a side of the cover 403 or housing 402. In some embodiments, the hold down bracket 401 can secure the cover 403 to the housing 402. The hold down bracket 401 can have an upper horizontal arm that is configured to secure the cover 403 to the PCB, and a lower horizontal arm that is configured to secure the housing 402 to the PCB.

Turning now to FIGS. 24, 27, and 28, an example of a bank of electrical contacts is shown without the insert bodies 408 and 412. At least one, up to all, of the banks 405(1) and 405(2) in FIG. 22 can be implemented as shown in FIGS. 24, 27, and 28 (although the lengths and heights of the banks can vary from one row to the next as described above). Now with specific reference to FIG. 27, each signal contact 406 has a first segment 406*g* and a second separate segment 406*h*. Note that each first segment 406*g* and each second segment 406*h* may also be referred to as a first signal segment and a second signal segment, respectively. The first and second segments are configured to couple to one another such that the signal contact 406 defines an angle θ between 75 degrees and 105 degrees from the first segment 406*g* to the second segment 406*h*. In some embodiments, the angle θ can be substantially 90 degrees.

Each first segment 406*g* has a first pair of surfaces 406*c* that are opposite from one another. Each first surface 406*c* may be referred to as a broadside. Each first segment 406*g* has a first pair of edges 406*d* that are opposite from one another and that extend between the first pair of surfaces 406*c*. Each first segment 406*g* has a mounting end 406*a* that is configured to mount to a first electrical component (not shown). Each mounting end 406*a* can be referred to as a signal mounting end. Each mounting end 406*a* can define a mounting feature 406*k* such as a mounting tail that is configured to receive a solder ball (not shown). However, in alternative embodiments, the mounting feature 406*k* can be configured as a press-fit mounting tail, a surface mount tail, or any other suitable mounting feature or combination of mounting features suitable for mounting the signal contact 406 onto a PCB.

Each first segment 406*g* has a first coupling end 406*i* that is offset from its mounting end 406*a* along an angularly offset direction $D_{AO}$ that is angularly offset from the longitudinal direction L and the lateral direction A. In some embodiments, the angularly offset direction $D_{AO}$ can be the transverse direction T. Each first coupling end 406*i* can be referred to as a first signal coupling end. Each first coupling end 406*i* can define at least one first coupling feature 407. The at least one coupling feature 407 can define, for example, an opening that is configured to receive a projection of a respective one of the second segments 406*h*. However, it will be understood that the at least one coupling feature 407 can be any other suitable coupling feature, such as a projection that is configured to be received in an opening of a respective one of the second segments 406*h*.

Each first segment 406*g* can have a width along the lateral direction A from one edge 406*d* to the other edge 406*d*, a thickness from one surface 406*c* to the other surface 406*c*, and a length from its signal mounting end 406*a* to its first coupling end 406*i*. The width can be greater than the thickness. Further, the length can be greater than the width and the thickness.

Each second segment 406*h* has a second pair of surfaces 406*e* that are opposite from one another. Each second surface 406*e* may be referred to as a broadside. Each second segment 406*h* has a second pair of edges 406*f* that are opposite from one another and that extend between the second pair of surfaces 406*e*. Each second segment 406*h* has a mating end 406*b* that is configured to mate with electrical contacts of a second electrical component (not shown). Each mating end 406*b* can be referred to as a signal mating end.

Each mating end 406*b* can define a mating feature that is configured to mate with electrical contacts of a second electrical component. For example, each mating feature can comprise a contact beam 406*m*, although embodiments of the disclosure can implement other suitable mating features. The contact beam 406*m* can extend from a body of the second segment along the longitudinal direction L. The contact beam 406*m* can be constructed as a flexible beam having a bent, such as curved, shape. Bent structures as described herein refer to bent shapes that can be fabricated, for instance, by bending the end or by stamping a bent shape, or by any other suitable manufacturing process. The contact beam 406*m* can include a beam body 406*n* and a stub 406*p* that extends from the beam body 406*n*. The stub 406*p* can extend from the beam body 406*n* along a direction that is away from the signal mounting end 406*a* and angularly offset from the beam body 406*n*, such as along a direction that is angularly offset from a plane that extends along the longitudinal direction L and the lateral direction A. The beam body 406*n* and the stub 406*p* can be adjoined to one another at an elbow 406*q*. At least a portion of the beam body 406*n* can be offset from the second segment 406*h* along the transverse direction T. The contact beam 406*m* can define a substantially "s"-shaped curve that connects the offset portion of the beam body 406*n* to a body of the second segment 406*h*.

Each elbow 406*q* is configured to wipe against a corresponding electrical contact of the second electrical connector (not shown) as the second electrical connector is mated with the contact beam 406*m* of the signal contact 406 along the longitudinal direction L. As each signal contact 406 wipes against a corresponding electrical contact of the second electrical connector, the contact beam 406*m* of the signal contact 406 deflects along the transverse direction T from an undeflected position to a deflected position. The contact beam 406*m* can then deflect back along the transverse direction T from its deflected position towards its undeflected position, without fully returning to the undeflected position. When mated, each contact beam 406*m* is configured to contact a corresponding contact of the second electrical connector so as to apply a biasing force to the corresponding contact along the transverse direction T.

Each second segment 406*h* has a second coupling end 406*r* that is offset from its mating end 406*b* along the longitudinal direction L. Each second coupling end 406*r* can be referred to as a second signal coupling end. Each second coupling end 406*r* can define at least one second coupling feature 409. The at least one coupling feature 409 can define, for example, a projection that is configured to be received in an opening of a respective one of the first segments 406*g*. However, it will be understood that the at least one coupling feature 409 can be any other suitable coupling feature, an opening that is configured to receive a projection of a respective one of the first segments 406*g*.

Each second segment 406*h* can have a width along the lateral direction A from one edge 406*f* to the other edge 406*f*, a thickness from one surface 406*e* to the other surface 406*e*, and a length from its signal mating end 406*b* to its second coupling end 406*r*. The width can be greater than the thickness. Further, the length can be greater than the width and the thickness.

Figure 32:
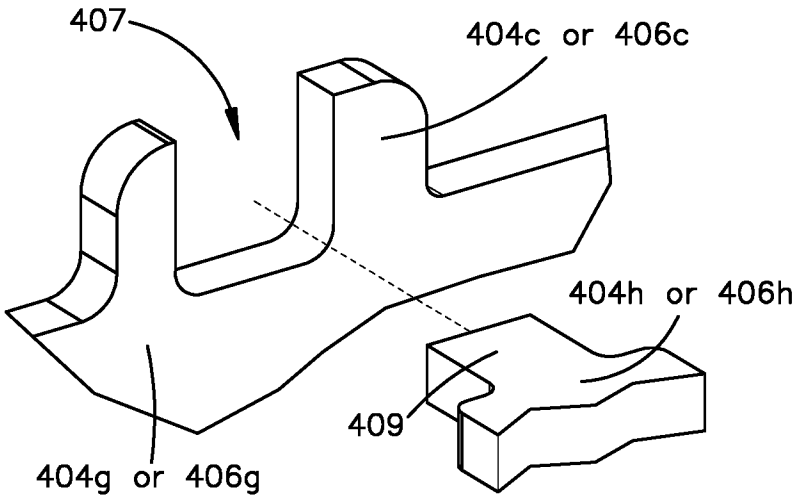
FIG. 32 shows a perspective view of first and second coupling features of the electrical contacts according to another embodiment, the first and second coupling features defining a projection and a recess, respectively.
Figure 31:
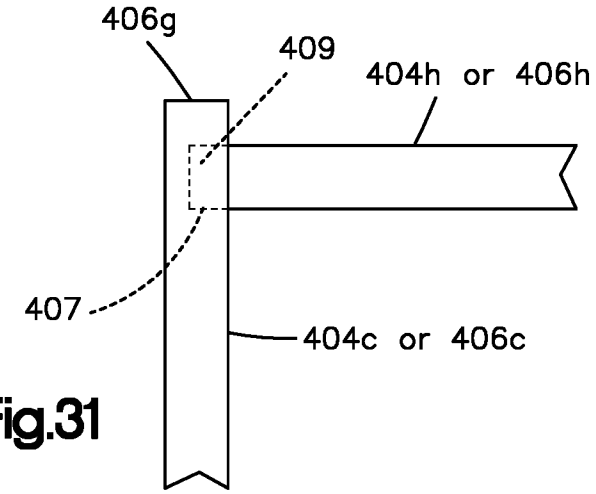
FIG. 31 shows a side view of the first and second coupling features of FIG. 29 according to another embodiment.
Figure 29:
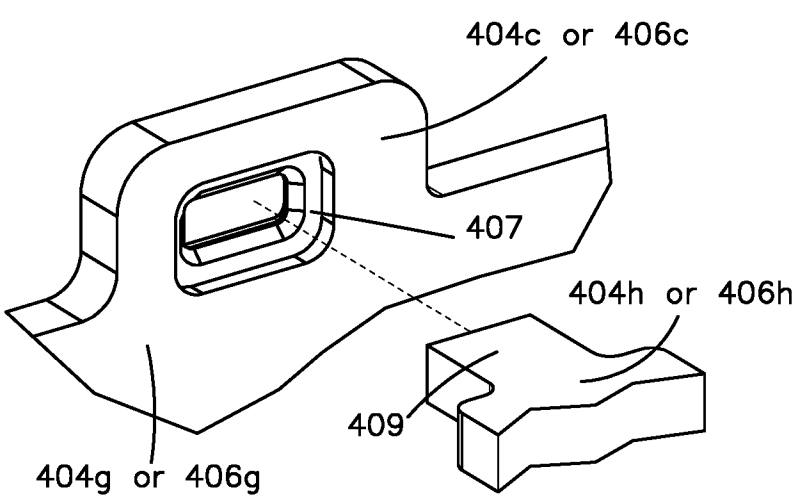
FIG. 29 shows a perspective view of first and second coupling features of the electrical contacts according to one embodiment, the first and second coupling features defining a projection and a recess, respectively.
Figure 30:
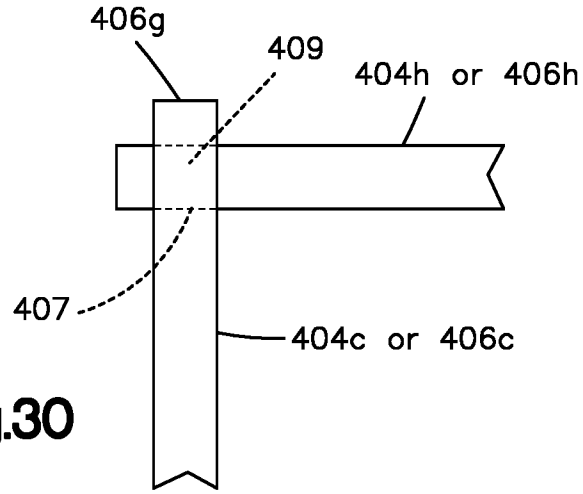
FIG. 30 shows a side view of the first and second coupling features of FIG. 29 according to one embodiment.

Turning briefly to FIGS. 29 to 32, various embodiments of the coupling features 407 and 409 are shown. As shown in FIGS. 29 to 32, the first coupling feature 407 can be an opening that extends into a broadside 406*c* of the first segment 406*g* and at least partially through the first segment 406*g*. The opening can have a rectangular shape, a circular shape, or any other suitable shape for mating with a projection. The second coupling feature 409 can be a projection that is sized and configured to extend at least partially through the opening. The projection can have a rectangular shape, a circular shape, or any other suitable shape for mating with an opening. The projection can have a width along the lateral direction that is less than a width of from one edge 406*f* to the other edge 406*f*. In some embodiments, as shown in FIGS. 29 to 31, the opening can be spaced from the end of the first segment 406*g* such that the opening defines a closed shape in a plane that is aligned with the broadsides 406*c*. In other embodiments, as shown in FIG. 32, the opening can be open at the end of the first segment 406*g* such that the opening defines an open shape in a plane that is aligned with the broadsides 406*c*.

In some embodiments, the opening can extend entirely through the first segment 406*g* as shown in FIG. 30, such as through the pair of broadsides 406*c*. In other embodiments, the opening can extend partially through the first segment 406*g* so as to define a recess illustrated by the dashed line in FIG. 31. The projection can be sized and configured to extend into the opening and at least partially through the first segment 406*g*. For example, as shown in FIG. 30, the projection can be sized to extend entirely through the first segment 406*g* so that the projection extends into one broadside 406*c* and beyond the other broadside 406*c*. Thus, the opening can have a thickness along a direction, and the projection can have a length along the direction L that is greater than the thickness such that the projection extends entirely through the opening. Alternatively, the projection can be sized to extend partially, but not fully, through the first segment 406*g* as shown in FIG. 31. It will be understood that the projections and openings of FIGS. 29 to 32 can be reversed such that the first segment defines the projection and the second segment defines the opening. Thus, one of the first and second coupling features 407 and 709 can be an opening defined in one of the broadsides of the first and second pairs of broadsides 406*c* and 406*e*, and the other one of the first and second couplings 407 and 409 can be a projection that is configured to be received in the opening.

In each embodiment, the projection can be fixed in the opening by welding. Welding can be performed by laser welding, or any other suitable welding technology such as ultrasonic tip, and can use any suitable laser such as a red laser or a green laser. In examples where the projection extends entirely through the opening, the projection can be welded so as to melt the terminal end of the projection, thereby bonding the projection to the first segment. Melting the terminal end can cause a total physical length of the signal segment 406*h* to decrease. Melting the terminal end can additionally or alternatively cause a total physical width of the terminal end of the signal segment to increase. Thus, melting the terminal end of the projection can cause the terminal end to form a bead having, for example, a substantially hemispherical shape as illustrated in FIG. 24. In alternative embodiments, the projection can be fixed in the opening by press fit, bonding, welding, soldering, adhering, or any other suitable technique to join the first and second segments. Bonding can be performed using an epoxy or any other suitable adhesive. The epoxy or adhesive can be electrically conductive.

Returning to FIG. 27, the at least one first coupling feature 407 and the at least one second coupling feature 409 can be configured to couple to one another such that electrical contact defines an angle θ between 75 degrees and 105 degrees from the first segment 406*g* to the second segment 406*h*. When the first and second segments 406*g* and 406*h* are coupled to one another to form a signal contact 406, the signal contact 406 defines a continuous conductive path between the mounting end 406*a* and the mating end 406*b*. It will be understood that all of the signal contacts 406 of the connector 400 can be implemented using the same coupling features, or at least some of the signal contacts 406 can use different coupling features than other signal contacts 406. For example, some of the first segments 406*g* can be implemented with projections, while others can be implemented with openings. Similarly, some of the second segments 406*h* can be implemented with projections, while others can be implemented with openings.

Turning now to FIG. 28, the ground contact 404 has a first segment 404*g* and a second separate segment 404*h*. The first segment 404*g* can be a first ground plate, and the second segment 404*h* can be a second ground plate. Note that the first segment 404*g* and the second segment 404*h* may also be referred to as a first ground segment and a second ground segment, respectively. The first and second segments are configured to couple to one another such that the ground contact 404 defines an angle θ between 75 degrees and 105 degrees from the first segment 404*g* to the second segment 404*h*. In some embodiments, the angle θ can be substantially 90 degrees.

The first segment 404*g* has a first pair of surfaces 404*c* that are opposite from one another. Each first surface 404*c* may be referred to as a broadside. The first segment 404*g* has a first pair of edges 404*d* that are opposite from one another and that extend between the first pair of surfaces 404*c*. The first segment 404*g* has a mounting end 404*a* that is configured to mount to a first electrical component (not shown). The mounting end 404*a* can be referred to as a ground mounting end. The first segment 404*g* has a first coupling end 404*i* that is offset from the mounting end 404*a* along an angularly offset direction $D_{AO}$ that is angularly offset from the longitudinal direction L and the lateral direction A. In some embodiments, the angularly offset direction $D_{AO}$ can be the transverse direction T. The first coupling end 404*i* can be referred to as a first ground coupling end. The first segment 404*g* can have a width along the lateral direction A from one edge 404*d* to the other edge 404*d*, a thickness from one surface 404*c* to the other surface 404*c*, and a length from its ground mounting end 404*a* to its first coupling end 404*i*. The length and width can be greater than the thickness. Further, in some embodiments, the width can be greater than the length.

The mounting end 404*a* can define at least one mounting feature 404*k* that is configured to mount to a first component such as a PCB. Each mounting feature 404*k* can be configured as a mounting tail that is configured to receive a solder ball (not shown). However, in alternative embodiments, each mounting feature 406*k* can be configured as a press-fit mounting tail, a surface mount tail, or any other suitable mounting feature or combination of mounting features suitable for mounting the ground contact 404 onto a PCB.

In some examples, the mounting end 404*a* can define a plurality of mounting features 404*k*. The mounting features 404*k* can be spaced from one another along the lateral direction A. At least some of the mounting features 404*k* can be arranged in pairs, although embodiments of the disclosure are not so limited. In embodiments in which the mounting features 404*k* are arranged in pairs, the mounting features 404*k* of each pair can be spaced from one another by a first distance along the lateral direction A. Further, adjacent pairs can be spaced from one another by a second distance, the second distance being greater than the first distance. In some embodiments, the second distance can be at least as great as a width of one of the signal contacts 406 along the lateral direction A. In some such embodiments, the second distance can be at least as great as a width of two of the signal contacts 406 along the lateral direction A.

The first coupling end 404*i* can define at least one first coupling feature 407. Each first coupling feature 407 can define, for example, an opening that is configured to receive a projection of the second segment 404*h*. In some examples, each first coupling feature 407 can include a tab that defines the opening. However, it will be understood that each first coupling feature 407 can be any other suitable coupling feature, such as a projection that is configured to be received in an opening of the second segment 404*h*.

In some examples, the at least one first coupling feature 407 can include a plurality of first coupling features 407. The first coupling features 407 can be spaced from one another along the lateral direction A. At least some of the first coupling features 407 can be arranged in pairs, although embodiments of the disclosure are not so limited. In embodiments in which the first coupling features 407 are arranged in pairs, the first coupling features 407 of each pair can be spaced from one another by a first distance along the lateral direction A. Further, adjacent pairs can be spaced from one another by a second distance, the second distance being greater than the first distance. In some embodiments, the second distance can be at least as great as a width of one of the signal contacts 406 along the lateral direction A. In some such embodiments, the second distance can be at least as great as a width of two of the signal contacts 406 along the lateral direction A. Each pair of first coupling features 407 can be aligned with a pair of the mounting features 404*k*, although embodiments of the disclosure are not so limited.

In some embodiments, the first segment 404*g* can include at least one alignment feature 404*l* that is configured to align with an alignment feature 402*h* of the connector housing 404 (shown in FIG. 22). When aligned, the alignment features 404*l* and 402*h* can align the mounting-end lead frame 410(1) with an abutment surface 402*g* along the lateral direction A and transverse direction T. For example, the first segment 404*g* can include a pair of alignment features 404*l* that are configured to align with an alignment feature 402*h* of the connector housing 404. In one example, each alignment feature 404*l* can be an opening defined in a surface 404*c* of the first segment 404*g*. The connector can include fasteners that extend through the openings 404*l* and the openings 402*h* of the housing 402 so as to secure the bank 405 to the housing 402. However, it will be understood that each alignment feature 404*l* could alternatively be a projection that is configured to be received in an opening of the housing 404. The second segment 404*h* can include at least one barb 404*t* that is configured to form a friction fit with the receptacle of the housing 402 to limit backout.

The second segment 404*h* has a second pair of surfaces 404*e* that are opposite from one another. Each second surface 406*e* may be referred to as a broadside. The second segment 404*h* has a second pair of edges 404*f* that are opposite from one another and that extend between the second pair of surfaces 404*e*. The second segment 404*h* has a mating end 404*b* that is configured to mate with electrical contacts of a second electrical component (not shown). The mating end 404*b* can be referred to as a ground mating end. The second segment 404*h* has a second coupling end 404*r* that is offset from the mating end 404*b* along the longitudinal direction L. The second coupling end 404*r* can be referred to as a second ground coupling end. Each second segment 404*h* can have a width along the lateral direction A from one edge 404*f* to the other edge 404*f*, a thickness from one surface 404*e* to the other surface 404*e*, and a length from its mating end 404*b* to its second coupling end 404*r*. The length and width can be greater than the thickness. Further, in some embodiments, the width can be greater than the length.

The second segment 404*h* can define a plurality of mating-end openings 404*m* adjacent the mating end 404*b* that extend into at least one of the planar surfaces 404*e*. The mating-end openings 404*m* can be spaced from one another along the lateral direction A. The second segment 404*h* can include offset surfaces 404*n* for each mating-end opening 404*m*. Each offset surface 404*n* can be aligned with a respective one of the mating-end openings 404*m* along the transverse direction T. Further, each offset surface 404*n* can be offset from a respective one of the mating-end openings 404*m* with respect to the transverse direction T. Each offset surface 404*n* is configured to shield at least one contact beam 406*m*, such as a pair of contact beams 406*m*, from electrical contacts or a PCB inwardly of the ground contact 404 as shown in FIGS. 23 and 24.

The mating end 404*b* can define at least one mating feature 404*q*, such as a plurality of mating features 404*q*, that are configured to mate with electrical contacts of a second electrical component. The mating features 404*q* can be spaced from one another along the lateral direction A. Further, individual ones of the mating features 404*q* can be disposed between two of the mating-end openings 404*m* with respect to the lateral direction A. In one embodiment, each mating feature 404*q* can include a planar mating segment having a first planar surface configured to mate with at least one contact beam of the second electrical connector. For example, each mating feature 404*q* can include first and second planar surfaces that are configured to mate with opposed ground-contact beams of the second connector in a manner similar to that shown in FIG. 15. Thus, each mating feature 404*q* can be received between a pair of opposed ground-contact beams of the second electrical connector. In alternative embodiments, each mating feature 404*q* can define any other suitable mating interface such as (without limitation) a contact beam.

The second coupling end 404*r* can define at least one second coupling feature 409. The at least one coupling feature 409 can define, for example, a projection that is configured to be received in an opening of a respective one of the first segments 404*g*. However, it will be understood that the at least one coupling feature 409 can be any other suitable coupling feature, an opening that is configured to receive a projection of a respective one of the first segments 404*g*.

In some examples, the at least one second coupling feature 409 can include a plurality of second coupling features 409. The second coupling features 409 can be spaced from one another along the lateral direction A. At least some of the second coupling features 409 can be arranged in pairs, although embodiments of the disclosure are not so limited. In embodiments in which the second coupling features 409 are arranged in pairs, the second coupling features 409 of each pair can be spaced from one another by a first distance along the lateral direction A. Further, adjacent pairs can be spaced from one another by a second distance, the second distance being greater than the first distance. In some embodiments, the second distance can be at least as great as a width of one of the signal contacts 406 along the lateral direction A. In some such embodiments, the second distance can be at least as great as a width of two of the signal contacts 406 along the lateral direction A. Each pair of first coupling features 407 can be aligned with a mating feature 404*q*, although embodiments of the disclosure are not so limited.

Turning briefly to FIGS. 29 to 32, the first coupling feature 407 can be an opening that extends into a broadside 404*c* of the first segment 404*g* and at least partially through the first segment 404*g*. The opening can have a rectangular shape, a circular shape, or any other suitable shape for mating with a projection. The second coupling feature 409 can be a projection that is sized and configured to extend at least partially through the opening. The projection can have a rectangular shape, a circular shape, or any other suitable shape for mating with an opening. The projection can have a width along the lateral direction that is less than a width of from one edge 404*f* to the other edge 404*f*. In some embodiments, as shown in FIGS. 29 to 31, the opening can be spaced from the end of the first segment 404*g* such that a perimeter of the opening defines a closed shape in a plane that is aligned with the broadsides 404*c*. In other embodiments, as shown in FIG. 32, the opening can be open at the end of the first segment 404*g* such that a perimeter of the opening defines an open shape in a plane that is aligned with the broadsides 404*c*.

In some embodiments, the opening can extend entirely through the first segment 404*g* as shown in FIG. 30, such as through the pair of broadsides 404*c*. In other embodiments, the opening can extend partially through the first segment 404*g* so as to define a recess illustrated by the dashed line in FIG. 31. The projection can be sized and configured to extend into the opening and at least partially through the first segment 404*g*. For example, as shown in FIG. 30, the projection can be sized to extend entirely through the first segment 404*g* so that the projection extends into one broadside 404*c* and beyond the other broadside 404*c*. Thus, the opening can have a thickness along a direction, and the projection can have a length along the direction L that is greater than the thickness such that the projection extends entirely through the opening. Alternatively, the projection can be sized to extend partially, but not fully, through the first segment 404*g* as shown in FIG. 31. It will be understood that the projections and openings of FIGS. 29 to 32 can be reversed such that the first segment defines the projection and the second segment defines the opening. Thus, one of the first and second coupling features 407 and 709 can be an opening defined in one of the broadsides of the first and second pairs of broadsides 404*c* and 404*e*, and the other one of the first and second couplings 407 and 409 can be a projection that is configured to be received in the opening.

In each embodiment, the projection can be fixed in the opening by welding. Welding can be performed by laser welding, or any other suitable welding technology such as ultrasonic tip, and can use any suitable laser such as a red laser or a green laser. In examples where the projection extends entirely through the opening, the projection can be welded so as to melt the terminal end of the projection, thereby bonding the projection to the first segment. Melting the terminal end can cause a total physical length of the ground segment 404*h* to decrease. Melting the terminal end can additionally or alternatively cause a total physical width of the terminal end of the ground segment to increase. Thus, melting the terminal end of the projection can cause the terminal end to form a bead having, for example, a substantially hemispherical shape. In alternative embodiments, the projection can be fixed in the opening by press fit, bonding, welding, soldering, adhering, or any other suitable technique to join the first and second segments. Bonding can be performed using an epoxy or any other suitable adhesive. The epoxy or adhesive can be electrically conductive.

Returning to FIG. 28, the at least one first coupling feature 407 and the at least one second coupling feature 409 can be configured to couple to one another such that electrical contact defines an angle θ between 75 degrees and 105 degrees from the first segment 404*g* to the second segment 404*h*. When the first and second segments 404*g* and 404*h* are coupled to one another to form the ground contact 404, the ground contact 404 defines a continuous conductive path between the mounting end 404*a* and the mating end 404*b*. Further, the ground contact 404 defines at least one window 404*p*, such as a plurality of windows 404*p*, at an elbow of the ground contact 404. The elbow can be defined between the ground mounting end 404*a* and the ground mating end 404*b*, such as at a position where the first and second ground segments 404*g* and 404*h* are coupled to one another. Each window 404*p* is defined at a location that is aligned between two of the first coupling features 407 of the ground contact 404 and between two of the second coupling features 409 of the ground contact 404 with respect to the lateral direction A.

It will be understood that the first segment 404*g* can be implemented with one type of coupling feature (e.g., openings or projections) or can be implemented with different types of coupling features (e.g., openings and projections). Similarly, the second segment 404*h* can be implemented with one type of coupling feature (e.g., openings or projections) or can be implemented with different types of coupling features (e.g., openings and projections). Moreover, the first ground segment 404*g* and the first signal segments 406*g* can be implemented with the one type of coupling feature (e.g., projections or openings) or can be implemented with different types of coupling features (e.g., the first segment 404*g* can be implemented with openings and the first segments 406*g* can be implemented with projections, or vice versa). Similarly, the second ground segment 404*h* and the second signal segments 406*h* can be implemented with the one type of coupling feature (e.g., projections or openings) or can be implemented with different types of coupling features (e.g., the second segment 404*h* can be implemented with openings and the second segments 406*h* can be implemented with projections, or vice versa).

Referring back to FIG. 24, the arrangement of the ground contact 404 and the signal contacts 406 in a bank of contacts 405 will now be described. The signal contacts 406 can be arranged so as to be spaced from one another along a row direction. The row direction can be the lateral direction A. In some embodiments (as shown), the signal contacts 406 can be arranged in pairs, although embodiments of the disclosure are not so limited. Each pair of signal contacts 406 can define a differential signal pair. The signal contacts 406 in each pair can be arranged edge-to-edge, and spaced from one another by a first distance along the lateral direction A. The pair of signal contacts are edge-coupled. Individual pairs of signal contacts 406 can be spaced from one another by a second distance along the lateral direction A, the second distance being greater than the first distance. In some embodiments, the second distance can be at least as great as a width of one of the signal contacts 406 along the lateral direction A. In some such embodiments, the second distance can be at least as great as a width of two of the signal contacts 406 along the lateral direction A. FIG. 24 shows four pairs of signal contacts 406 and a single ground contact 404; however, it will be understood that any suitable number of signal contacts and ground contacts can be employed. In embodiments having multiple rows, the signal pairs can be offset from one row to the next along the transverse direction T such that a line extending between a pair of contacts in one row does not extend between a pair of contacts in an adjacent row.

The ground shield 404 can be spaced from the signal contacts 406 such that each of the windows 404*p* of the ground shield 404 is aligned with at least one of the signal contacts 406 along the inward-outward direction. Each signal contact 406 can be arranged outwardly from to the ground contact 404 such that the first signal segments 406*g* are spaced from the first ground segment 404*g* and the second signal segments 406*h* are spaced from the second ground segment 404*h*. Thus, a line can extend along the lateral direction A between the ground contact 404 and the first segments 406*g* of all of the signal contacts 406 without intersecting either the ground contact 404 or the signal contacts 406. Stated differently, a line can extend through the first segments 406*g* of all of the signal contacts 406 along the lateral direction A without extending through any portion of the ground contact 404. Similarly, a line can extend along the lateral direction A between the ground contact 404 and the second segments 406*h* of all of the signal contacts 406 without intersecting either the ground contact 404 or the signal contacts 406. Stated differently, a line can extend through the second segments 406*h* of all of the signal contacts 406 along the lateral direction A without extending through any portion of the ground contact 404. It will be noted that, in alternative embodiments, the positions of the ground contact 404 and the signal contacts 406 can be switched such that the signal contacts 406 are generally inwardly spaced from the ground contact 404.

The signal contacts 406 and ground contact 404 can be arranged relative to one another such that the signal mounting features 406*k* of the signal contacts 406 are in-line with one another and with the ground mounting features 404*k* of the ground contact 404 along the lateral direction A. Individual signal mounting features 406*k* can be disposed between two of the ground mounting features 404*k* with respect to the lateral direction A. In embodiments in which the signal contacts 406 are arranged in pairs, individual pairs of the signal mounting features 406*k* can be disposed between two of the ground mounting features 404*k* with respect to the lateral direction A. In embodiments in which the ground mounting features 404*k* are arranged in pairs, individual pairs of ground mounting features 404*k* can be disposed between two of the signal mounting features 406*k* with respect to the lateral direction A. In embodiments in which both the signal contacts 406 and the ground mounting features 404*k* are arranged in pairs, individual pairs of ground mounting features 404*k* can be disposed between two pairs of the signal mounting features 406*k* with respect to the lateral direction A. Similarly, individual pairs of the signal mounting features 406*k* can be disposed between two pairs of the ground mounting features 404*k* with respect to the lateral direction A.

The signal contacts 406 can be arranged relative to the ground contact 404 such that the contact beam 406*m* of each signal contact 406 is aligned with one of the mating-end openings 404*m* along the transverse direction T. Thus, each contact beam 406*m* is configured to deflect into a corresponding mating-end opening 404*m* when the contact beam 406*m* mates with a mating end of the second electrical connector. Preferably, each contact beam 406*m* can deflect into a corresponding opening 404*m* such that the body 406*n* of the contact beam 406*m* is substantially in-plane with the mating features 404*q* when the contact beam 406*m* is mated with the second electrical connector. In embodiments in which the signal contacts 406 are arranged in pairs, each mating-end opening 404*m* can be aligned with the contact beams 406*m* of one pair of the signal contacts 406. The offset surfaces 404*n* of the ground contact 404 can be aligned with the broadsides 406*e* of the signal contacts 406 along the transverse direction T when the signal contacts 406 are in the adjacent position with respect to the ground contact 404.

The ground contact 404 and the signal contacts 406 can maintained in the adjacent position discussed above by at least one dielectric or electrically insulative insert body. For example, the first segments 406*g* of the signal contacts 406 and the first segment 404*g* of the ground contact 404 can be supported by a first insert body 408. Further, the second segments 406*h* of the signal contacts 406 and the second segment 404*h* of the ground contact 404 can be supported by a second insert body 412. The ground contact 404 and the signal contacts 406 can be affixed to the first and second insert bodies 408 and 412 by insert molding, stitching, press fitting, or any other suitable technique for affixing an electrical contact to a housing.

The second segment 404*h* of the ground contact 404 is generally planar along the lateral direction A and the longitudinal direction L. Further, the first segment 404*g* of the ground contact 404 is generally planar along the angularly offset direction $D_{AO}$. In one example, the angularly offset direction $D_{AO}$ is the transverse direction T. Thus, the first segment 404*g* can be substantially perpendicular to the second segment 404*h*.

The second segments 406*h* of the signal contacts 406 can be in-plane with one another along a plane that extends in the lateral direction A and the longitudinal direction L. The first segments 406*g* of the signal contacts 406 can be in-plane with one another along a plane that extends along the lateral direction A and the angularly offset direction $D_{AO}$. In one example, the angularly offset direction $D_{AO}$ is the transverse direction T. Thus, the second segments 406*h* can be substantially perpendicular to the first segments 406*g*. The first segments 406*g* of the signal contacts 406 can be substantially parallel to the first segment 404*g* of the ground contact 404. The second segments 406*h* of the signal contacts 406 can be substantially parallel to the second segment 404*g* of the ground contact 404.

Referring back to FIGS. 22 and 24, a method of assembling the angled connector 400 will now be described. The method comprises attaching at least one bank 405(1) and 405(2) of electrical contacts to the housing 402 of the electrical connector 400, where each bank 405(1) and 405(2) comprises a plurality of signal contacts 406 arranged in a row along a lateral direction A, and a ground shield 404 offset from the signal contacts 406 along an inward-outward direction, perpendicular to the lateral direction A. It will be understood that the method can be performed for connectors having as few as one bank of electrical contacts or more than one bank, and for connectors having as few as one row of electrical contacts or more than one row. In embodiments that employ a plurality of rows of banks 405(1) and 405(2), the rows can be attached the connector housing 402 in an order that begins at the bottom-most or inner-most row $R_1$ and ends at the upper-most or outer-most row $R_4$. For example, the at least one bank can comprise a first bank 405(1) and a second bank 405(1) for first and second rows $R_1$ and $R_2$, respectively, and the method can comprise attaching the second bank after the first bank such that the second bank is spaced from the first bank along an outward direction that is perpendicular to the lateral direction A.

Each bank 405(1) and 405(2) can be attached to the housing 402 by inserting a second lead frame 410(2) of the bank into a receptacle of the housing 402, and then subsequently coupling a first lead frame 410(1) to the second lead frame 410(2). However, it will be noted that in alternative embodiments, the first and second lead frames 410(1) and 410(2) can be coupled to one another before the second lead frame 410(2) is inserted into the receptacle. The step of coupling the first lead frame 410(1) to the second lead frame 410(2) can comprise, for each signal contact 406, coupling a first signal segment 406*g* of the signal contact 406 to a second signal segment 406*h* of the signal contact 406 so as to define an angle between 75 degrees and 105 degrees between the first and second signal segments 406*g* and 406*h*, and so as to define a continuous conductive path from a mounting end 406*a* of the first signal segment 406*g* to a mating end 406*b* of the second signal segment 406*h*. This step can also comprise coupling a first ground segment 404*g* of the ground shield 404 to a second ground segment 404*h* of the ground shield 404 so as to define an angle between 75 degrees and 105 degrees between the first and second ground segments 404*g* and 404*h*, and so as to define a continuous conductive path from a mounting end 404*a* of the first ground segment 404*g* to a mating end 404*b* of the second ground segment 404*h*. In coupling the first ground segment 404*g* to the second ground segment 404*h*, the first ground segment 404*g* can be abutted against an abutment surface 402*g* of the housing 402 so as to orient the first ground segment 404*g* at an angle of between 75 degrees and 105 degrees with respect to the second ground segment 404*h*.

The first signal segments 406*g* can be coupled to the second signal segments 406*h* by receiving a projection of one of the first and second signal segments 406*g* and 406*h* into an opening of the other one of the first and second signal segments 404*g* and 404*h*. The first ground segment 404*g* can be coupled to the second ground segment 404*h* by receiving a projection of one of the first and second ground segments 404*g* and 404*h* into an opening of the other one of the first and second ground segments 404*g* and 404*h*. Additionally, or alternatively, each first signal segment 406*g* can be coupled to a corresponding second signal segment 406*h* by welding the first and second signal segments 406*g* and 406*h* to one another. The first ground segment 404*g* can be coupled to the second ground segment 404*h* by welding the first and second ground segments 404*g* and 404*h* to one another. The welding can comprise melting a coupling feature 407 or 409, such as at least a portion of a projection, of one of the first and second signal segments 406*g* and 406*h* so as to bond the coupling feature to the other one of the first and second signal segments 406*g* and 406*h*. Similarly, the welding can comprise melting a coupling feature 407 or 409, such as at least a portion of a projection, of one of the first and second ground segments 404*g* and 404*h* so as to bond the coupling feature to the other one of the first and second ground segments 404*g* and 404*h*. In some embodiments, the coupling feature can be a projection that extends entirely through the other one of the first and second signal segments 404*g* and 404*h*, and the end of the projection that extends through the other one of the first and second signal segments 404*g* and 404*h* can be melted by welding.

Returning to FIG. 18, the electrical connector 400 can have edge-coupled differential signal pairs and can transfer data signals between the mating ends and the mounting ends of the electrical contacts at a rate of between approximately 54 Gigabits per second at 27 GHz and approximately 80 Gigabits per second at 40 GHz, with a near-end cross talk power sum that is between −40 dB and −80 dB through 40 GHz at 8.5 picosecond rise time (10 percent to 90 percent), with a far-end cross talk power sum that is between −40 dB and −80 dB through 40 GHz at 8.5 picosecond rise time (10 percent to 90 percent), and keeping differential insertion loss in a range between 0 and −2 dB through 27 GHz and in a range between 0 and −4 dB through 40 GHz.

With continued reference to FIG. 18, the dimensions of the electrical connectors of the present disclosure will now be described. Although the dimensions are described with reference to FIG. 18, it will be understood that the corresponding dimensions of the electrical connector 100 can be the same as the dimensions below. Each pair of signal contacts 406 can define a center that is midway between the signal contacts 406 of the pair along the lateral direction A. The pairs of signal contacts 406 in each bank 405 can define a distance $d_1$ from the center of one pair to the center of an adjacent pair. The center-to-center distance $d_1$ can define a signal-contact pitch along the lateral direction A. The signal-contact pitch can be constant within each bank, and from one bank to the next. Thus, the banks 405 in each row can have a constant signal-contact pitch, and the banks 405 in each row can have a signal-contact pitch that is the same as the signal-contact pitch of the banks 405 in each other row. Thus, it can be said that the electrical connector 400 has a constant signal-contact pitch. In some examples, the distance $d_1$ can be approximately 3.2 mm, such as within +10 percent of 3.2 mm. For example, the distance $d_1$ can be in the range of 2.88 mm to 3.52 mm.

Similarly, each ground shield 404 can define a ground-contact center that is midway between two adjacent pairs of signal contacts 406 with respect to the lateral direction A. For example, the ground-contact center can be a center of a mating feature 404*q* or center of a mounting feature 404*k*. Each ground shield 404 can define a distance $d_2$ from one ground-contact center to an adjacent ground-contact center. The center-to-center distance $d_2$ can define a ground-contact pitch along the lateral direction A. The ground-contact pitch can be constant within each ground shield 404, and from one ground shield 404 to the next. Thus, the ground shields 404 in each row can have a constant ground-contact pitch, and the ground shields 404 in each row can have a ground-contact pitch that is the same as the ground-contact pitch of the ground shields 404 in each other row. Thus, it can be said that the electrical connector 400 has a constant ground-contact pitch. In some examples, the distance $d_2$ can be approximately 3.2 mm, such as within +10 percent of 3.2 mm. For example, the distance $d_2$ can be in the range of 2.88 mm to 3.52 mm.

The electrical connector 400 can define a centerline of each row that extends along the lateral direction. The electrical connector 400 can define a distance $d_3$ from the centerline of one row to the centerline of the next row along the transverse direction T. The center-to-center distance $d_3$ can define a row pitch along the transverse direction T. The row pitch can be constant from one row to the next. Thus, it can be said that the electrical connector 400 has a constant row pitch. In some examples, the distance $d_3$ can be approximately 1.8 mm, such as within ±10 percent of 1.8 mm. For example, the distance $d_2$ can be in the range of 1.62 mm to 1.98 mm.

The pairs of signal contacts 406 can be staggered from one row to the next. For example, the first pair of signal contacts in each row can be offset from the first pair of signal contacts in the next row by a distance $d_4$. The distance $d_4$ can be from a center of the first pair in each row to the center of the first pair in the next row. In some examples, the distance $d_4$ can be approximately 1.2 mm, such as within ±10 percent of 1.2 mm. For example, the distance $d_4$ can be in the range of 1.08 mm to 1.32 mm.

The mating end 402*b* of the electrical connector 400 (and electrical connector 100) can include a signal-contact field defined by one column of banks 405. In particular, the signal-contact field can be defined by an imaginary perimeter or box having (i) a width that extends along the lateral direction A between the outermost points of the outermost signal contacts of one column of banks 405 and (ii) a height that extends along the transverse direction T between the outermost points of the outermost rows of signal contacts. For example, the signal-contact field can have (i) a width along the lateral direction A from the outermost point of the right-most signal contact in row $R_1$ to the outermost point of the fourth signal pair (i.e., the outermost point of the eighth signal contact 406) in row $R_4$ as counted from right to left, and (ii) a height along the transverse direction T from the uppermost point of the right-most signal contact in row $R_1$ to the lowermost point of the fourth signal pair (i.e., the lowermost point of the eighth signal contact 406) in row $R_4$ as counted from right to left.

The width of the signal-contact field along the lateral direction A can be approximately 11.69 mm, such as within ±10 percent of 11.69 mm. As shown, the signal-contact field can have a lateral signal-contact density of four signal pairs (i.e., eight signal contacts 406) per approximately 11.69 mm along the lateral direction A, such as four signal pairs within ±10 percent of 11.69 mm. The height of the signal-contact field along the transverse direction T can be approximately 5.86 mm, such as within ±10 percent of 5.86 mm. As shown, the signal-contact field can have a transverse signal-contact density of four signal pairs (i.e., eight signal contacts 406) per approximately 5.86 mm along the transverse direction T, such as four signal pairs within ±10 percent of 5.86 mm. Further, the signal-contact field can have an areal density that is equal to the product of the lateral signal-contact density and the transverse signal-contact density. Thus, the areal density can be approximately 68.50 square mm (i.e., 11.69 mm×5.86 mm), such as between 55.49 square mm (i.e., (11.69 mm−10 percent)×(5.86 mm−10 percent)) and 82.89 square mm (i.e., (11.69 mm+10 percent)×(5.86 mm+10 percent)).

It will be appreciated by those skilled in the art that changes could be made to the embodiments described above without departing from the broad inventive concept thereof. Furthermore, it should be appreciated that the structure, features, and methods as described above with respect to any of the embodiments described herein can be incorporated into any of the other embodiments described herein unless otherwise indicated. It is understood, therefore, that this invention is not limited to the particular embodiments disclosed, but it is intended to cover modifications within the spirit and scope of the present disclosure.

Unless explicitly stated otherwise, each numerical value and range in the present disclosure should be interpreted as being approximate as if the word "about" or "approximately" preceded the value of the value or range.

What is claimed is:

1. A ground shield for an electrical connector, the ground shield comprising:

a first segment having a first pair of broadsides that are opposite one another, a first pair of edges that are opposite one another and that extend between the first pair of broadsides, a mounting end that is configured to mount to a first electrical component, and a first coupling end offset from the mounting end, the first coupling end defining a plurality of first coupling features; and a second segment separate from the first segment, the second segment having a second pair of broadsides that are opposite one another, a second pair of edges that are opposite one another and that extend between the second pair of broadsides, a mating end that is configured to mate with a second electrical component, and a second coupling end offset from the mating end, the second coupling end defining a plurality of second coupling features, wherein the plurality of first coupling features and the plurality of second coupling features are coupled to one another such that electrical contact defines an angle of approximately 90 degrees between the first and second segments and the first and second segments define a continuous conductive path between the mounting end and the mating end, and wherein the mounting end is oriented along a transverse direction, the mating end is oriented along a longitudinal direction that is transverse to the transverse direction, the plurality of first coupling features are spaced from one another along a lateral direction that is perpendicular to each of the transverse direction and the longitudinal direction, and the plurality of second coupling features are spaced from one another along the lateral direction.

2. The ground shield of claim 1, wherein the plurality of first coupling features and the plurality of second coupling features are welded to one another.

3. The ground shield of claim 1, wherein one of the first and second coupling features is an opening that extends into at least one of the broadsides of a respective one of the first and second segments, and the other one of the first and second coupling features is a projection that is configured to be received in the opening.

4. The ground shield of claim 1, wherein the electrical contact is a ground contact, the first segment is a first ground plate, and the second segment is a second ground plate.

5. A plurality of electrical contacts for an angled connector, the plurality of electrical contacts comprising:

a plurality of signal contacts that are spaced from one another in a row along a lateral direction, each signal contact comprising:

a first signal segment having a signal mounting end that is configured to mount to a first electrical component, and a first signal coupling end offset from the signal mounting end; and a second signal segment having a signal mating end that is configured to mate with a second electrical component, and a second signal coupling end offset from the signal mating end, the second signal coupling end being coupled to the first signal coupling end such that the signal contact defines an angle between 75 degrees and 105 degrees between the first and second signal segments, and so as to define a continuous conductive path from the signal mounting end to the signal mating end; and a ground shield that is spaced from the signal contacts along an inward-outward direction, perpendicular to the lateral direction, the ground shield comprising:

a first ground segment having a ground mounting end that is configured to mount to a first electrical component, and a first ground coupling end offset from the ground mounting end; and a second ground segment having a ground mating end that is configured to mate with a second electrical component, and a second ground coupling end offset from the ground mating end, the second ground coupling end being coupled to the first ground coupling end such that the ground shield defines an angle between 75 degrees and 105 degrees between the first and second ground segments and so as to define a continuous conductive path from the ground mounting end to the ground mating end, wherein the first and second signal segments of each signal contact define first and second coupling features, respectively, that couple the first and second signal segments of the signal contact to one another, and wherein the first and second ground segments define at least first and second coupling features, respectively, that couple the first and second ground segments to one another.

6. The plurality of electrical contacts of claim 5, wherein the first and second signal segments of each signal contact are welded to one another, and the first and second ground segments of the ground contact are welded to one another.

7. The plurality of electrical contacts of claim 5, wherein:

one of the first and second coupling features of each signal contact defines an opening, and the other of the first and second coupling features of each signal contact defines a projection received in the opening; and one of the first and second coupling features of the ground contact defines an opening, and the other of the first and second coupling features of the ground contact defines a projection received in the opening of the ground contact.

8. An angled electrical connector comprising a plurality of electrical contacts, wherein at least one of the electrical contacts is configured as recited in claim 5.

9. The angled electrical connector of claim 8, wherein each of the plurality of electrical contacts is configured as recited in claim 5.

10. The angled electrical connector of claim 9, wherein the angled electrical connector is configured to transfer data signals between the mating ends and the mounting ends of the electrical contacts at a rate of between approximately 54 Gigabits per second at 27 GHz and approximately 80 Gigabits per second at 40 GHz.

11. The angled electrical connector of claim 10, wherein the electrical connector has a near-end cross talk power sum that is between −40 dB and −80 dB through 40 GHz at 8.5 picosecond rise time (10 percent to 90 percent).

12. The angled electrical connector of claim 10, wherein the electrical connector has a far-end cross talk power sum that is between −40 dB and −80 dB through 40 GHz at 8.5 picosecond rise time (10 percent to 90 percent).

13. The angled electrical connector of claim 10, wherein the electrical connector has a differential insertion loss in a range between 0 and −2 dB through 27 GHz and in a range between 0 and −4 dB through 40 GHz.

14. A method of assembling an angled electrical connector, the method comprising:

attaching at least one bank of electrical contacts to a housing of the electrical connector, each bank comprising a plurality of signal contacts arranged in a row along a lateral direction, a ground shield offset from the signal contacts along an inward-outward direction, perpendicular to the lateral direction, the attaching for each bank comprising:

coupling, for each signal contact, a first signal segment of the signal contact to a second signal segment of the signal contact so as to define an angle between 75 degrees and 105 degrees between the first and second signal segments, and so as to define a continuous conductive path from a mounting end of the first signal segment to a mating end of the second signal segment; and coupling a first ground segment of the ground shield to a second ground segment of the ground shield so as to define an angle between 75 degrees and 105 degrees between the first and second ground segments, and so as to define a continuous conductive path from a mounting end of the first ground segment to a mating end of the second ground segment.

15. The method of claim 14, wherein coupling the first signal segment to the second signal segment comprises receiving a projection of one of the first and second signal segments into an opening of the other one of the first and second signal segments, and coupling the first ground segment to the second ground segment comprises receiving a projection of one of the first and second ground segments into an opening of the other one of the first and second ground segments.

16. The method of claim 14, wherein coupling the first signal segment to the second signal segment comprises welding the first and second signal segments to one another, and coupling the first ground segment to the second ground segment comprises welding the first and second ground segments to one another.

17. The method of claim 16, wherein welding the first and second signal segments comprises melting a coupling feature of one of the first and second signal segments so as to bond the coupling feature to the other one of the first and second signal segments.

18. The method of claim 17, wherein the coupling feature is a projection that extends through the other one of the first and second signal segments.

19. The method of claim 14, wherein the first ground segment includes a first plurality of first coupling features, the second ground segment includes a plurality of second coupling features, coupling the first ground segment to the second ground segment includes coupling the first and second coupling features to one another.

* * * * *